US007766022B2

(12) United States Patent
Livacich et al.

(10) Patent No.: US 7,766,022 B2
(45) Date of Patent: Aug. 3, 2010

(54) MODULAR SYSTEM FOR CONCEALMENT AND SHELTER

(75) Inventors: John Livacich, Sunnyvale, CA (US); Kendyl A. Roman, Sunnyvale, CA (US)

(73) Assignee: Eurio, Inc., Santa Clara, CA (US)

( * ) Notice: Subject to any disclaimer, the term of this patent is extended or adjusted under 35 U.S.C. 154(b) by 233 days.

(21) Appl. No.: 11/295,305

(22) Filed: Dec. 5, 2005

(65) Prior Publication Data

US 2006/0283491 A1 Dec. 21, 2006

Related U.S. Application Data

(63) Continuation-in-part of application No. 11/155,398, filed on Jun. 16, 2005.

(51) Int. Cl.
*E04H 15/30* (2006.01)

(52) U.S. Cl. ..... 135/95

(58) Field of Classification Search ..... 135/114, 135/117, 118, 120.1, 124, 125, 127, 909, 135/91, 93, 115, 94, 95; 403/296
See application file for complete search history.

(56) References Cited

U.S. PATENT DOCUMENTS

| | | | | |
|---|---|---|---|---|
| 74,933 | A | 2/1868 | Palmer | |
| 305,140 | A * | 9/1884 | Bradley | 285/396 |
| 513,841 | A * | 1/1894 | Tolmie | 135/117 |
| 528,392 | A * | 10/1894 | Rinn | 135/120.3 |
| 891,622 | A | 6/1908 | Kroder | |
| 926,945 | A | 7/1909 | Howland | |
| 1,051,252 | A * | 1/1913 | Parker | 135/87 |
| 1,079,431 | A | 11/1913 | Nitka | |
| 1,288,518 | A | 12/1918 | Collier | |
| 1,298,634 | A | 4/1919 | Allen | |
| 1,435,110 | A | 11/1922 | Efford | |

(Continued)

FOREIGN PATENT DOCUMENTS

| | | |
|---|---|---|
| EP | 222048 | 11/1985 |

(Continued)

*Primary Examiner*—David Dunn
*Assistant Examiner*—Noah Chandler Hawk

(57) ABSTRACT

An easy to use, universal, simple, lightweight, compact, portable, dynamically configurable and modular system of concealment and shelter. An operator configures a number of concealment blinds or shelters using brackets, supports, segmented shafts, covers, curtains, and skirts, and more complex modules. The segmented shafts have both the ability to make an attachment to retain a particular configuration while being able to break down the shafts for transportation or storage. The brackets and supports are used to secure a configuration to a tree, the ground, or a hand held device. Advanced modules include user adjustable domes and cylindrical arches. The system can be configured for placement on a hillside or over rough terrain and obstacles. Multiple modules can be carried by separate members of a group and combined together to form a more complex structure to meet the needs of the group. The system provides a novel star window with independently opening sections. The window openings are configured in a number of configurations to meet the needs of the user. The configuration of the structure is changed by the user to quickly provide cover, increase cover, and to adapt to terrain or changing weather. The system includes a low cost method of tightening the skin on a cover to reduce wind movement and noise.

29 Claims, 48 Drawing Sheets

U.S. PATENT DOCUMENTS

| | | | | | |
|---|---|---|---|---|---|
| 1,516,372 | A | | 11/1924 | Brooks | |
| 1,528,910 | A | | 3/1925 | Carlson | |
| 1,572,845 | A | | 2/1926 | Efford et al. | |
| 1,619,740 | A | | 3/1927 | Long et al. | |
| 1,649,219 | A | | 3/1927 | Goldberg | |
| 2,069,479 | A | * | 2/1937 | Pluth | 135/115 |
| 2,159,273 | A | | 5/1939 | Killinger | |
| 2,175,501 | A | | 10/1939 | Bergh | |
| 2,186,482 | A | | 1/1940 | Frank | |
| 2,188,747 | A | | 1/1940 | Bittick | |
| 2,573,414 | A | | 10/1951 | Dunn | |
| 2,619,101 | A | | 11/1952 | McGerry et al. | |
| 2,712,950 | A | * | 7/1955 | Siebert | 285/7 |
| 2,826,758 | A | | 3/1958 | Kahn | |
| 2,835,262 | A | | 5/1958 | Collins | |
| 2,865,386 | A | | 12/1958 | Burns | |
| 2,888,021 | A | | 5/1959 | Adams | |
| 2,928,404 | A | | 3/1960 | Klages | |
| 3,039,478 | A | | 6/1962 | Timmons | |
| 3,052,249 | A | * | 9/1962 | Seaman et al. | 135/125 |
| 3,068,046 | A | | 12/1962 | Bourgoin | |
| 3,116,746 | A | | 1/1964 | Bird | |
| 3,165,110 | A | | 1/1965 | Brooks | |
| 3,195,898 | A | | 7/1965 | Respini | |
| 3,356,098 | A | * | 12/1967 | Krutzikowsky | 135/93 |
| 3,441,037 | A | | 4/1969 | Transeau | |
| 3,468,299 | A | | 9/1969 | D'Amato | |
| 3,474,802 | A | * | 10/1969 | Loring | 135/125 |
| 3,480,023 | A | * | 11/1969 | McConnell et al. | 135/125 |
| 3,515,194 | A | | 6/1970 | Carhart et al. | |
| 3,537,688 | A | | 11/1970 | Stein | |
| 3,586,013 | A | * | 6/1971 | Gladden | 135/120.1 |
| 3,590,864 | A | | 7/1971 | Vechesloff | |
| 3,610,323 | A | | 10/1971 | Troyer | |
| 3,794,054 | A | | 2/1974 | Watts | |
| 3,800,814 | A | * | 4/1974 | Hibbert | 135/93 |
| 3,855,635 | A | | 12/1974 | Ramirez | |
| 3,911,499 | A | | 10/1975 | Benevento et al. | |
| 3,950,789 | A | | 4/1976 | Konz et al. | |
| 3,957,069 | A | | 5/1976 | Denaro | |
| 4,055,173 | A | | 10/1977 | Knab | |
| 4,084,599 | A | | 4/1978 | Matthews | |
| 4,146,933 | A | | 4/1979 | Jenkins et al. | |
| 4,175,576 | A | | 11/1979 | Iby | |
| 4,192,333 | A | * | 3/1980 | Sato | 135/124 |
| 4,256,129 | A | | 3/1981 | Gilsenan | |
| 4,263,925 | A | | 4/1981 | Arganbright | |
| 4,352,362 | A | | 10/1982 | Nichols | |
| 4,369,528 | A | | 1/1983 | Vest et al. | |
| 4,449,542 | A | | 5/1984 | McSwain et al. | |
| 4,494,248 | A | | 1/1985 | Holder | |
| 4,524,463 | A | | 6/1985 | Ogden | |
| 4,558,468 | A | | 12/1985 | Landry et al. | |
| 4,576,364 | A | | 3/1986 | O'Fearna | |
| 4,578,825 | A | | 4/1986 | Vote | |
| 4,587,671 | A | | 5/1986 | Rodriguez et al. | |
| 4,651,727 | A | | 3/1987 | Howorth | |
| 4,653,120 | A | | 3/1987 | Leaf | |
| 4,696,066 | A | | 9/1987 | Ball et al. | |
| 4,718,210 | A | | 1/1988 | McCourt et al. | |
| 4,750,509 | A | | 6/1988 | Kim | |
| 4,787,101 | A | | 11/1988 | Feinberg | |
| 4,827,958 | A | * | 5/1989 | Cantwell et al. | 135/127 |
| 4,838,293 | A | * | 6/1989 | Novak | 135/100 |
| 4,858,635 | A | * | 8/1989 | Eppenbach | 135/125 |
| 4,911,573 | A | * | 3/1990 | Pietro | 403/349 |
| 4,914,752 | A | | 4/1990 | Hinson et al. | |
| 4,945,936 | A | | 8/1990 | Surrendi | |
| 4,964,282 | A | | 10/1990 | Wagner | |
| 5,062,234 | A | | 11/1991 | Green | |
| 5,062,424 | A | | 11/1991 | Hooker | |
| 5,180,143 | A | | 1/1993 | Brower | |
| 5,218,982 | A | | 6/1993 | Kenji | |
| 5,255,390 | A | | 10/1993 | Gross et al. | |
| 5,259,077 | A | | 11/1993 | Hager et al. | |
| 5,299,331 | A | | 4/1994 | Badillo | |
| 5,301,706 | A | | 4/1994 | Jones | |
| 5,304,213 | A | | 4/1994 | Berke et al. | |
| 5,333,634 | A | | 8/1994 | Taylor | |
| 5,360,439 | A | | 11/1994 | Dickeroff et al. | |
| 5,367,710 | A | | 11/1994 | Karmin | |
| 5,411,541 | A | | 5/1995 | Bell et al. | |
| 5,443,488 | A | | 8/1995 | Namenmye et al. | |
| 5,479,954 | A | | 1/1996 | Lin | |
| 5,564,232 | A | | 10/1996 | Callaway | |
| 5,572,742 | A | | 11/1996 | McFadden | |
| 5,575,006 | A | | 11/1996 | Wolfe | |
| 5,609,176 | A | | 3/1997 | Weeks | |
| 5,611,087 | A | | 3/1997 | Adkins | |
| 5,620,482 | A | | 4/1997 | Augustine et al. | |
| 5,647,660 | A | | 7/1997 | Lee | |
| 5,697,963 | A | | 12/1997 | Augustine | |
| 5,746,555 | A | | 5/1998 | McEvoy | |
| 5,785,716 | A | | 7/1998 | Bayron | |
| 5,865,355 | A | | 2/1999 | Camara | |
| 5,871,026 | A | | 2/1999 | Lin | |
| 5,876,011 | A | | 3/1999 | Blasing | |
| 5,891,187 | A | | 4/1999 | Winthrop et al. | |
| 5,934,628 | A | | 8/1999 | Bosnakovic | |
| 5,937,883 | A | | 8/1999 | Camara | |
| 5,970,519 | A | | 10/1999 | Weber | |
| 5,974,605 | A | | 11/1999 | Dickerhoff et al. | |
| 6,049,907 | A | | 4/2000 | Palomo | |
| 6,148,836 | A | | 11/2000 | Cananzey | |
| 6,154,883 | A | | 12/2000 | Spann et al. | |
| 6,199,572 | B1 | | 3/2001 | Rousselle et al. | |
| 6,200,060 | B1 | | 3/2001 | Vernay | |
| 6,216,270 | B1 | | 4/2001 | Moquin et al. | |
| 6,230,728 | B1 | | 5/2001 | Reese | |
| 6,230,928 | B1 | | 5/2001 | Hanna et al. | |
| 6,235,659 | B1 | | 5/2001 | McAmish et al. | |
| 6,279,877 | B1 | * | 8/2001 | Davis | 254/134.3 FT |
| 6,286,531 | B1 | | 9/2001 | Joo-Tai | |
| 6,336,465 | B1 | | 1/2002 | Surrendi et al. | |
| 6,354,316 | B1 | | 3/2002 | Chen | |
| 6,378,136 | B2 | | 4/2002 | Matsushita | |
| 6,434,877 | B1 | | 8/2002 | Shelton | |
| 6,450,187 | B1 | * | 9/2002 | Lin et al. | 135/114 |
| 6,484,321 | B1 | | 11/2002 | Shamam | |
| 6,511,501 | B1 | | 1/2003 | Augustine et al. | |
| 6,523,558 | B1 | | 2/2003 | Gillis | |
| 6,524,332 | B1 | | 2/2003 | Augustine et al. | |
| 6,551,347 | B1 | | 4/2003 | Elkins | |
| 6,571,574 | B1 | | 6/2003 | Blackstone | |
| 6,581,617 | B2 | | 6/2003 | Ham et al. | |
| 6,596,019 | B2 | | 7/2003 | Turner et al. | |
| 6,647,552 | B1 | | 11/2003 | Hogan | |
| 6,662,492 | B2 | | 12/2003 | Oliver | |
| 6,679,009 | B2 | * | 1/2004 | Hotes | 52/86 |
| 6,679,277 | B2 | * | 1/2004 | Choi | 135/93 |
| 6,694,522 | B1 | | 2/2004 | Neal | |
| 6,718,565 | B1 | * | 4/2004 | Cruz | 4/476 |
| 6,766,623 | B1 | | 7/2004 | Kalnay | |
| 6,776,177 | B2 | | 8/2004 | Wu | |
| 6,792,622 | B2 | | 9/2004 | Graves | |
| 6,799,332 | B2 | | 10/2004 | Hatton | |
| 6,851,125 | B2 | | 2/2005 | Fujikawa et al. | |
| 6,876,884 | B2 | | 4/2005 | Hansen et al. | |
| 6,925,686 | B2 | * | 8/2005 | Heathcock et al. | 16/429 |
| 6,997,199 | B1 | | 2/2006 | Wright | |
| 7,001,416 | B2 | | 2/2006 | Augustine et al. | |
| 7,044,145 | B2 | | 5/2006 | Bouchard | |
| 7,100,626 | B2 | | 9/2006 | Livacich | |
| 7,152,614 | B2 | | 12/2006 | Kalnay | |

| | | | | |
|---|---|---|---|---|
| 7,226,454 | B2 | 6/2007 | Albrecht et al. | |
| 7,264,011 | B2 | 9/2007 | Cohen | |
| 7,276,076 | B2 | 10/2007 | Bieberich | |
| 7,364,584 | B2 | 4/2008 | Anderson | |
| 2002/0020439 | A1 | 2/2002 | Tate | |
| 2002/0026742 | A1 | 3/2002 | Washington | |
| 2004/0099299 | A1 | 5/2004 | Wu | |
| 2004/0159346 | A1 | 8/2004 | Huang | |
| 2005/0015127 | A1 | 1/2005 | Bieberich | |
| 2005/0016573 | A1 | 1/2005 | Wu | |
| 2005/0092355 | A1* | 5/2005 | Hsu | 135/125 |
| 2005/0143796 | A1 | 6/2005 | Augustine et al. | |
| 2005/0161069 | A1 | 7/2005 | Wu | |
| 2005/0183761 | A1 | 8/2005 | Livacich | |
| 2005/0252541 | A1 | 11/2005 | Chen | |
| 2006/0000499 | A1 | 1/2006 | Livacich | |
| 2006/0016467 | A1 | 1/2006 | Bae | |
| 2006/0037636 | A1 | 2/2006 | Lin | |
| 2006/0047332 | A1 | 3/2006 | Malmberg et al. | |
| 2006/0122671 | A1 | 6/2006 | Albrecht et al. | |
| 2006/0122672 | A1 | 6/2006 | Anderson | |
| 2006/0147320 | A1 | 7/2006 | Hansen et al. | |
| 2006/0162756 | A1 | 7/2006 | Gao | |
| 2006/0184216 | A1 | 8/2006 | Van Duren | |
| 2006/0184217 | A1 | 8/2006 | Van Duren | |
| 2006/0184218 | A1 | 8/2006 | Bieberich | |
| 2006/0185704 | A1 | 8/2006 | Guo et al. | |
| 2006/0259104 | A1 | 11/2006 | Panser | |
| 2006/0283492 | A1 | 12/2006 | Livacich | |
| 2007/0000533 | A1 | 1/2007 | Tseng | |
| 2007/0093882 | A1 | 4/2007 | Anderson et al. | |
| 2007/0093883 | A1 | 4/2007 | Anderson et al. | |
| 2007/0093884 | A1 | 4/2007 | Anderson et al. | |
| 2007/0093885 | A1 | 4/2007 | Anderson et al. | |
| 2007/0175504 | A1 | 8/2007 | Tseng | |
| 2007/0239239 | A1 | 10/2007 | Albrecht et al. | |
| 2008/0006317 | A1 | 1/2008 | Livacich | |
| 2008/0027521 | A1 | 1/2008 | Bieberich | |
| 2008/0027522 | A1 | 1/2008 | Bieberich | |
| 2008/0125840 | A1 | 5/2008 | Anderson | |
| 2009/0065039 | A1 | 3/2009 | Livacich | |

FOREIGN PATENT DOCUMENTS

| | | |
|---|---|---|
| GB | 475811 | 11/1937 |
| GB | 2054002 | 2/1981 |
| GB | 2259927 | 3/1993 |
| GB | 2265165 | 9/1993 |
| GB | 1 462 033 | 1/1997 |
| JP | 5113059 | 5/1993 |
| SE | 525 415 | 2/2005 |
| WO | WO 97/14381 | 4/1997 |
| WO | WO 98/48652 | 11/1998 |
| WO | WO 00/62726 | 10/2000 |
| WO | WO 03/086500 | 10/2003 |
| WO | WO 03/106897 | 12/2003 |
| WO | WO 2004/004500 | 1/2004 |
| WO | WO 2006/020170 | 2/2006 |
| WO | WO 2006/062910 | 6/2006 |
| WO | WO 2006/063027 | 6/2006 |
| WO | WO 2006/086587 | 8/2006 |
| WO | WO 2007 047917 | 4/2007 |
| WO | WO 2008 013603 | 1/2008 |
| WO | WO 2008 091486 | 7/2008 |

* cited by examiner

Inside View

Top View

Camouflage pattern © Mossy Oak®

MODULAR SYSTEM FOR CONCEALMENT AND SHELTER

RELATED APPLICATIONS

This application is a continuation-in-part of, and claims priority based on, U.S. patent application Ser. No. 11/155,398, filed Jun. 16, 2005, entitled "MODULAR SYSTEM FOR CONCEALMENT AND SHELTER". The parent application claims priority based on, U.S. patent application Ser. No. 11/045,736, filed Jan. 28, 2005, entitled "LIGHTWEIGHT PORTABLE CONCEALMENT MEANS AND METHODS". The grandparent application claims priority based U.S. patent application Ser. No. 10/161,986, filed Jun. 4, 2002. This application, as well as its parent, grandparent, and great-grandparent, claim priority under 35 U.S.C. §199(e) of U.S. provisional application Ser. No. 60/295,956, filed Jun. 4, 2001, entitled "LIGHTWEIGHT PORTABLE CONCEALMENT MEANS AND METHODS". Applications 60/295,956, Ser. Nos. 10/161,986, 11/045,736, and 11/155,398 are hereby included by reference.

BACKGROUND

1. Field of the Invention

This invention relates to lightweight portable concealment and shelter systems and methods.

2. Description of Prior Art

There is often a need to conceal oneself when researching wildlife, hunting, camping, working on construction projects, or working in the outdoors. Wildlife researchers conceal themselves so that they can film and study wildlife without disturbing the behavior of the animals. Hunters often conceal themselves in various hunting blinds to avoid being detected by their prey. Campers often conceal themselves to bathe, change clothes, and perform other personal or hygiene activities. Construction workers, military, law enforcement, and others who work in the outdoors also have similar needs for concealment. Various methods have been employed to accomplish these tasks.

In the past, quite complex, heavy structures have been built or constructed for concealment. Hunters have built permanent hunting blinds. Portable huts, shower stalls, dressing shelters, tents, canopies, and complex tree blind structures have been carried into the great outdoors.

The parent application provided a list of patents relating to this field of invention. The discussion of these prior art references is included by reference.

The use of such devices has several disadvantages such as being heavy, bulky, noisy, expensive, and complicated to assemble or use. Most of these devices have only a single use with poor performance. There is a need for a simple, lightweight, compact, portable, multi-use means of concealment.

To avoid being detected by their scent, hunters and other wildlife observers climb trees using tree steps and then remain for hours in a tree stand watching and waiting for animals to pass by. However, a person in a tree stand makes a silhouette against the sky or background and is exposed to a 360 degree view. Animals can easily detect the human silhouette or movement. Further, if the person or equipment makes a noise the animal will know where to look. There is a need for a device that eliminates the silhouette.

Complicated equipment or procedures create a situation where a person may drop equipment or, even worse, fall from the tree stand. Most of the existing devices block the view or mobility of the person.

Metal objects screwed into trees are sometimes forgotten and become over grown by the tree. Later when the lumber is harvested and cut, the saw strikes the metal object and can cause severe damage. Some states have banned the use of metal tree screws or spikes. Any device used for attaching to trees in the forest needs an embodiment that attaches to the outside of the tree and can be easily removed.

The following ground blinds are known in the art:

Hunter's Specialties' "Lightweight Portable Ground Blind"

Avery' "Avery Quick Carry Ground Blind"

U.S. Pat. No. 5,062,234, entitled "Portable Blind"

Double Bull "Matrix"

However, these ground blinds are limited in that they are designed for a single use or application.

There are a number of very old patents relating to curtain support brackets. These are associated with hanging curtains inside a building on a wall and fail to anticipate many novel features of the present invention.

It is also desirable to have a blind that can provide shelter from the elements. Light weight portable tents with nylon shells, rain flies, and external fiberglass poles are well known, but there have not been major innovations in basic structure and configuration of such tents in the last two decades. Each tent comes with a predetermined number of parts and is limited to a single configuration.

What is needed is a modular system of components that could be used to construct a wide variety of outdoor blinds and shelters. With such a modular system, the same components could be used to create tree blinds, ground blinds, waterfowl blinds, blinds attached to vessels and vehicles, and various shelters.

SUMMARY OF THE INVENTION

Accordingly, it is an objective of the present invention to provide an easy to use, universal, simple, lightweight, compact, portable, quiet, multi-use modular system for concealment and shelter.

Objects and Advantages

Accordingly, beside the objects and advantages described above, some additional objects and advantages of the present invention are:

1. To provide a modular system of components that can be used construct a variety of outdoor blinds and shelters.
2. To provide a basic module that can be used to create a tree blind, ground blind, and waterfowl blind by reconfiguring the same components.
3. To provide advanced modules that can be used with one or more basic modules to form more complex structures for use as both blinds and shelters.
4. To provide bind and shelter modules that can be interconnected with other modules to accommodate the needs of larger groups.
5. To provide overhead cover to enhance the effectiveness of an otherwise open blind.
6. To provide modular components that can be assembled in a specific configuration and then can be broken down without disassembly, so that the specific configuration can be quickly put up at a later time.
7. To provide a bracket that can be attached to either a vertical or horizontal structure, or that can be inserted into the ground.

8. To provide a multi-legged bracket wherein the legs can be configured and then held at any angle.
9. To provide a method of removeably attaching shaft segments whereby shafts can pass through and hold flexible materials such as shelter covers, floors, and panels.
10. To provide a method of removeably attaching shaft segments whereby shafts can pass through a material whereby portions of the shaft can be inside a structure and other portions of the same shaft can be outside the structure.
11. To provide a method of removeably attaching shaft segments whereby the shaft segments are held together regardless of whether an external pressure is forcing them towards or away from each other.
12. To provide a method of assembling an outdoor structure wherein the supports for the structure are secured to the ground independent of having the supports interconnected or covered.
13. To provide a structure with a removable floor that can be omitted to reduce weight and complexity.
14. To provide a modular system that be used on steep terrain.
15. To provide a method of tightening a skin of a blind to reduce undesired motion.
16. To provide a method of tightening a shoot through panel to reduce the drag or other effect on a projectile as it passes through the panel.
17. To provide a covered structure with unobstructed openings.
18. To provide a blind or shelter structure with an overhead window whereby a rain fly can be installed and removed without leaving the structure.
19. To provide a blind with a lower window and an overhead window, in addition to other horizontal openings, whereby the operators line of sight is not obstructed down nor up steep terrain.
20. To provide a cover module that can be used alone or as part of a more complex combination of components.
21. To provide a method of holding cover shafts taut within a cover component whereby the cover can be used alone or placed and secured on other basic modules.
22. To provide a method of holding cover shafts taut within a cover component wherein the cover shafts can have more than one predetermined length.
23. To provide a method of holding the end of a cover shaft inside a cover without damaging the cover during repetitive use.
24. To provide a method of using a basic tree blind module to form a rain fly or cover for another basic tree blind module.
25. To provide a smooth handle for a threaded bracket that can be more easily attached.
26. To provide a method of converting a basic blind into a covered shelter.
27. To provide of a camouflaged shield module that can be attached to a tree, a vessel, a vehicle, or to the ground.
28. To provide a camouflaged shield module that can be attached to a weapon or camera whereby the operator can move freely through open space.
29. To provide a camouflaged shield module with a shoot through section.
30. To provide shoot-through (or blackout sections) that can be moved to cover opening in a blind or shelter structure.
31. To provide a fully enclosed blind that allows unobstructed line of sight in 360 degrees of a substantially horizontal plane.
32. To provide a fully enclosed blind that allows unobstructed line of sight in 180 degrees in a substantially vertical plane on steep terrain.
33. To provide an improved wildlife research blind.
34. To provide an improved hunting blind.
35. To provide an improved tree stand concealment means.
36. To provide a quick, silent means of lowering or raising a screen.
37. To provide a pivotal means of attachment that maintains its frictional force.
38. To provide an option for attaching to the outside of a tree.
39. To provide unobstructed vision or shooting lanes.
40. To provide a means of concealment by hiding in front of a similar pattern.
41. To provide a system that can be used as a ground blind as well as a tree blind.
42. To provide a universal support with multiple legs which can be used with a curtain to form various configurations to meet the needs of various environments and uses.
43. To provide improved means of construction with lower cost and longer reliability.
44. To provide a method and means of tightening the skin on the sides of a blind cover to reduce movement and flutter.
45. To provide means for attaching a bow cord to a cover shaft.
46. To provide a corner loop in a cover for securing the cover to a support or a ground stake
47. To provide a method of constructing a modular blind or shelter by first securing supports in the ground, then completing a frame and then putting a cover over the frame.
48. To provide a blind window with four or more sections such that any section or groups of sections can be independently opened while maintaining taut cover panels.
49. To provide a cover that can have the top fully opened.
50. To provide a window section attachment such that non-adjacent sections can be attached.
51. To provide a cover for a blind or shelter that can be configured in a taller position and in a lower position, while still maintaining taut cover panels.
52. To provide an attached cover bag that can contain a cover, the cover bag having a smaller compartment for holding unused components of the module system.
53. To provide methods and means for reducing scent detection.
54. To provide a hay roll cover configuration for the modular system of the present invention These and other features and advantages of the present invention will become apparent upon consideration of the following specification, claims, and drawings.

DRAWING FIGURES

In the drawings, closely related figures have the same number but different alphabetic suffixes.

FIG. 1P through 1Z show various details of shaft segments and their construction and use.

Figure 5A:
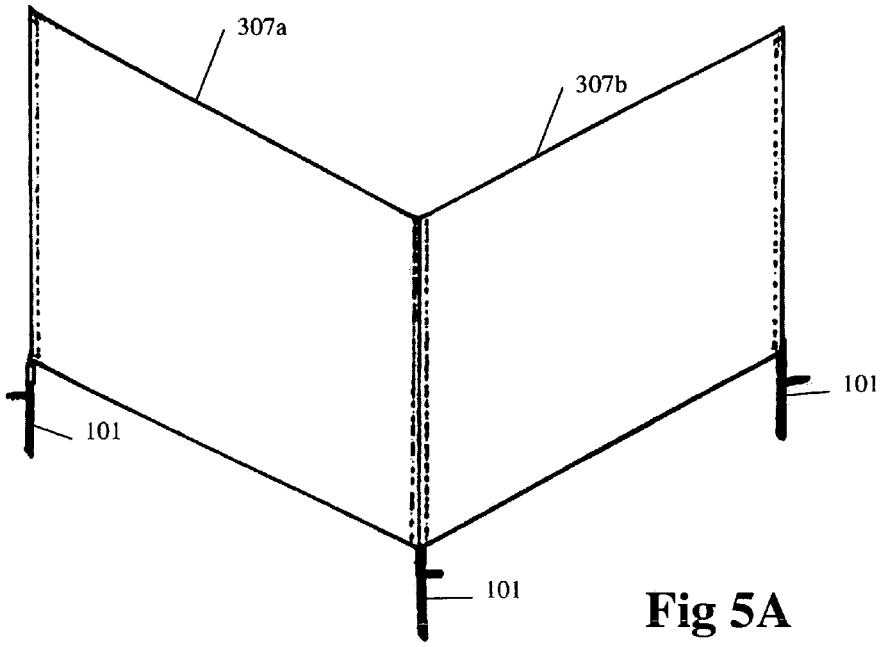
FIG. 5A and FIG. 5B show uncovered ground blind embodiments.
Figure 5B:
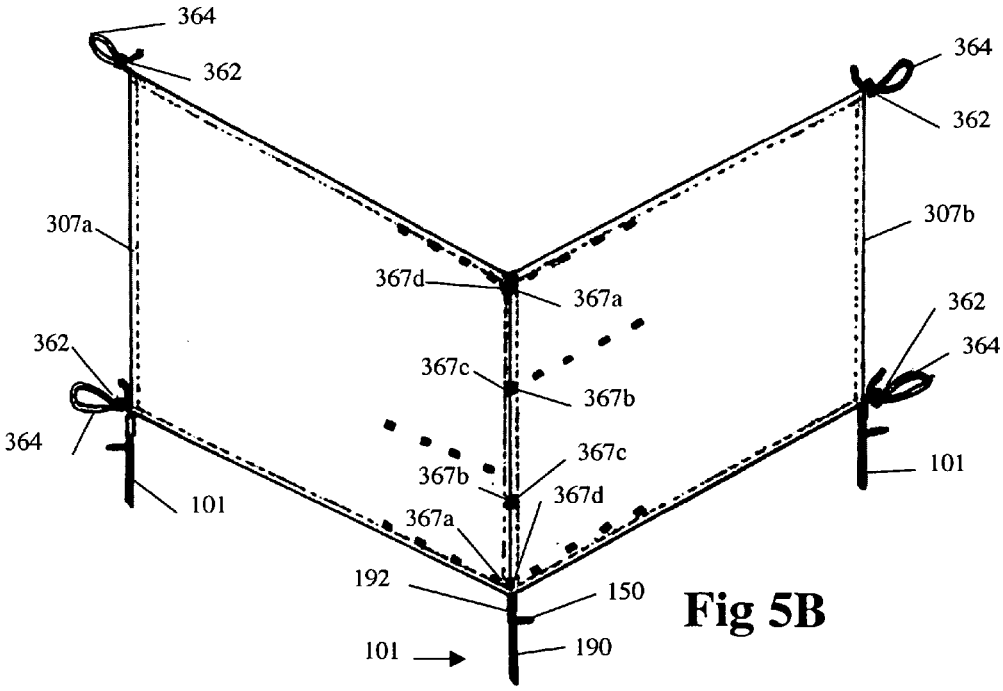
Figure 5C:
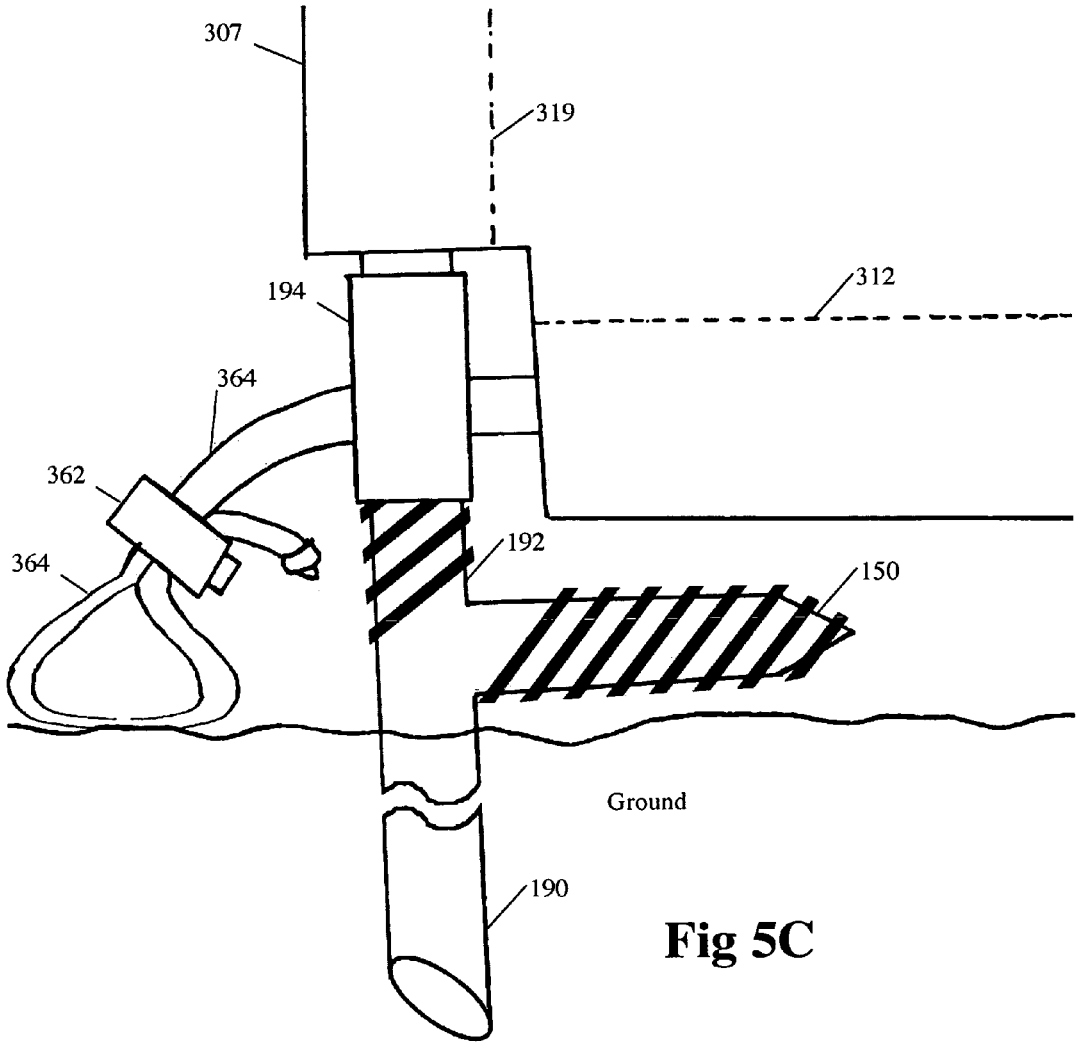
Figure 5D:
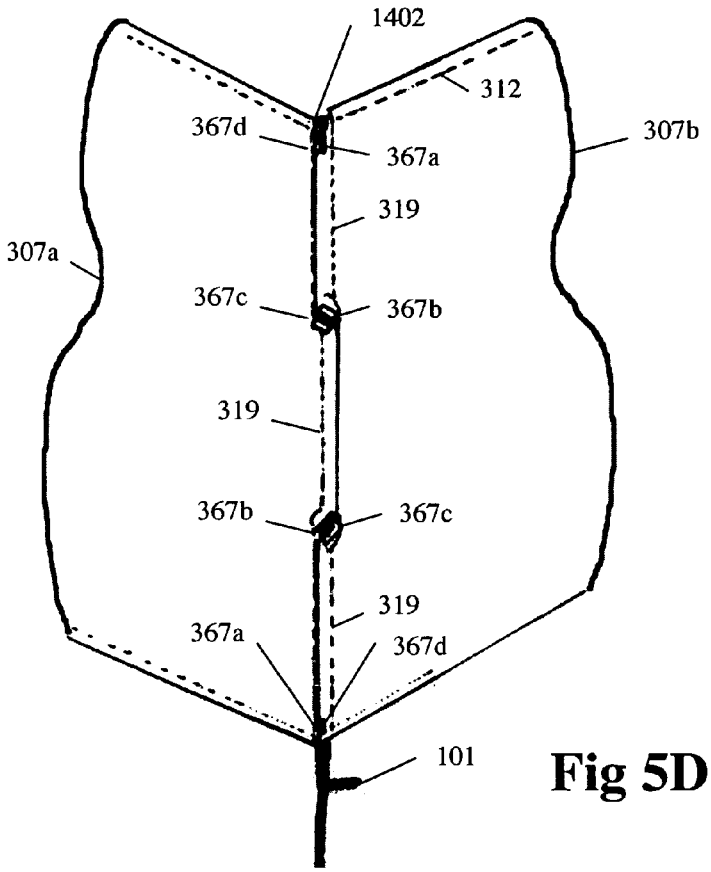

FIG. 5C though FIG. 5D shows details of the ground blind embodiments.

Figure 6:
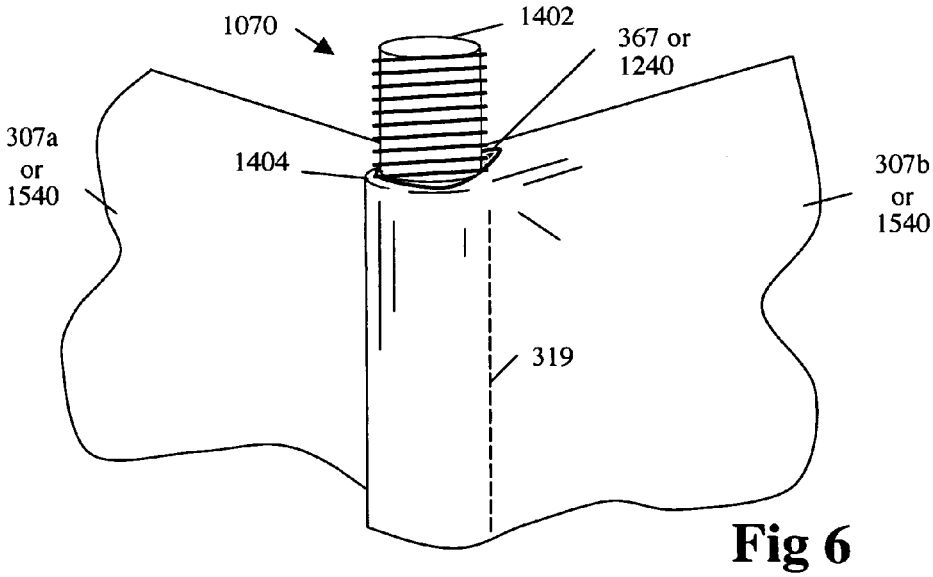

FIG. 6 shows details of a tip passing through a hole and holding material.

Figure 7A:
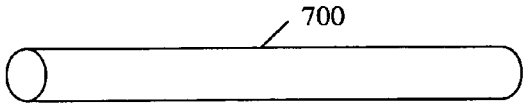
Figure 7B:
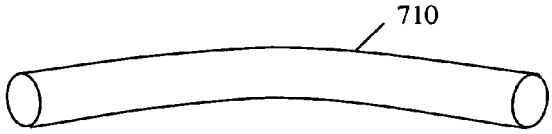

FIG. 7A through FIG. 7B show connectors.

Figure 8A:
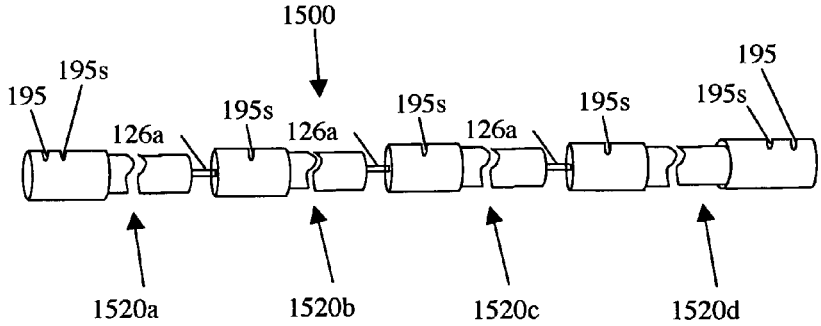
Figure 8B:
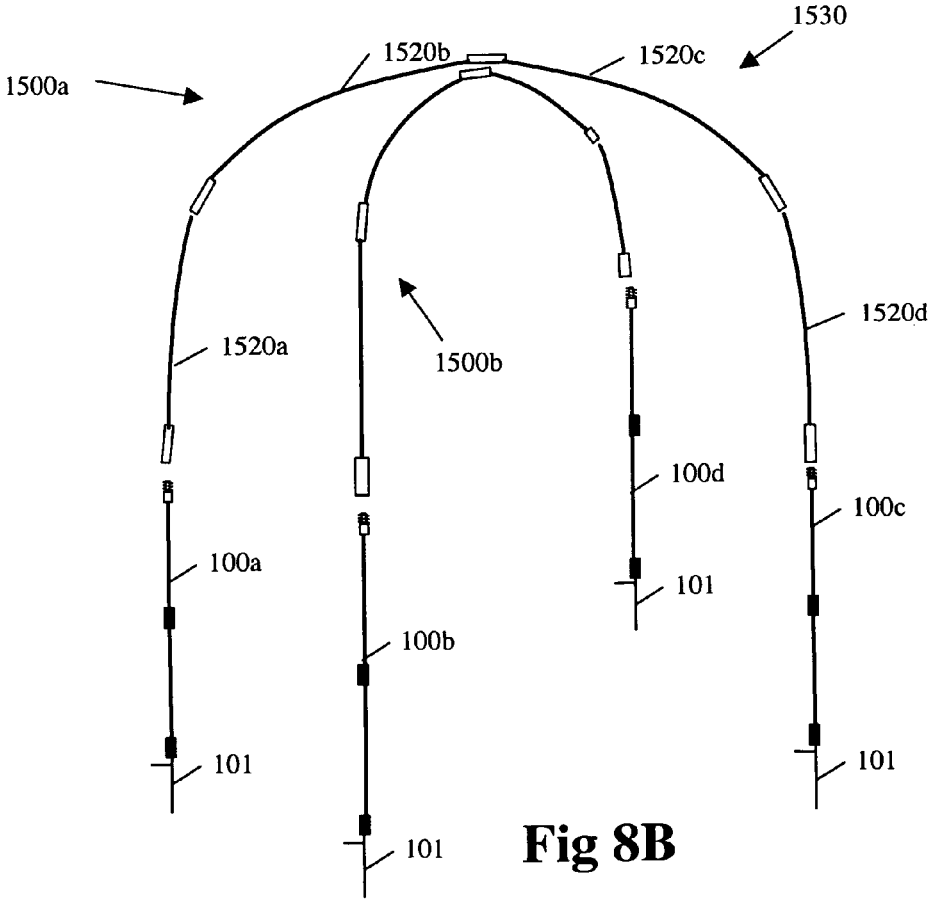
Figure 8C:
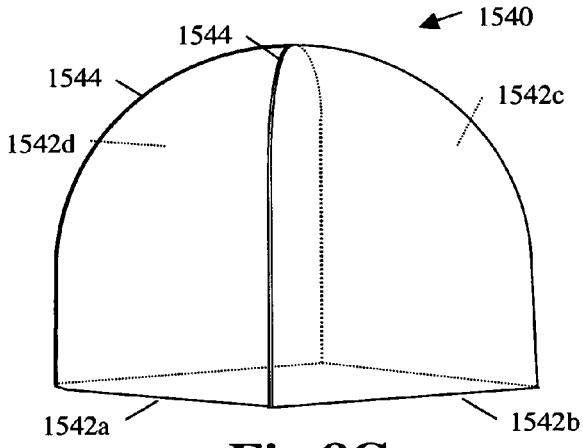

FIG. 8A through FIG. 8C show modular components of a covered blind or shelter structure.

Figure 9A:
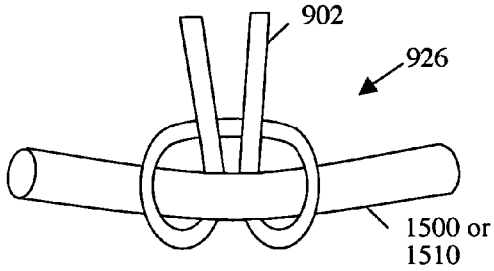
Figure 9B:
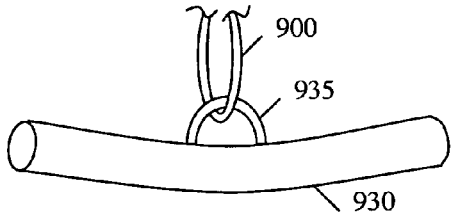

FIG. 9A FIG. 9B show details of connecting a cord to a shaft or connector.

Figure 10A:
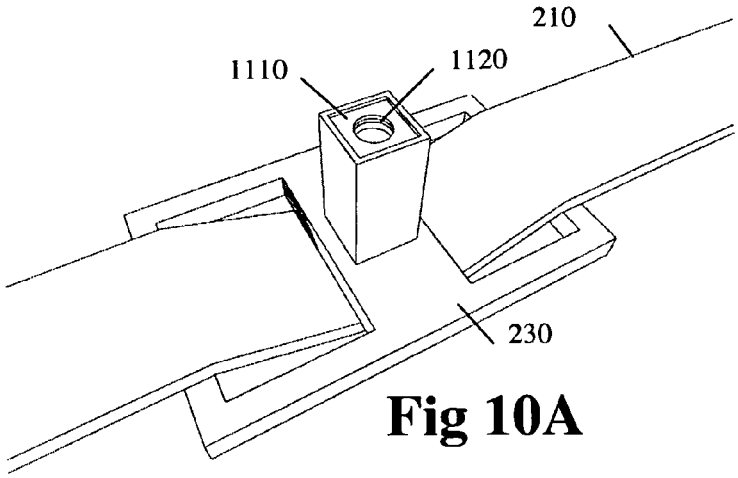
Figure 10B:
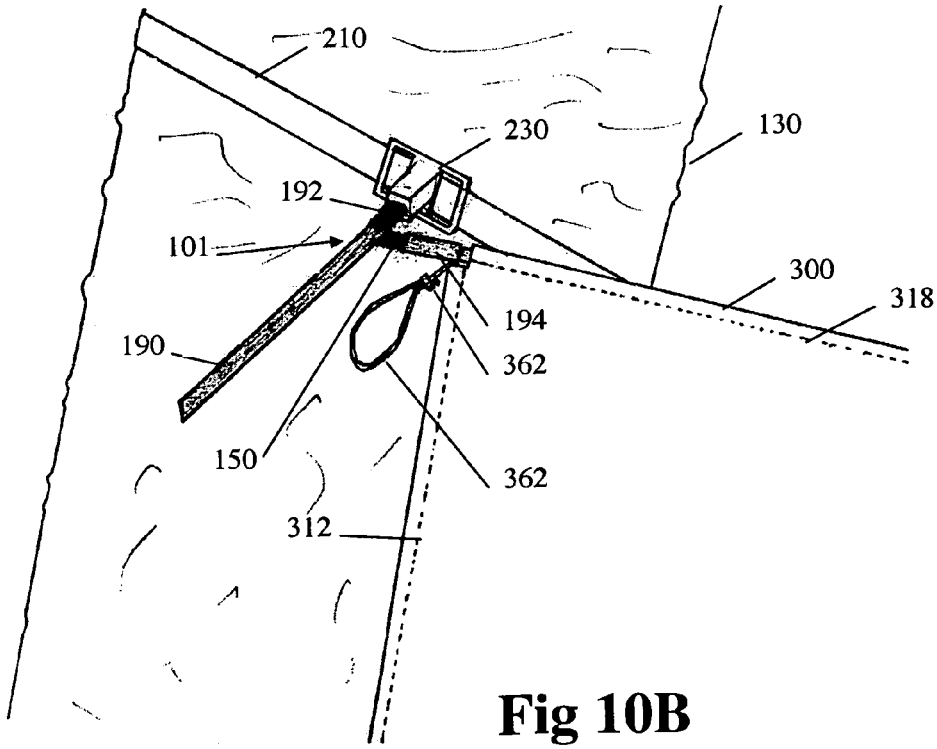

FIG. 10A through FIG. 10B show the structure and use of an attaching fastener.

FIG. 11A through FIG. 11F show details of shelter frame and the novel uses of bow cords on cover shafts.

Figure 12A:
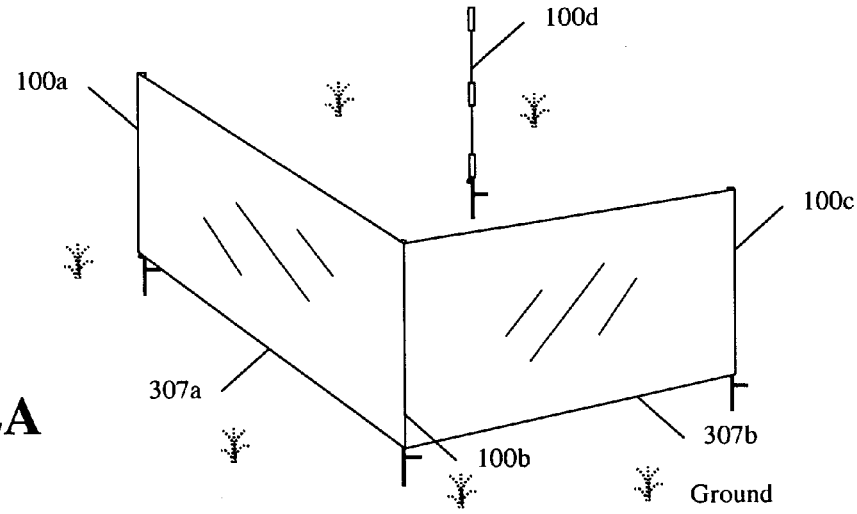
Figure 12B:
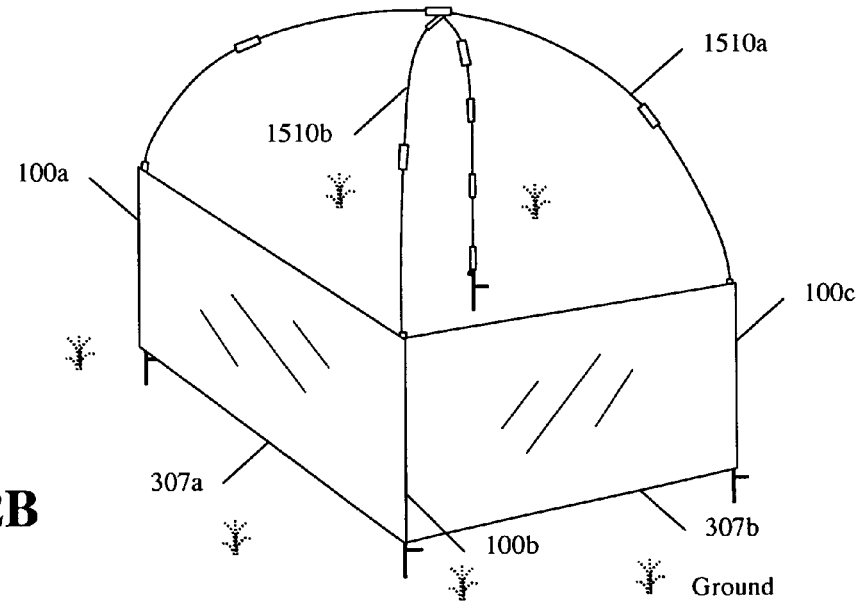
Figure 12C:
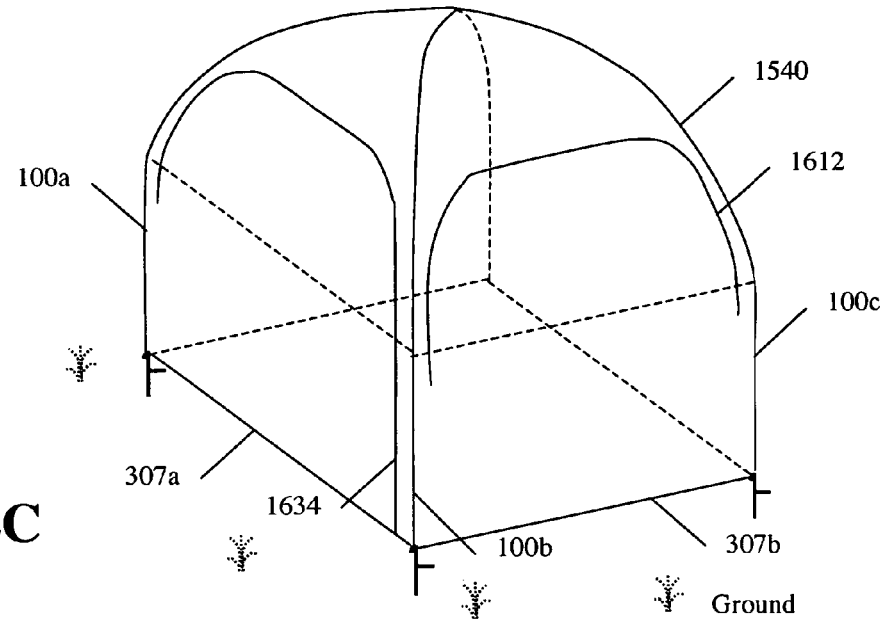

FIG. 12A through 12C show the operation of one embodiment of the shelter or blind.

FIG. 12D through 12H show the operation of another embodiment of the shelter or blind.

FIG. 12I through 12L show another embodiments of the shelter or blind. shows an exemplary lightweight portable embodiment.

Figure 14A:
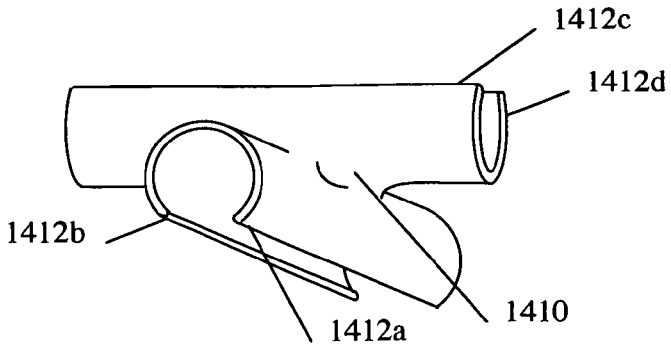
Figure 14B:
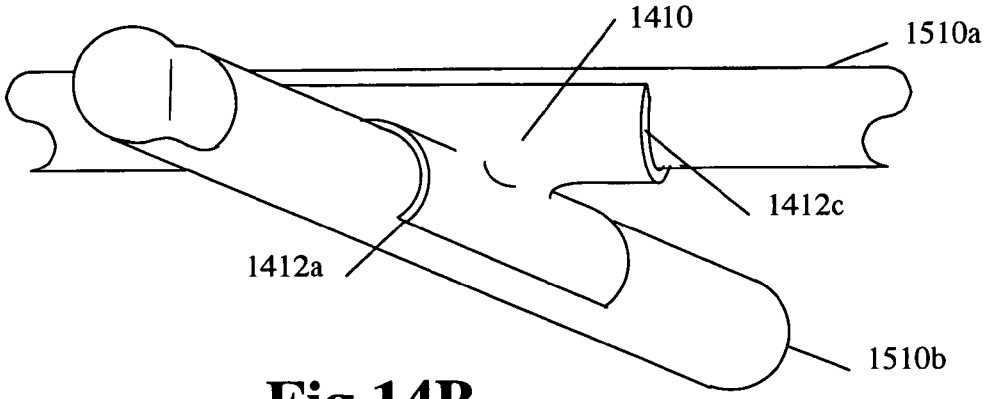

FIG. 14A and FIG. 14B show the design and use a shaft intersection clip.

Figure 14C:
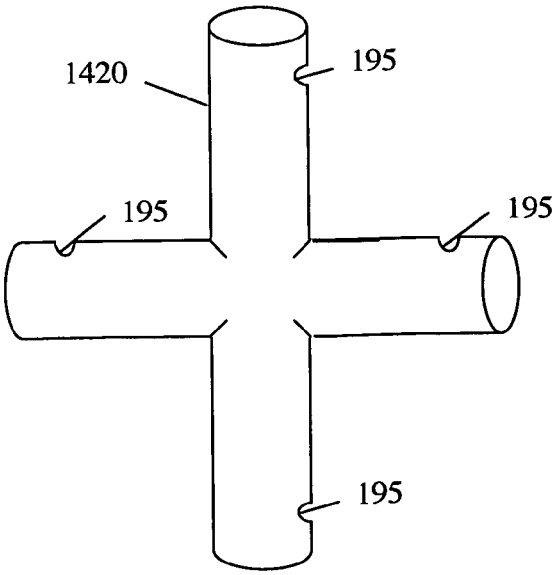

FIG. 14C shows a 4-way receiving end connector.

Figure 15A:
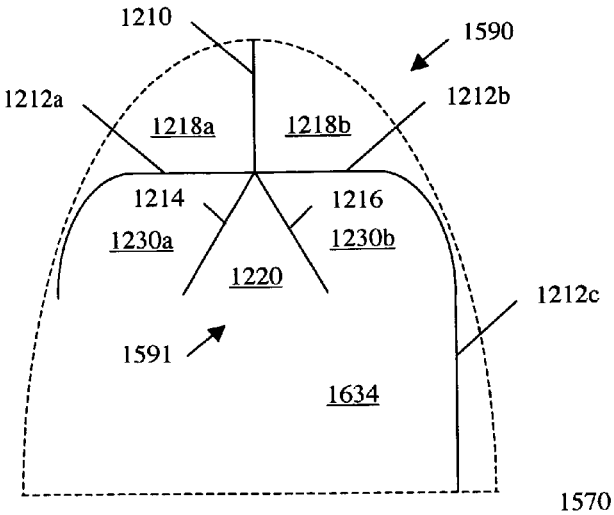
Figure 15B:
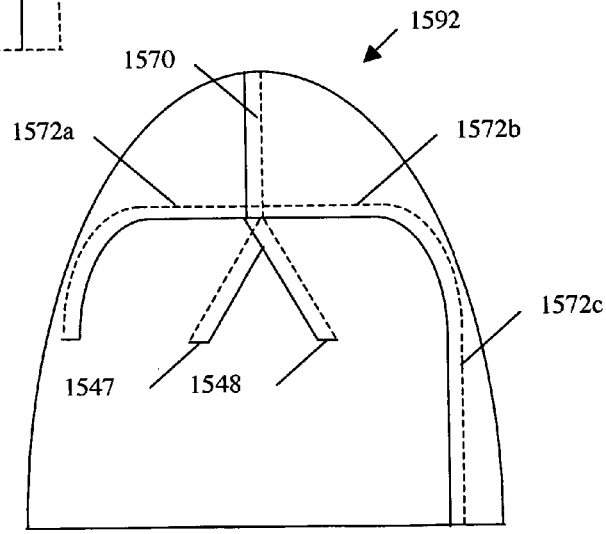
Figure 15C:
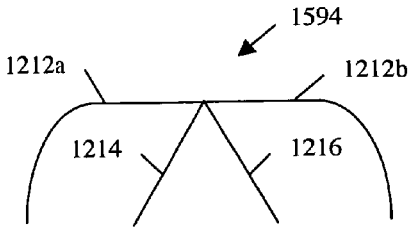
Figure 15D:
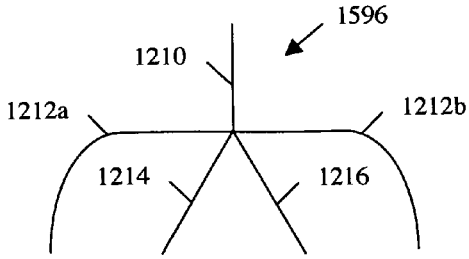
Figure 15E:
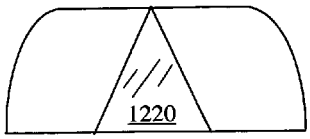
Figure 15F:
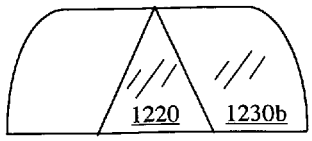
Figure 15G:
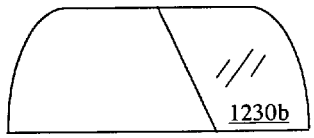
Figure 15H:
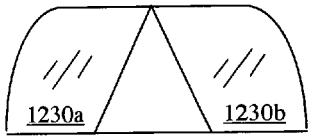
Figure 15I:
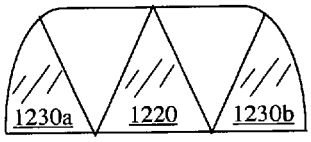
Figure 15J:
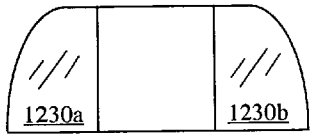
Figure 15K:
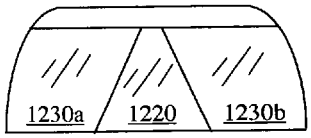
Figure 15L:
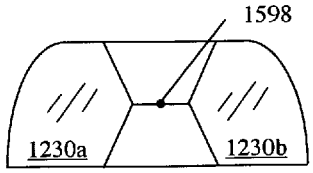
Figure 15M:
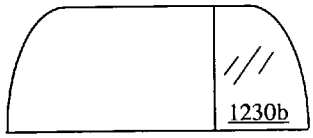
Figure 15N:
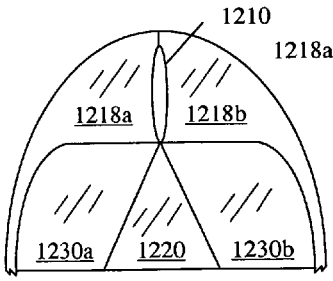
Figure 15O:
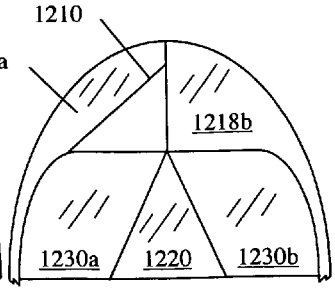
Figure 15P:
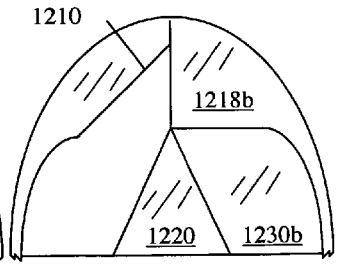
Figure 15Q:
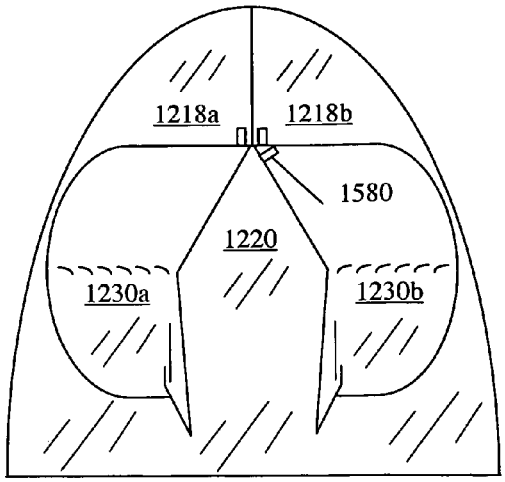
Figure 15R:
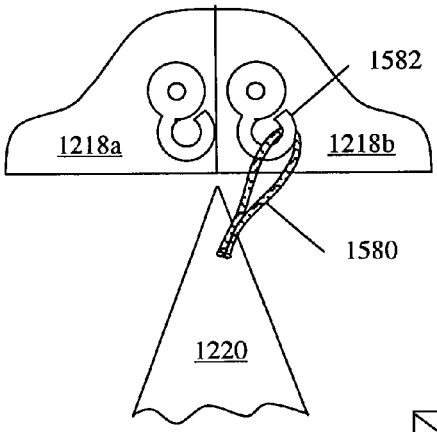
Figure 15S:
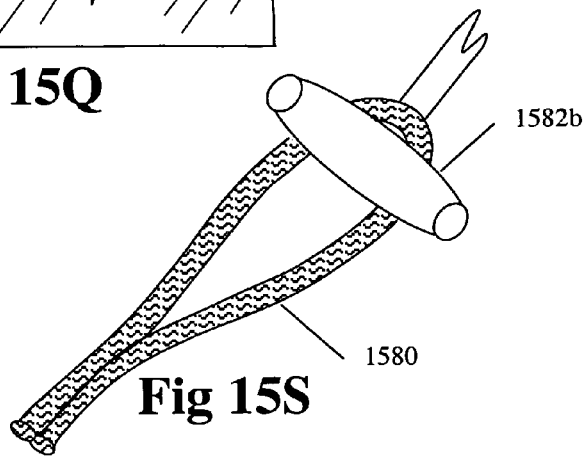
Figure 15T:
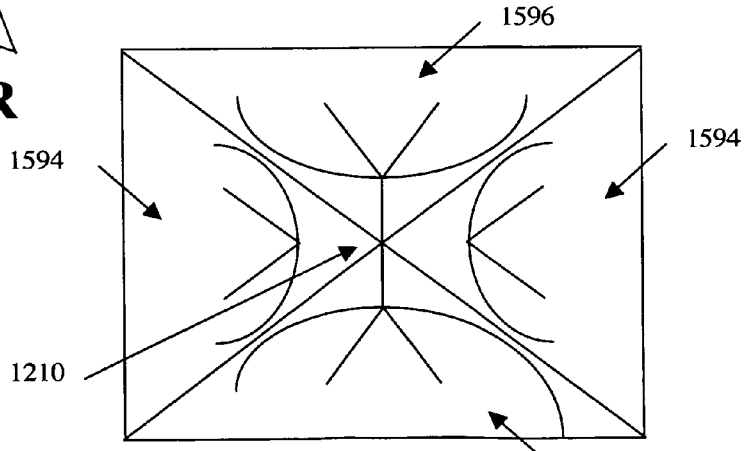

FIG. 15A through FIG. 15T show details and features of novel star windows configurations.

FIG. 16A through FIG. 16G show various configurations of the modular system.

Figure 16A:
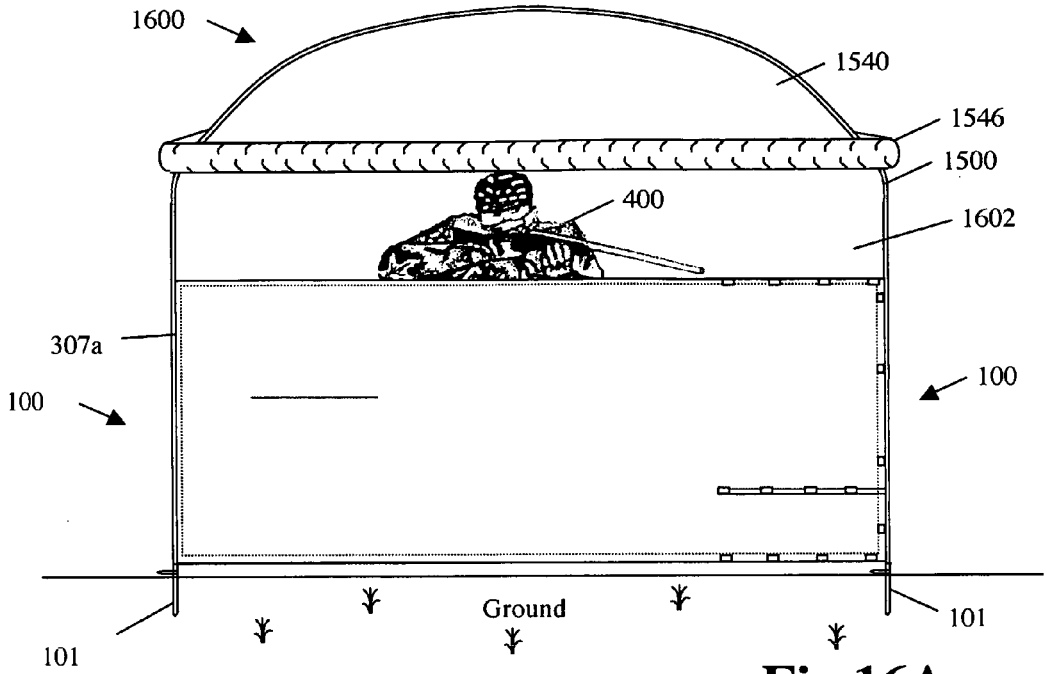
Figure 16B:
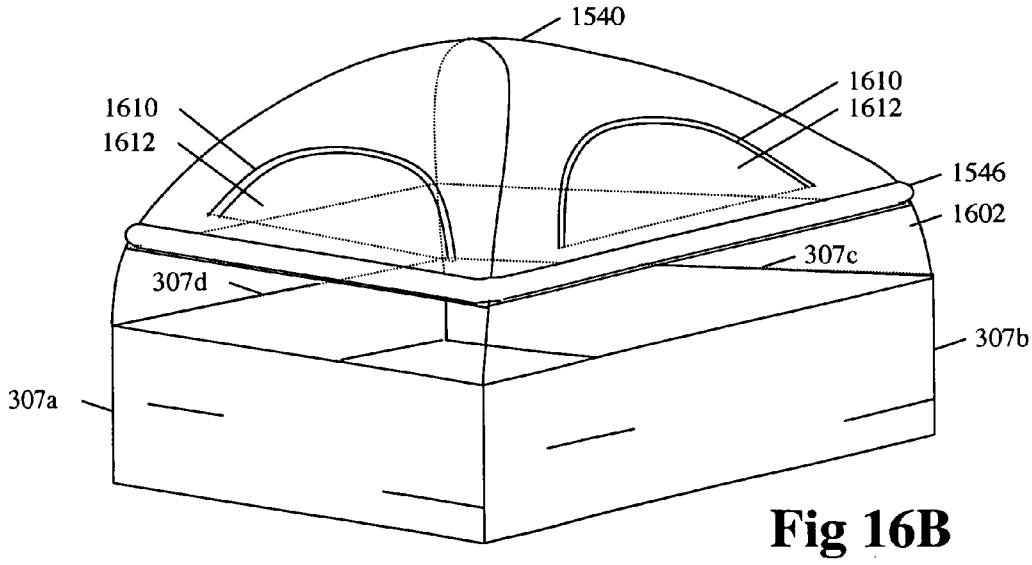
Figure 16C:
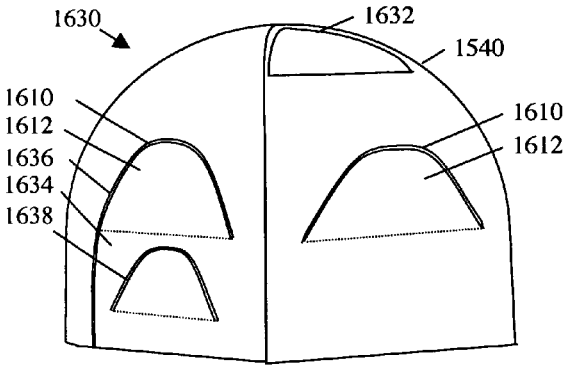
Figure 16D:
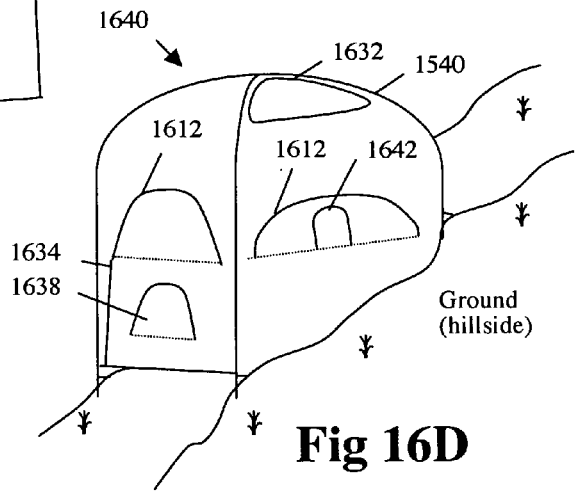
Figure 16E:
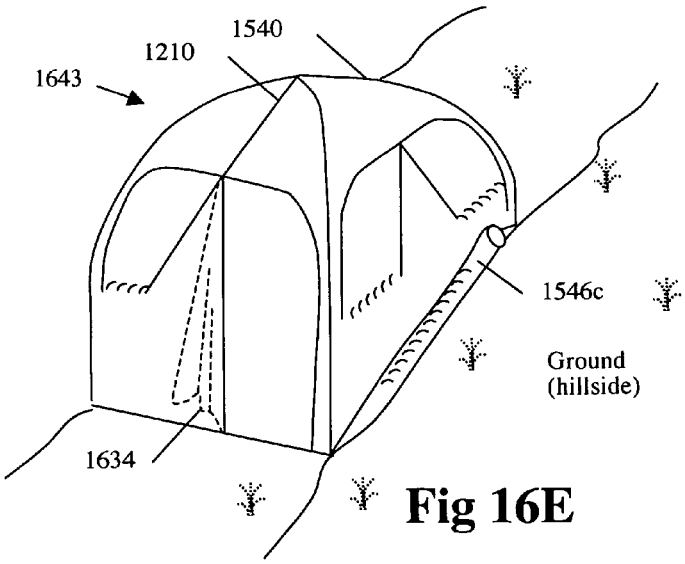
Figure 16F:
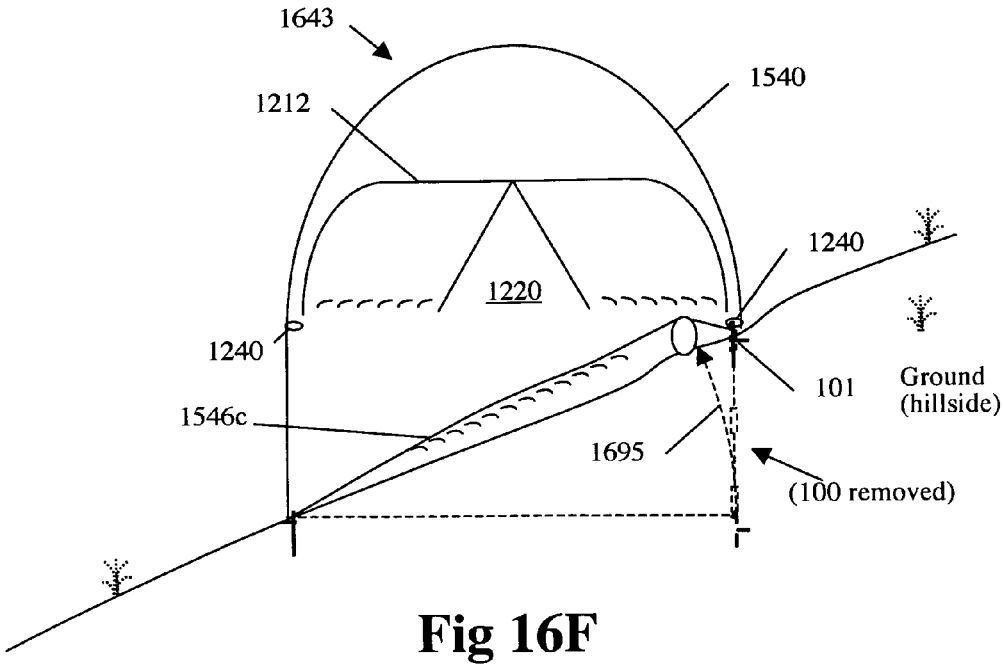
Figure 16G:
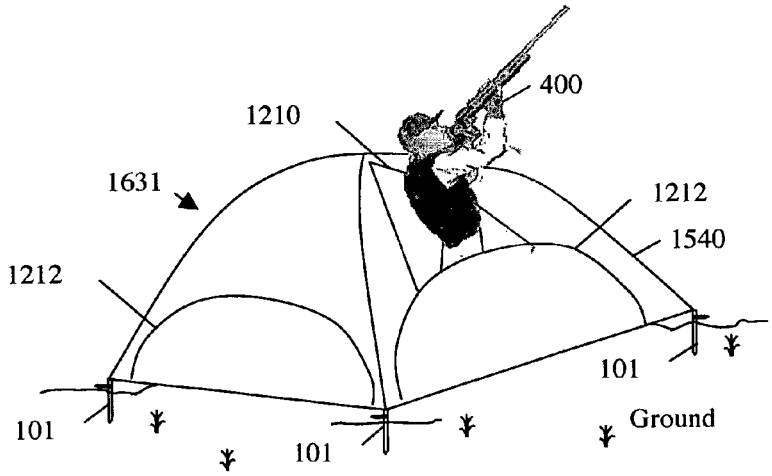
Figure 16H:
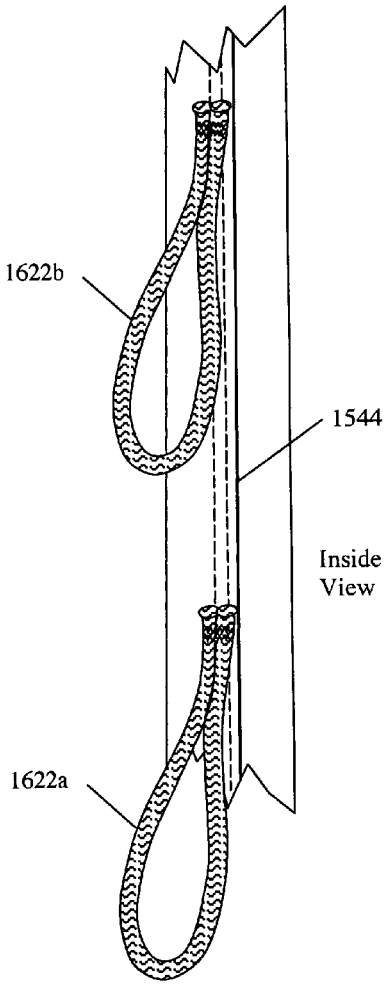
Figure 16I:
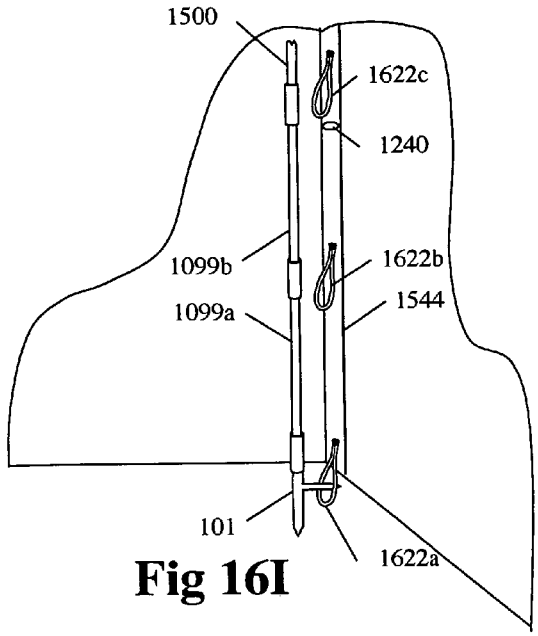
Figure 16J:
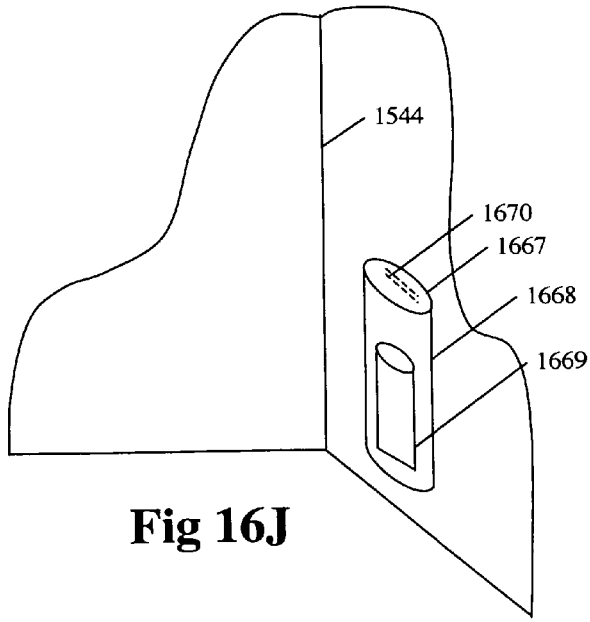

FIG. 16H through FIG. 16J show optional details of the cover.

Figure 16K:
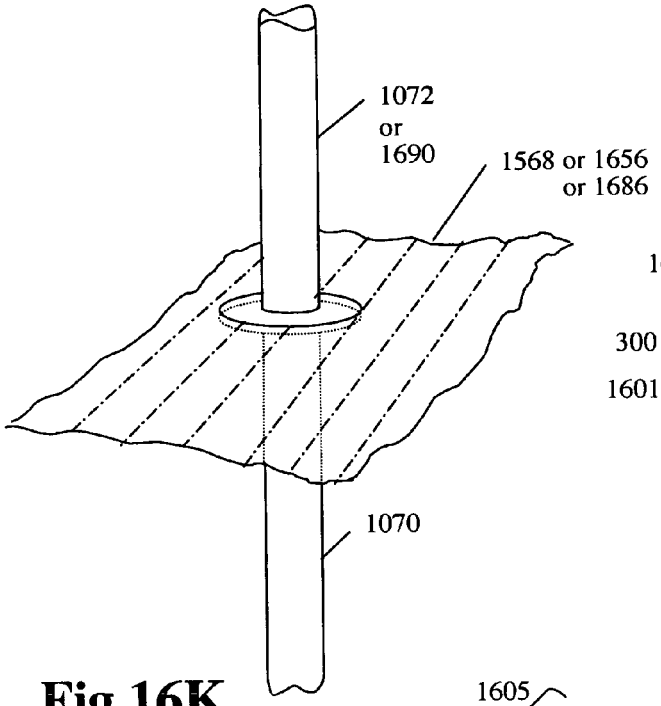

FIG. 16K shows how the shaft segments can pass through and hold blind or shelter material or straps.

FIG. 16L through FIG. 16S show various configurations that can be constructed using the module components of the present invention.

FIG. 17A through FIG. 17F show various embodiments of tree blinds and shields components.

FIG. 17G through FIG. 17J shows various connectors.

Figure 18A:
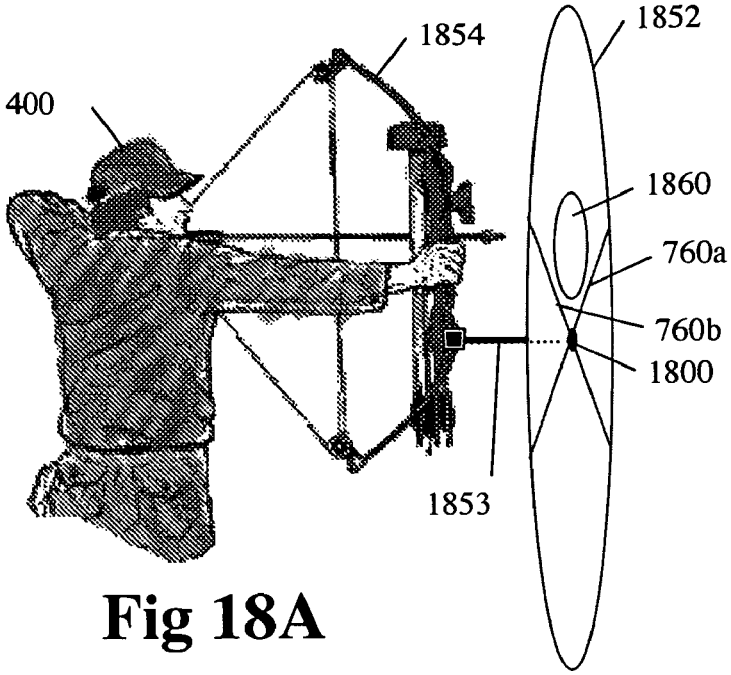
Figure 18B:
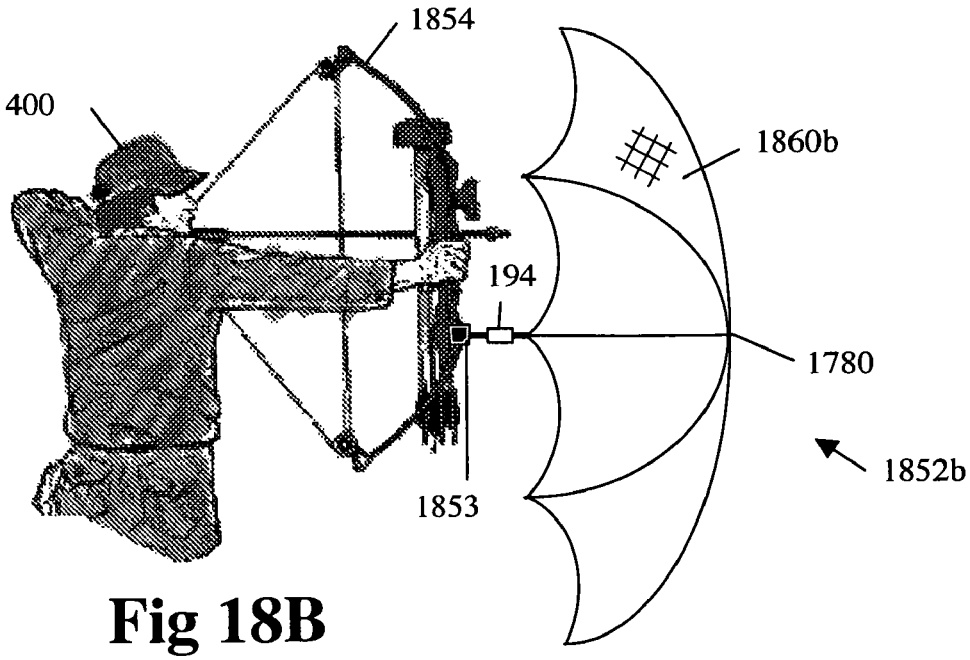

FIG. 18A and FIG. 18B show moveable shields.

FIG. 19A through FIG. 19F show various embodiments of covers with scent limiting features.

FIG. 20A through 20D show embodiment with a skirt and various details skirt attachments.

Figure 21A:
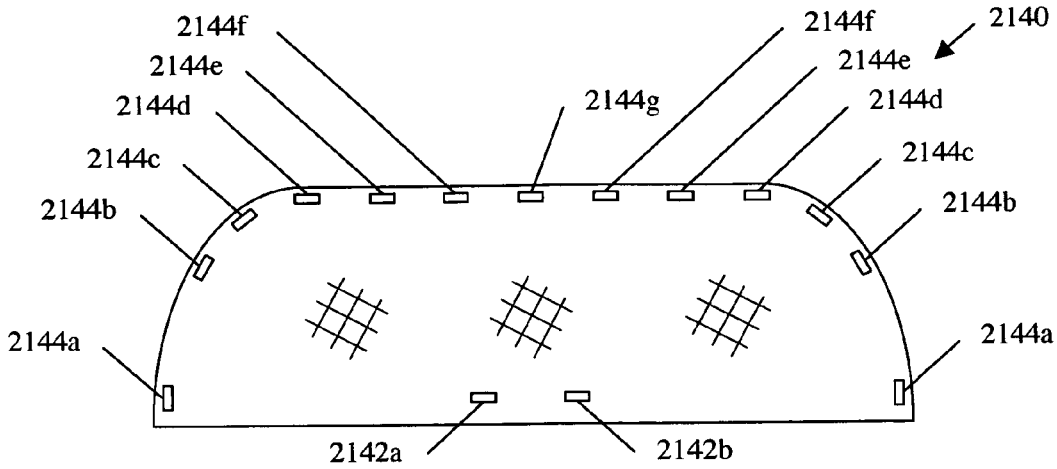
Figure 21B:
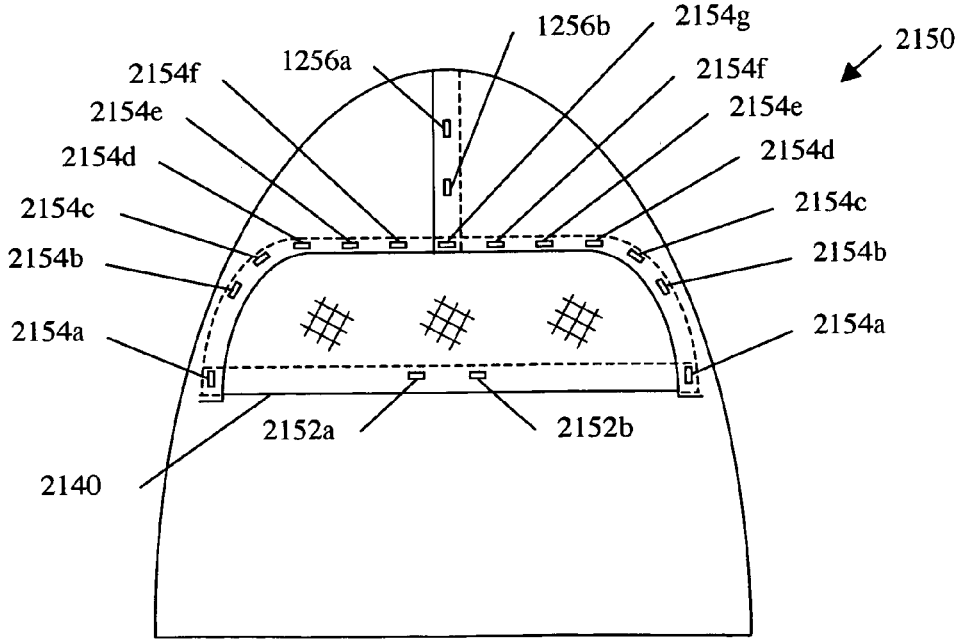
Figure 21C:
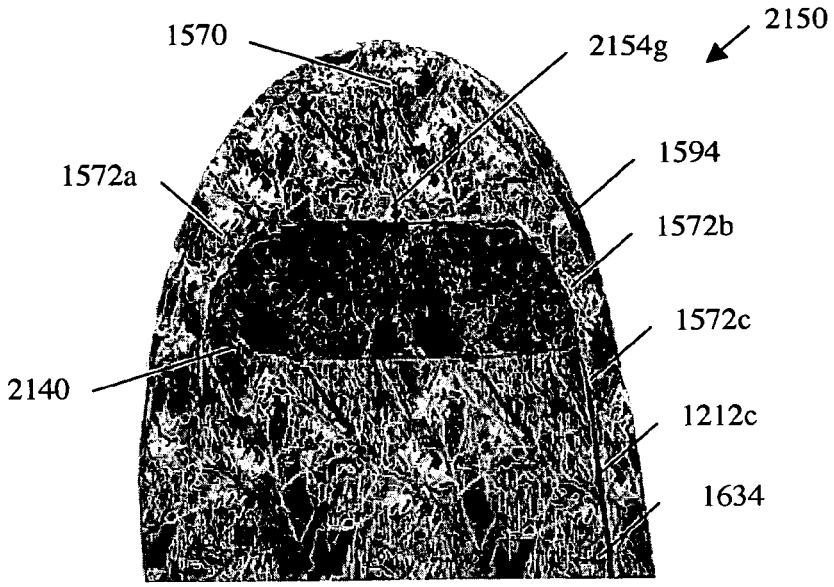

FIG. 21A through FIG. 21C show various embodiments and operation of a shoot-through window.

FIG. 22A through FIG. 22G show alternate ways to secure the ends of a shaft to the ground and to connect a bow cord.

FIG. 23A through FIG. 23D show covers with expansion panels.

REFERENCE NUMERALS IN DRAWINGS

100 attaching pivoting support
100 (*a*) first support
100 (*b*) second support
100 (*c*) third support
100 (*d*) fourth support
101 (*b*) 3-legged alternate support
101 (*c*) 4-legged alternate support
101 alternate support
102 threaded support
104 threaded connector
106 shaft
107 segmented shaft
108 telescoping shaft
109 threaded segmented shaft
110 plate
112 plate connection
114 plate sleeve
120 drilled support
122 drilled receiving shaft
124 fastener
126 (*a*) cord
126 (*b*) cord attachment or knot
126 elastic cord
130 attaching structure
140 bend
150 first leg
160 second leg
170 end-cap
180 horizontal structure
190 third leg
191 threaded third leg
192 alternate second leg
193 fourth leg
194 dimpled connector
194 (*a*) spirally dimpled connector
194 (*b*) parallel dimpled connector
194 (*c*) partial dimpled connector
194 (*d*) enhanced dimpled connector
194 (*e*) alternate dimpled connector
194 (*f*) slot attaching dimpled connector
194 dimpled connector
195 (*a-r*) dimple
195 (*s*) midpoint dimple
196 pin
197 (*a-c*) retaining dipple
198 (*a-b*) deeper dimple
199 shaft segment
200 attaching belt
210 strap
220 tension means
230 attaching fastener
240 threaded receptor
300 curtain
301 curtain with shoot-through panel
302 anchored curtain
304 draw-curtain
306 enhanced draw-curtain
307 (*a-d*) alternate curtain
308 window cover
309 windowed curtain
310 anchor point
312 edge hem
314 interior hem
316 grommet group
318 support hem
319 alternate support hem
320 see-through
322 window
324 window grommet
340 tie
350 slit
352 slit cord
354 side grommet
356 pull loop
360 cord cutout
362 drawstring clip
364 drawstring
365 drawstring knot
366 drawstring fastener

367 (*a-d*) reinforced holes
368 grommet
369 grommet reinforcement
370 first anchor point
380 second anchor point
390 third anchor point
395 (*a-c*) hem segment
400 operator
410 path
510 hem reinforcement
520 fastening strap
530 hook and loop fastener
600 T-shaped support
605 cross bar
610 first ring end
620 second ring end
630 ring
640 curtain opening
700 straight connector
710 angled connector
720 reinforced angled connector
730 connector reinforcement
740 support with angled connector
750 shaft with angled connector
760 (*a-e*) connected shaft
770 connector insert
780 top rail
782 bottom rail
784 rail ring
790 flexible connector
800 double support ring
810 segmented ring
820 curtained ring
900 supporting cord
902 knot
910 hoop
915 overhead structure
920 eye fastener
925 knotted connector
926 knotted connection
930 connector with eye loop
935 eye loop
940 second cord
1010 first example
1020 second example
1025 friction pivot joint
1030 third example
1040 fourth example
1050 fifth example
1060 sixth example
1070 inserting end (male)
1072 receiving end (female)
1074 machined end
1075 cord retainer
1076 threaded connector
1077 connector threads
1082 2-legged threaded support
1084 obtuse threaded support
1086 angled threaded connector
1088 bolt
1090 thinner shaft inserting end
1091 thinner shaft receiving end
1092 thinner shaft (more flexible segment)
1094 (*a-f*) locking slot
1094 (*d*) three-notched locking slot
1096 slot mark
1099 alternate shaft segment
1100 strap hole
1110 attaching material
1120 attaching hole
1130 tooth
1150 stopper
1210 top window fastener
1212 (*a*) left window fastener
1212 (*b*) right window fastener
1212 (*c*) door fastener
1214 bottom left window fastener
1216 bottom right window fastener
1218 (*a*) top left section
1218 (*b*) top right section
1220 triangle section
1230 (*a*) left section
1230 (*b*) right section
1240 cover hole
1250 (*a-d*) quarter section
1251 first opening fastener
1252 second opening fastener
1253 third opening fastener
1254 fourth opening fastener
1256 (*a-c*) fastening point
1300 case
1310 belt loop
1320 stake
1400 alternate cap
1402 tip
1404 rim
1410 intersection clip
1412 (*a-d*) clip member
1420 4-way receiving end connector
1500 (*a-b*) cover shafts
1500 segmented cover shaft
1510 alternate cover shaft
1510 (*a*) top cover shaft
1510 (*b*) bottom cover shaft
1511 cover shaft intersection
1520 (*a-f*) cover shaft segment
1530 shelter frame
1532 shelter cord
1540 cover
1542 (*a-d*) cover panels
1544 cover seam
1546 cover roll
1547 second flap
1548 third flap
1550 rain fly
1551 alternate fly boundary
1552 fly material
1553 pocket seam attachment
1554 fly cord
1556 fly fastener
1558 fly pocket
1559 rain fly shaft
1560 tarp (removable floor)
1562 first side
1563 tarp corner
1564 corner fold
1565 second side
1566 (*a-b*) corner grommets
1566 (*c-e*) side grommets
1566 firm grommet (or eyelet)
1566 (*f-i*) skirt grommets
1568 tarp material
1570 top flap
1571 top attachment

1572 (*a*) first flap
1572 (*b*) fourth flap
1572 (*c*) door flap
1573 bottom attachment
1574 (*a-b*) bow string attachment
1576 slip knot
1577 attaching clip
1578 (*a-d*) quarter section flaps
1579 clip eye
1580 window section loop
1582 window section attachment (hook or tie)
1582 (*b*) loop clasp
1590 star window layout
1591 star window with door
1592 rain flap configuration
1594 four-fastener star window
1596 five-fastener star window
1598 connected ties
1600 covered blind/shelter
1601 2-walled covered blind/shelter
1602 opening
1603 cylindrical arched roof
1604 cylindrical arched roof unit
1604 (*a*) cylindrical arch exterior
1604 (*b*) arch with ceiling shaft
1604 (*c*) staked arches
1605 basic module
1606 vessel
1607 (*a-b*) pyramid unit
1608 bow arch
1610 window fastener
1612 cover window
1620 pyramid cover
1621 pyramid cap
1622 corner loop
1626 bow cord
1630 alternate cover
1631 cover cap
1632 (*a-d*) overhead window
1633 (*a-b*) zipper
1634 door
1636 door fastener
1638 lower window
1640 extended configuration
1641 line of sight (trajectory)
1642 shoot-through panel
1643 extended configuration with star windows
1644 (*a*) one-man alternate structure
1644 (*b*) two-man alternate structure
1645 hay roll cover
1650 rain fly configuration
1651 ridge
1652 fly loop
1654 cover shaft pocket
1655 3-sided attachment
1656 grommetted pocket
1657 pocket seam
1658 pocket grommet
1659 pocket attachment
1660 cover with windows
1661 alternate cover with windows
1662 overhead window fastener
1664 zipper start
1665 pocket seam
1666 zipper end
1670 cover bag attachment
1667 cover bag closure
1668 cover bag
1669 smaller compartment
1672 window roll
1680 channelled plug
1681 alternate plug
1682 plug hole
1683 skirt fastener
1684 strap attachment
1685 reinforced strap hole
1686 strap
1687 eyelet top
1688 eyelet bottom
1689 reinforcement
1690 2-receptor shaft
1691 pyramid cover shaft
1692 extended pyramid shaft
1695 cover bottom arc
1700 tree fly
1703 curtain fly
1710 alternate tree fly
1712 alternate fly material
1720 ground shield
1730 3-shafted shield
1732 3-shafted fly material
1734 side shafts
1736 fly tiedown
1740 receiving-to-receiving connector
1750 6-way receiving end connector
1752 3-way receiving end connector
1760 inserting-to-inserting connector
1762 slotted connector
1770 hinged connector
1772 (*a-b*) threaded leg
1774 hinge
1780 umbrella
1782 end piece
1800 adjustable bracket
1810 (*a-d*) bracket leg
1812 bracket leg threads
1814 bracket leg base
1816 bracket leg opening
1820 quick release
1840 (*a-d*) thicker based leg
1842 thicker base
1844 adjustable bracket bolt
1846 lower nut
1848 upper nut
1850 rectangular fly material
1851 fan fly material
1852 moving shield
1852 (*b*) umbrella shield
1853 equipment attachment
1854 hand held equipment
1858 batten
1860 shoot-through section
1860 (*b*) shoot-through umbrella section
1862 wider umbrella section
1910 guyline module
1911 guyline shaft
1912 (*a-d*) guyline
1914 guyline base
1915 washer hole
1916 guyline capital

1917 guyline washer
1918 fixed capital
1919 (*a-d*) guyline slot
1920 blackout panel
1922 see-through panel
1930 retractable guyline
1932 coil attachment
9134 guyline coil
1936 guyline hook
1938 guylinelock
1940 (*a-e*) scent cover
1942 (*a-e*) scent flaps
1944 tall grass
1950 scent chimney
1952 chimney attachment
1954 chimney opening
1956 chimney cover
1958 chimney skirt
2010 skirt
2020 horizontal guyline
2030 horizontally sliding panel
2032 vertical slit
2040 skirt door hook
2042 skirt door flap
2050 skirt door
2060 door shaft
2100 hinged inserting end
2102 hinge pin
2104 tenon
2106 threaded hinge leg
2108 second hinge leg
2120 doubly hinged inserting connector
2122 middle hinge leg
2124 raised ring
2130 beveled hinged inserting end
2132 side face
2134 beveled face
2140 shoot-through window
2142 (*a-b*) lower fastening points
2144 (*a-g*) shoot-through fastening points
2150 shoot-through configuration
2152 (*a-b*) lower receiving points
2154 (*a-g*) shoot-through receiving points
2200 base block
2202 block
2204 embedded dimpled connector
2210 receiving base
2212 base plate
2214 base receiving end
2220 inserting base
2224 base inserting end
2230 threaded stake
2231 sharpened shaft with slot
2232 stake with tab
2233 stake with disc
2235 unthreaded arm
2236 threaded arm
2237 tab
2238 cord hole
2239 disc
2240 sharpened shaft
2242 clip with hook
2244 clip hook
2246 clip with tab
2250 inserting pin
2252 stake with hook
2310 fold
2312 (*a-e*) expansion panels
2314 (*a-f*) lace holes
2316 lace

SPECIAL DEFINITIONS cord—a flexible, and possibly elastic, filament including but not limited to a fiber, thread, string, rope, twine, wire, cable, yarn, thong, tendon, or line.

curtain—a concealing or protecting sheet of material.

grommet—a flexible loop that serves as a fastening, support, or reinforcement or an eyelet of firm material to strengthen or protect an opening or to insulate or protect something passed through it.

eyelet—a typically metal or plastic reinforcement for a hole.

shaft—a supporting member in construction including but not limited to any solid or hollow, round or rectangular bar, beam, pole, rod, spar, or tube composed of wood, plastic, metal, or composite material.

DESCRIPTION OF THE INVENTION

The present invention comprises an easy to use, simple, lightweight, compact, portable modular system for concealment and shelter and methods for its construction and use. The main components of a basic module are various novel supports and a curtain. The support attaches to a structure and pivots at the attachment. Other modules include novel covers with cover shafts, a removable floor, a rain fly, and various novel flies and shields. The modules can be combined to form various tree blinds, ground blinds, waterfowl blinds, blinds attached to vessels or vehicles, and various shelters. The system uses novel shaft segments that can be attached in various configurations and then broken down without detaching the attachments. The present invention encompasses various embodiments of the attaching pivoting support as well as various embodiments of curtains with various features. A method of the present invention allows for 360 degree concealment. In addition to a method of being fully enclosed, a method of the present invention is based on the concept of "hiding in front" of a similar pattern.

FIG. 1A through FIG. 1D

Figure 1A:
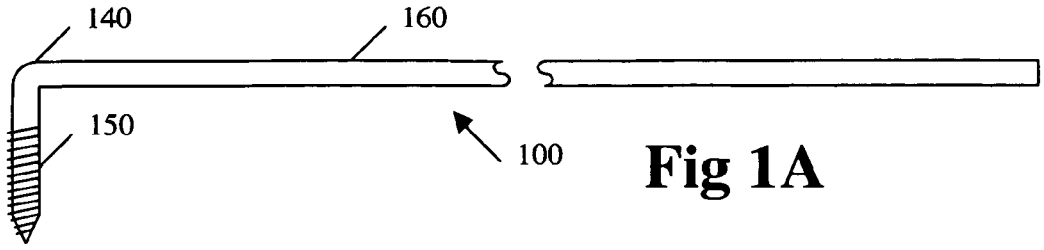
FIG. 1A through FIG. 1D show various embodiments of the support of the present invention.

FIG. 1A illustrates an attaching pivoting support 100. The support 100 is bent at an angle. The bend 140 results in two legs: a first leg 150 and a second leg 160. The first leg 150 has a threaded portion for threaded attachment to an attaching structure 130, such as a tree, pole, rock, wall, or attaching fastener 230. The bend 140 allows a user to exert a force on the second leg 160 that acts as a lever to screw the first leg 150 into the attaching structure 130.

The angle of the bend 140 is shown as a 90 degree angle; however, good results have also been obtained by using an obtuse angle. An obtuse angle still provides a leveraged force but is less likely to cause the second leg 160 to be blocked by tree branches or other obstructions.

In this exemplary embodiment, a portion of the threaded portion of the first leg 150 is cylindrical, not tapered, so that once attached to the attaching structure 130, the second leg 160 can be rotated up and down around the first leg 150 without losing frictional force necessary to hold the attaching pivoting support 100 in the position the operator leaves it (as will be explained below).

The attaching pivoting support 100 can be constructed of a single shaft. However, depending on construction materials, a lighter embodiment can be constructed by combining various components. This invention anticipates that any combination of parts can be used to make the attaching pivoting support 100 with equivalent structural features and functions. Examples of some embodiments are shown in FIG. 1B through FIG. 1F.

Figure 1B:
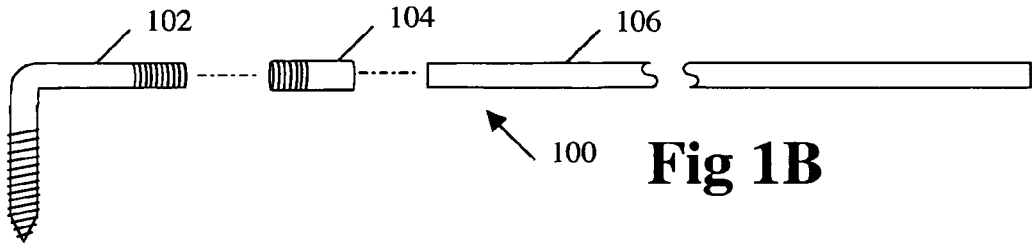

FIG. 1B shows an exploded view of the attaching pivoting support 100 comprised of a threaded support 102, a threaded connector 104, and a shaft 106. The threaded connector 104 screws onto the threaded support 102 and is attached to the shaft 106. Good results have been obtained by making the threaded support 102 from hardened steel, by making the threaded connector 104 from an aluminum alloy tube, and by making the shaft 106 from fiberglass. Good attachment results have been obtained by gluing or crimping the aluminum tube to the fiberglass.

Figure 1C:
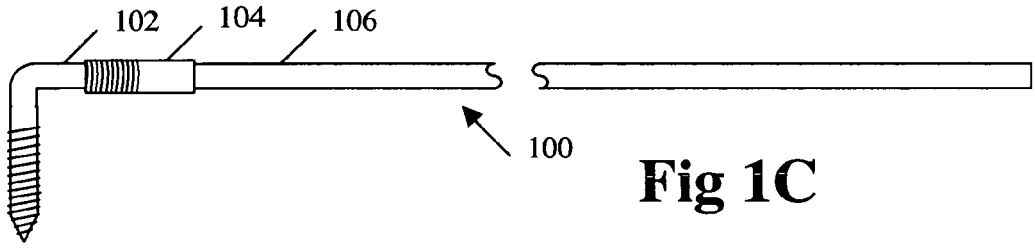

FIG. 1C shows an assembled view of the example shown in FIG. 1B.

Good results have also been obtained by attaching the threaded connector 104 to the shaft 106 as shown in FIG. 1B and FIG. 1C.

Figure 1D:
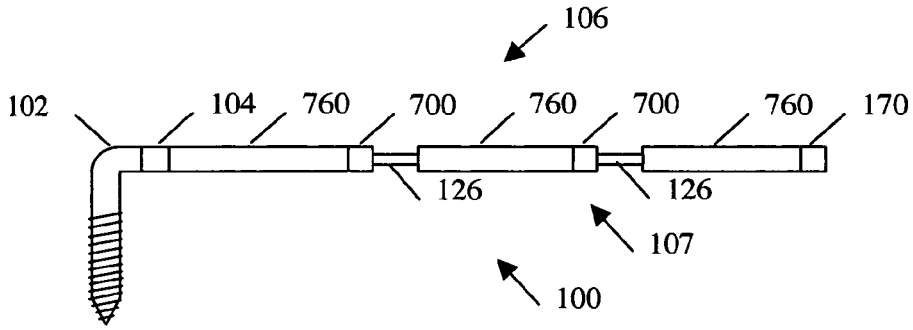
Figure 1E:
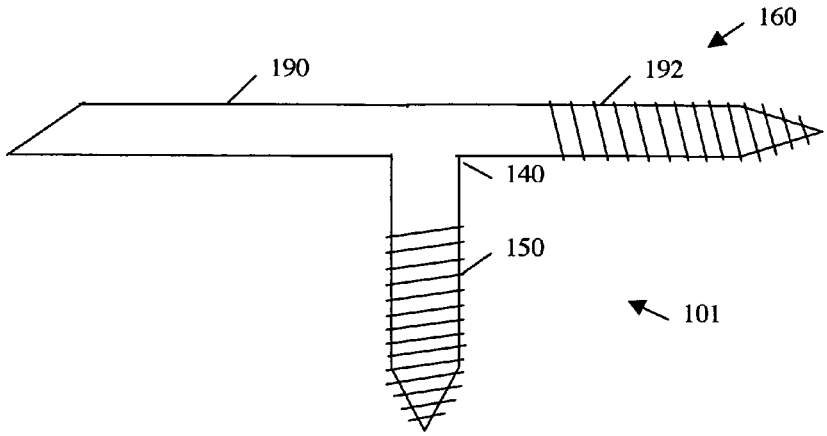
FIG. 1E through FIG. 1G and FIG. 1T show various embodiments of the alternate support of the present invention.

FIG. 1D shows an embodiment of the attaching pivoting support 100 comprised of the threaded support 102, the threaded connector 104, and the shaft 106. As in FIG. 1B, the threaded connector 104 screws onto the threaded support 102 and is attached to the shaft 106. However, in this embodiment the shaft 106 is comprised of a plurality of connected shafts 760 each connected to a connector. In this embodiment each connected shaft 760 is connected to a straight connector 700. These form a segmented shaft 107.

FIG. 1D further shows an example where the shafts are hollow and connected with an elastic cord 126. The elastic cord 126 running through the centers of the shaft 106 components (such as 100, 700, 710, 720, 740, 750, 760, 770, or 780) can connect the components. This can prevent components from falling and makes it easier to assemble the shaft 106.

FIG. 1E through FIG. 1K

Figure 1F:
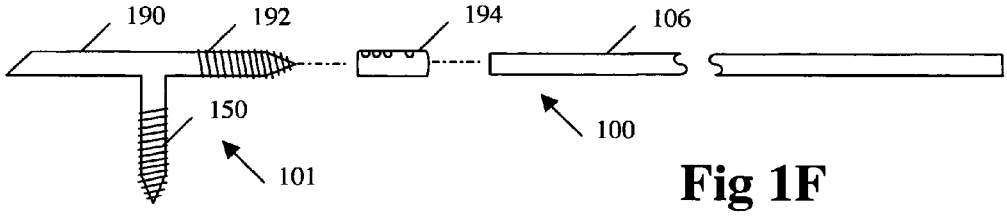
Figure 1G:
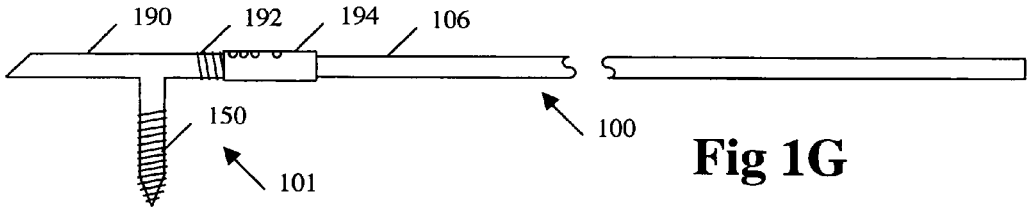
Figure 1H:
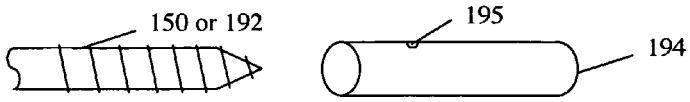
FIG. 1H through FIG. 1K show various embodiments of the dimpled connectors.
Figure 1I:
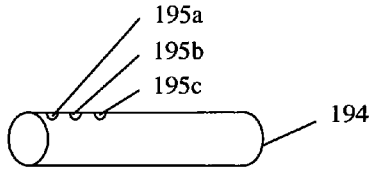

FIG. 1I. illustrates an alternate support 101 which is an embodiment of the attaching pivoting support 100. The support 101 is comprised of three legs: a first leg 150, an alternate second leg 192 and a third leg 190. The first leg 150 has a threaded portion for threaded attachment to an attaching structure 130, such as a tree, pole, rock, wall, or attaching fastener 230. The alternate second leg 192 is an embodiment of second leg 160, but has the same threaded portion as first leg 150. In this embodiment either the first leg 150 or alternate second leg 192 can be attached to the attaching structure. The unused leg can be attached to a shaft 106 or connected shaft 760. The bend 140 allows a user to exert a force on the alternate second leg 192 or the third leg 190 that act as a lever to screw the other leg into the attaching structure 130. The third leg 190 is sharpened at one end. It is shown with a diagonal cut in this figure, but could have two diagonal cuts like a screw driver, four tetrahedral cuts like a nail or a tapered point like an awl, without departing from the spirit of the present invention. The sharpened end of the third leg 190 can be easily inserted into the ground. This allows the same alternate support to be used to form a ground blind as well as various tree blind configurations.

FIG. 1F shows an exploded view of the attaching pivoting support 100 comprised of an alternate support 101, a dimpled connector 194, and a shaft 106. The dimpled connector 194 receives either the first leg 150 or the alternate second leg 192, and is attached to the shaft 106. An improved permanent attachment can be made by inserting shaft 106 then subsequently dimpling the dimpled connector such that the dimples mechanically engage the shaft 106 (see parent application).

FIG. 1G shows an assembled view of the example shown in FIG. 1F.

FIG. 1H shows a leg either 150 or 192 being inserted into the dimpled connector 194. In this figure the dimple connector 194 is shown with one dimple 195. One dimple 195 is sufficient for receiving a thread (for example, as shown below in FIG. 1R through FIG. 1U, and FIG. 1W through FIG. 1Z). The currently preferred embodiments use one dimple. This reduces manufacturing cost and is less likely to bind when being attached or detached by the user.

FIG. 11 shows a dimpled connector 194 with three dimples 195 (195*a*, 195*b*, and 195*c*, respectively).

The threads of the leg (e.g. 150 or 192) first engage the first dimple 195*a*, then the second dimple 195*b*, then the third dimple 195*c*.

A novel feature of the system of the present invention is that a dimpled connector 194 can receive either a left or right handed thread on an inserting end 1070, or even a shaft with a locking slot 1094 as will be explained below in reference to FIG. 1U and 1V. A concave dimple can easily be made, for example, by striking the outside of a metal ferrule (e.g. connector 700) with a punch. The hemispherical dimple will result inside the ferrule and is sufficient to receive a threaded member, or a shaft 106 with a locking slot 1094.

FIG. 11 show an embodiment of the dimpled connector 194 where the dimples (195*a* through 195*c*) form a single line. One of ordinary skill in the art would understand that various dimpled arrangements could be used without departing from the spirit of the present invention.

Figure 1J:
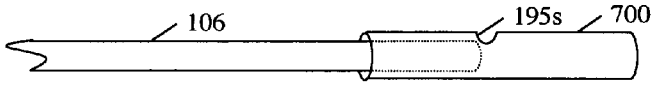

FIG. 1J shows an example of use in a straight connector 700 of a midpoint dimple 195*s* as a guide for manufacturing. When permanently attaching a connector, such as 700 or 710, the shaft 106 can be inserted up to the midpoint dimple. The permanent attachment can be made using glue or crimping, or by making a retaining dimple 197*a*, as shown in the parent application, which is incorporated by reference.

Good attachment results have been obtained by gluing or crimping the aluminum tube to the fiberglass. Gluing the aluminum tube to the fiberglass creates a weld that distributes the force more evenly across the fiberglass shaft; this reduces the breakdown of the fiberglass that can shatter or fray when the forces are applied to a smaller area.

Figure 1K:
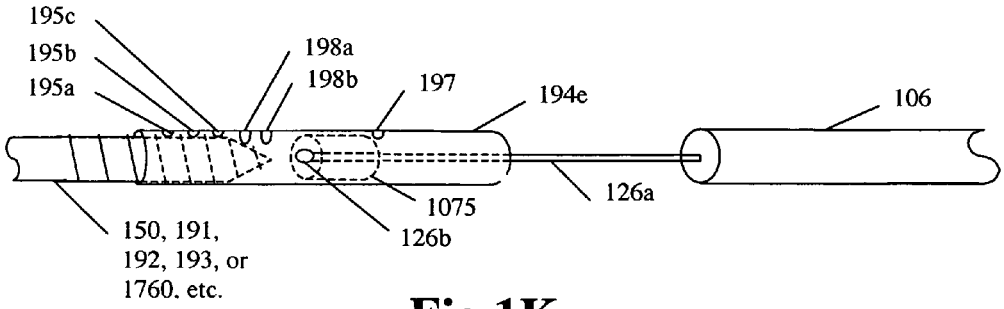
Figure 1L:
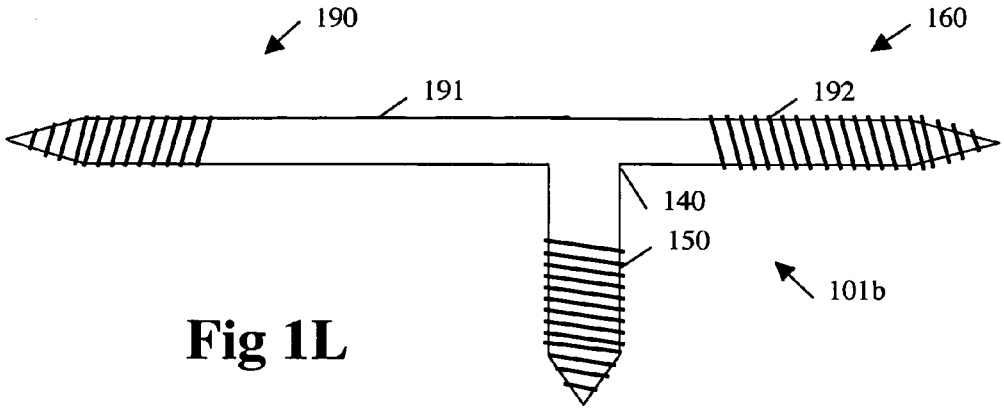
FIGS. 1L and 1M show embodiments of the alternate support.
Figure 1M:
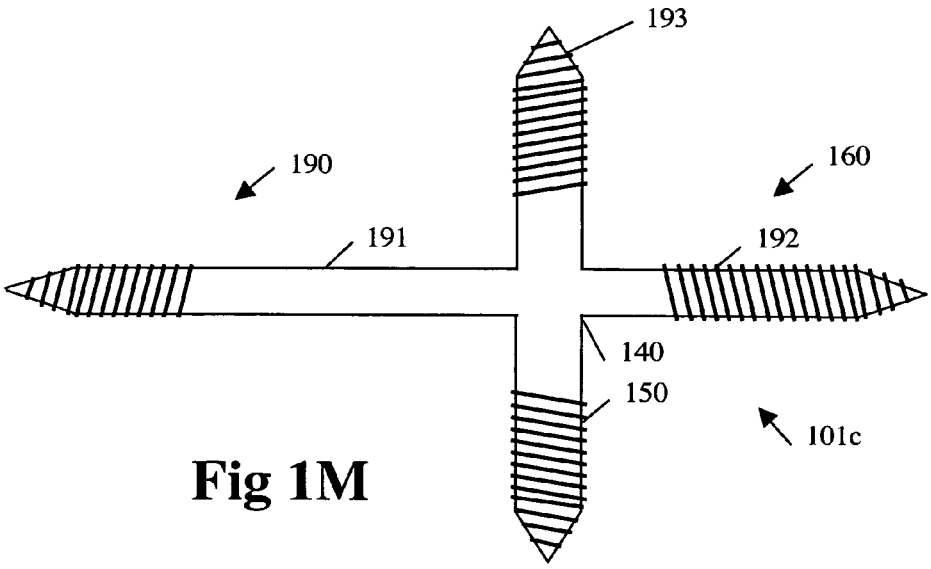
Figure 1N:
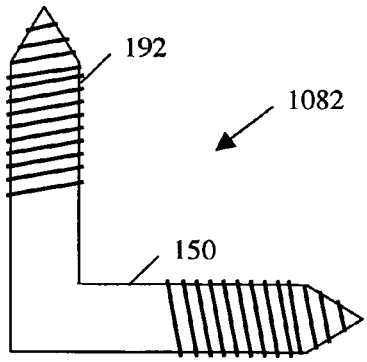
FIGS. 1N and 1O show embodiments of the threaded support.
Figure 1O:
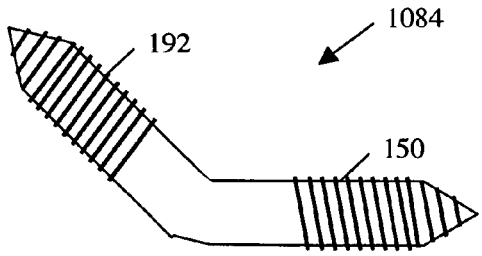
Figure 1P:
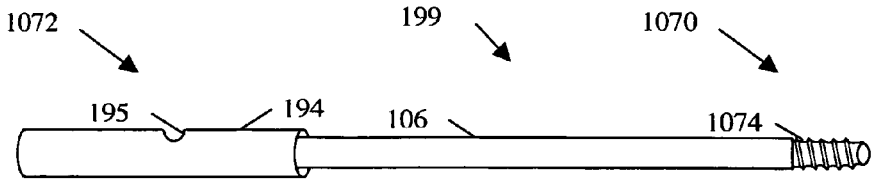
Figure 1Q:
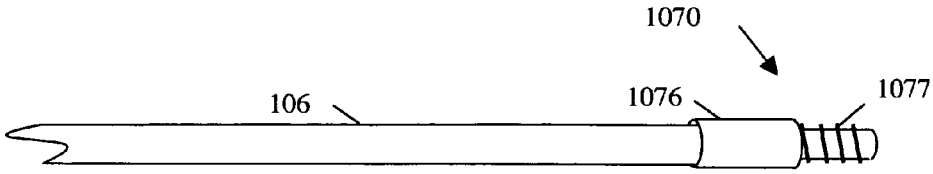

FIG. 1K shows an alternate dimpled connector 194*e*. This embodiment comprises the cord retainer 1075, the cord 126*a*, and a retaining dimple 197. The cord 126*a* passes through the cord retainer 1075 and is secured with cord attachment or knot 126*b*. The cord retainer 1075 is held inside the dimpled connecter 194*e* by the retaining dimple 197, and optionally with glue. This embodiment is easy to assemble and requires few specialized parts or tools. It also strengthens the connector. The force on the cord 126*a* or shaft 106 is distributed evenly.

The cord retainer 1075 can be made by cutting a relatively thin slice of a solid cylinder and drilling a hole to pass cord 126*a*. Once the cord 126*a* is passed through the hole, a knot 126*b* can be tied in the cord 126*a*. The cord retainer 1075 could be made with a short segment of hollow fiberglass; however, better results have been found by making the cord retainer from plastic, such as polyoxymethylene or acetal. While the hole can be drilled in the center, as shown here, to avoid having a sharp screw point damage the knot 126*b*, the hole can be advantageously drilled off center as will be shown later in FIG. 1W.

Figure 1R:
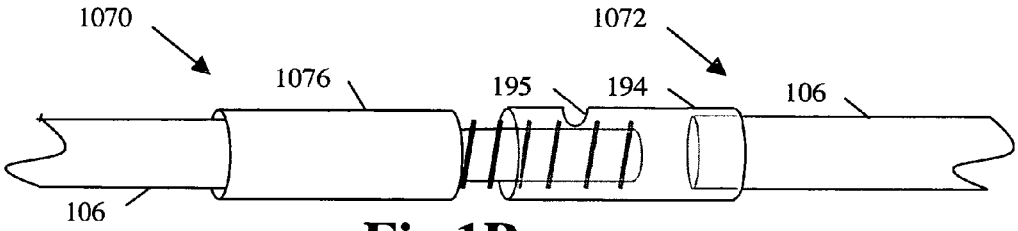

In FIG. 1K, the thread receiving dimples 195*a* through 195*c* and deeper dimples 198*a* and 198*b* as described in relation to FIG. 1R are also shown but are optional. When the leg 150 or 192 is threadedly attached to the enhance dimpled connector 194*d*, the point of the leg will engage the deeper dimples 198 and stop the point of the leg from being inserted beyond the deeper dimples 198 where the point could damage the cord attachment or knot 126*b*. Note that any threaded leg could be removably attached to a dimpled connector 194, for example, such as 194*e*.

Alternatively, in a currently preferred embodiment of the dimpled connector 194, only one dimple, 195*a* is needed to make the attachment with the threaded leg and a second dimple which is not a deeper dimple 198, such as 195*b*, is placed at a position that is not at an distance that is a multiple of the distance between the threads (e.g. between the location of 195*b* and 195*c*). When the teeth reach the second irregularly placed dimple (e.g. 195*b*), the threads will bind, thus the second irregularly placed dimple will stop the point of the leg from being inserted beyond the irregularly palced dimple where the point could damage the cord attachment or knot 126*b*. For example, this currently preferred embodiment of a dimpled connector is made by placing one dimple 195*a* ¼ inch from the end of a connector 700 and a second irregularly placed dimple 195*b* about ¾ inch from the end, while using seven threads per inch.

FIG. 1L through FIG. 1O

FIG. 1L illustrates an embodiment of alternate support 101 which is an embodiment of the attaching pivoting support 100. The 3-legged alternate support 101*b* is similar to the alternate support 101 described relation to FIG. 1E except that the third leg 190 is a threaded third leg 191. Threaded third leg 191 has the same threaded portion as first leg 150. In this embodiment either the first leg 150, alternate second leg 192, or the threaded third leg 191 can be attached to the attaching structure. The unused legs can be attached to a shaft 106 or connected shaft 760. The bend 140 allows a user to exert a force on the alternate second leg 192 or the first leg 150 that act as a lever to screw the threaded third leg 191 into the attaching structure 130. The threaded third leg 191 is sharpened end. The sharpened end of the threaded third leg 191 can be easily inserted into the ground. This allows the same alternate support 101*b* to be used to form a ground blind as well as various tree blind configurations.

FIG. 1M illustrates yet another embodiment of alternate support 101. A 4-legged alternate support 101*c* has the first leg 150, alternate second leg 192, and the threaded third leg 191 of the 3-legged alternate support 101*b* and adds a fourth leg 193. Threaded fourth leg 193 has the same threaded portion as the other three legs.

The alternate supports 101*b* and 101*c* are interchangeable because of the common threading and can be used to comprise a number of modules in the modular system for concealment and shelter of the present invention. Any of the 3 or 4 legs can be attached to a dimpled connector 194 or to an attaching structure 130. Preferably, the third leg 190 is longer and is inserted into the ground. Force can be applied to the first leg 150 (or the fourth leg 193) to facilitate ground insertion and removal. Once inserted into the ground, the alternate support 101 provides a solid anchor for various modules that will be discussed below.

FIGS. 1N and 1O illustrate two embodiments of brackets with two legs, namely a 2-legged threaded support 1082, and an obtuse threaded support 1084. The first leg 150 and the second leg 192 have the same threaded portions so both legs can be attached to a dimpled connector 194 or to an attaching structure 130. These threaded supports can be used to connect components in various configurations. FIGS. 1N and 1O are shown with pointed ends, however, in some embodiments the ends do not need to be pointed.

Figure 22G:
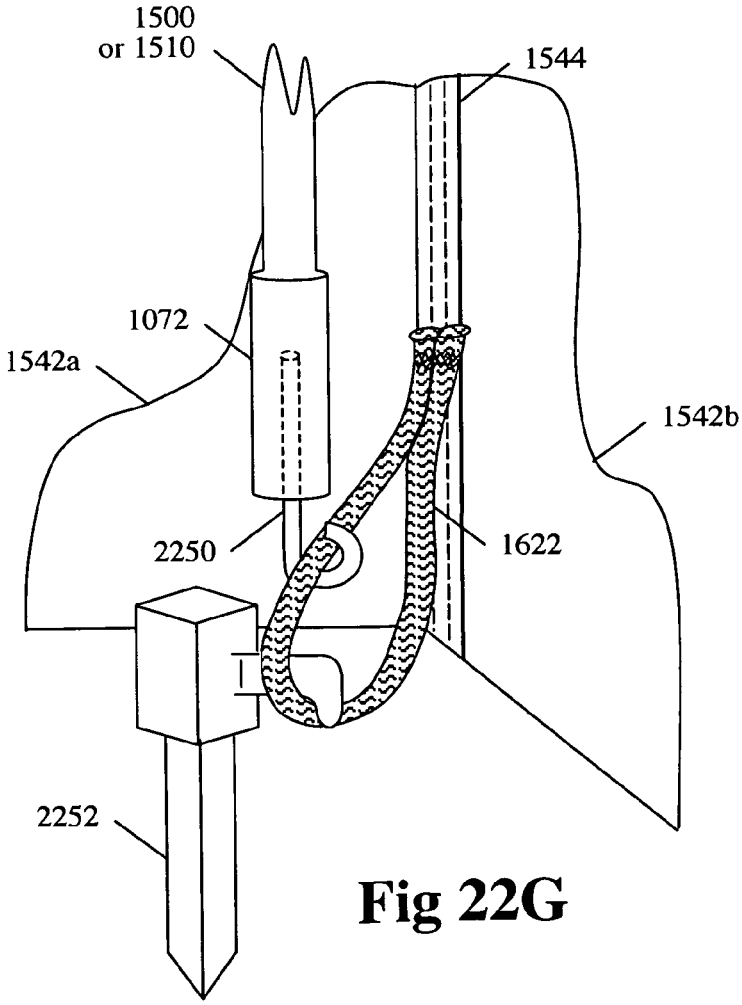
Figure 22A:
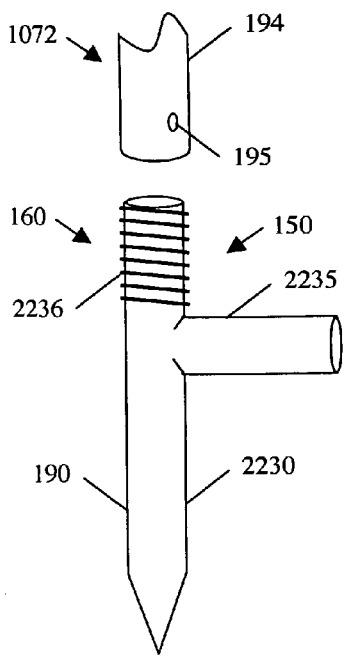

See FIG. 22A for an embodiment of a three-legged connector with both a threaded leg and a non-threaded leg which are not pointed.

FIG. 1P through FIG. 1T

FIG. 1P illustrates a shaft segment 199. A plurality of shaft segments 199 may be attached to form a threaded segmented shaft 109. For example, FIG. 1T shows a threaded segmented shaft 109 comprised of two shaft segments 199. Many of the modules of the present invention are comprised of shaft segments 199 of various lengths that can be connected in various configurations.

In the currently preferred embodiment, each shaft segment 199 is 15.5 inches (or about 39.5 cm) in length (also known as a "half stick"). The standard full size of the shaft 106 of a support 100 is about 31 inches (or 79 cm) which can be made by using two half sticks. Other components, such as 2-receptor shaft 1690 (FIG. 1W), cover shaft segments 1520 (FIGS. 8A, 8B) and alternate shaft segment 1099 (FIG. 11C), are also full size, i.e. 31 inches.

As shown in FIG. 1P a shaft segment 199 has an inserting end 1070 (also called in the art a male end) and a receiving end 1072 (also called in the art a female end). The inserting end 1070 has threads. The threads can be formed by machining the end of the shaft 106 resulting in a machined end as shown in FIG. 1P. Alternatively, the threads can be part of a threaded connector 1076 as shown in FIG. 1Q. The threaded connector 1076 has connector threads 1077.

The receiving end 1072 as shown in FIG. 1P can be any dimpled connector 194 having at least one thread receiving dimple 195.

As shown in FIG. 1R the inserting end 1070 of one shaft segment 199 can be threadedly attached to the receiving end 1072 of a second shaft segment 199. Two or more shaft segments 199 can be connected to form a threaded segmented shaft 109 as shown in FIG. 1DD.

Figure 1S:
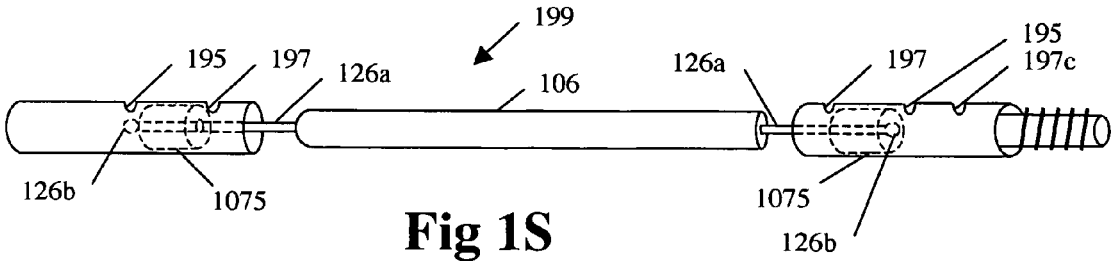
Figure 1T:
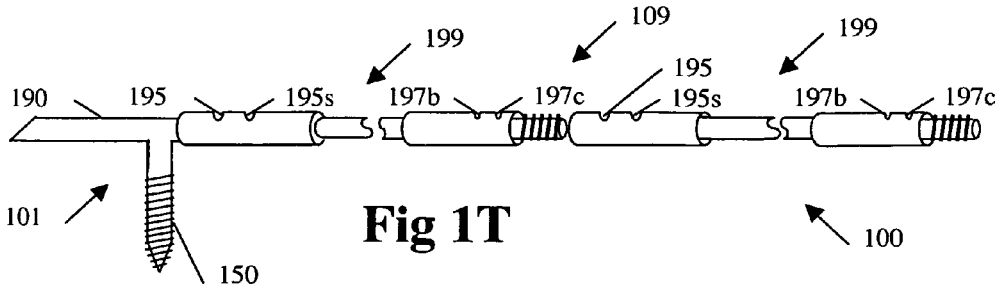
Figure 1U:
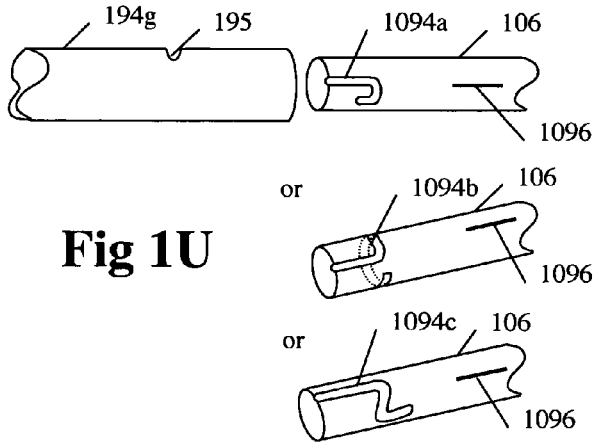

FIG. 1S shows a novel feature of the present invention. The connectors of both the inserting end 1070 and receiving end 1072 of the shaft segment 199 can be attached to the shaft 106 using a cord 126a using pins 196 (not shown) or cord retainers 1075 (as shown in FIG. 1R, FIG. 1W and here in FIG. 1S). The cord is attached using the cord attachment or knot 126*b*. This feature allows a plurality of shaft segments 199 to be threaded together with various supports or brackets, such as 101, 101*b*, 101*c*, 1082, 1084, 1800, and so forth, to form various configurations. Once configured the structure can be quickly broken down by separating the connectors from the shaft 106 by stretching the cord 126*a* on one or both ends. The structure can be quickly put up by reinserting each end of shaft 106 into the connector to which it is attached by the cord 126. The advantages of this feature will be seen below.

FIG. 1T shows an embodiment of the attaching pivoting support 100 of the present invention, comprising an alternate support 101 (or 101*b* or 101*c*, not shown) and a threaded segmented shaft 109.

FIG. 1U through FIG. 1Z

Because the receiving end 1072 of the connectors of the currently preferred embodiment of the modular system of the present invention is a dimpled connector 194, rather than a threaded connector 104, the inserting ends 1070 do not necessary need to have connector threads 1077. Instead the shaft 106 can have a locking slot 1094 through which the receiving dimple 195 is passed. As shown in FIG. 1U, the locking slot 1094 can have a path with a shape that will lock the two pieces together. A J-shaped locking slot 1904*a* can be useful if the shaft 106 has force applied to it that brings it back toward the connector (for example the cord 126*a* as shown in FIG. 1S). Alternatively, when the force can be either a pulling or pushing force, a locking slot 1094*b* can have a path that circles almost completely around the shaft, or locking slot 1094*c* can have a zig-zag path. Because the locking slot 1094 is hidden when inserted into the dimpled connector 194*g*, a slot mark 1096 can be made on the shaft 106 showing the position of the locking slot entry and exit. The locking slot has the advantage over connector threads 1077 in that the connection can be made or released with a rotation that is less than one complete rotation. With threaded connectors such as 1076, many rotations are required.

The locking slot 1094 can be used to temporarily secure the connection of a shaft 106 to a dimpled connector 194f which otherwise would be held together only by the force of the cord 126*a*. In one embodiment of the modular system of the present invention the shaft segments 199 with cords 126 attaching the receiving 1070 and receiving 1072 ends to the shaft 106 as shown in FIG. 1S use the locking slot 1094 (instead of threads) and dimpled connectors 194.

Figure 1V:
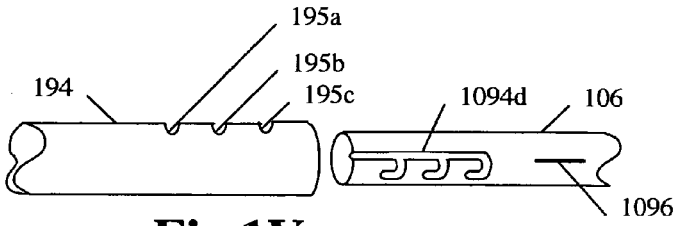
Figure 1W:
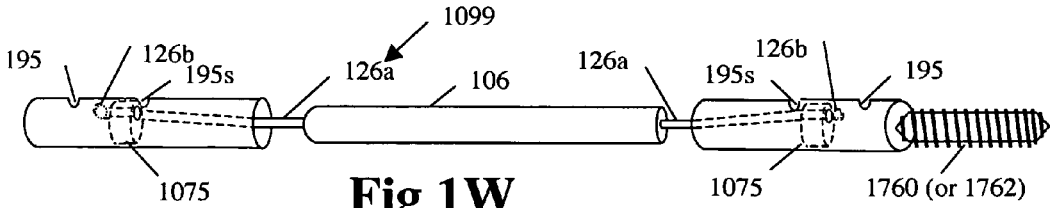

FIG. 1V shows an alternate embodiment of three-notched locking slot 1094*d* which would mate with the three-dimpled connector 194 as shown in FIG. 1I.

FIG. 1W shows a more versatile embodiment of the shaft segment 199 that includes the features described in FIG. 1S. In this embodiment, the connectors at both ends are formed the same, namely both as receiving ends 1072 (forming a 2-receptor shaft 1690). Either end can be converted to be the inserting end 1070 by attaching a short inserting-to-inserting connector 1760, such as the one shown in FIG. 17I or any support having at least two legs with threads (e.g. 101, 101*b*, 101*c*, 1082, 1084) or locking slots 1094 (e.g. FIG. 1U and slotted connector 1762, FIG. 17J). Both connectors are connected to the shaft 106 with cords 126*a* providing a means for breaking down the structure after it has been configured with the threaded attachments. FIG. 1W shows the holes in the cord retainers 1075 being off-center. As discussed above, this is advantageous because the sharp point of a support such as 101*b* will not damage the cord knot or attachment 126*b*.

The alternate shaft segment 1099 shown in FIG. 1W is more versatile than the embodiment in FIG. 1S, because it allows all the shafts in the system to be common and interchangeable. These type shafts can be interconnected with the various supports (such as 101, 101*b*, 101*c*, 1082, 1084, 1800, etc.) and connectors (such as 1086, 1760, or 1762) to form any number of structures, including those shown, for example, in FIGS. 3A, 4B, 5A-B, 16G, 16L-N, 17A-C, 19A-F, 20A, 21B-C, and 22*a*-C, as well as others shown in the parent application or that will be designed by users. Like the embodiment of FIG. 1S, once configured with the thread-to-dimple attachments the structure can be quickly broken down by separating the connectors from the shaft 106 by stretching the cord 126*a* on one or both ends. The structure can be quickly put up by reinserting each end of shaft 106 into the connector to which it is attached by the cord 126*a*.

Figure 1X:
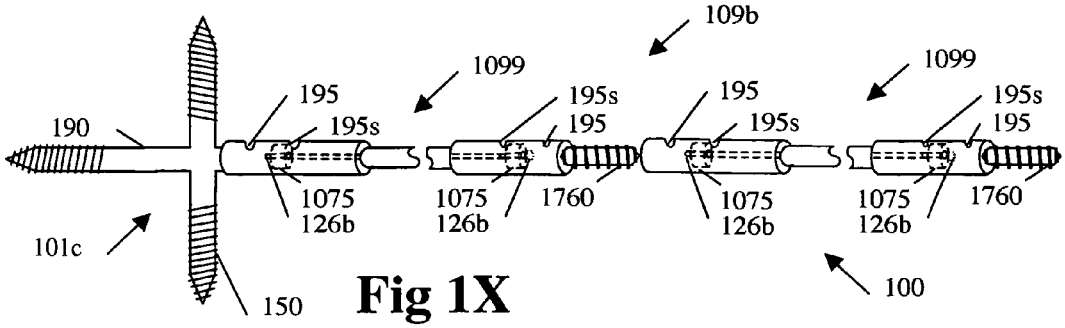

FIG. 1X shows an embodiment of the attaching pivoting support 100 of the present invention, comprising an alternate support 101*c* (or 101 or 101*b*, not shown) and a threaded segmented shaft 109 which uses the alternate shaft segments 1099 and connectors 1760 of embodiment shown in FIG. 1W.

Figure 1Y:
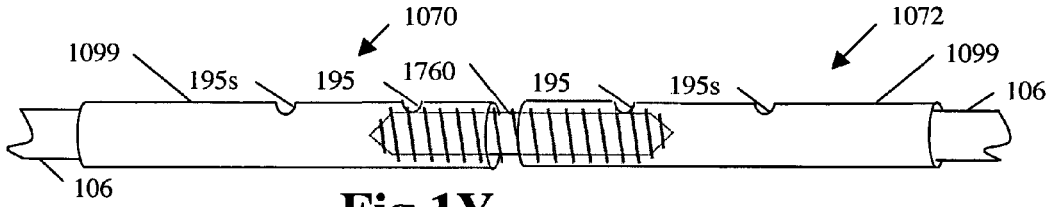

FIG. 1Y shows the inserting-to-inserting connector 1760 that can be threadedly attached to two dimpled connectors 194 each having at least one thread receiving dimple 195. The connector 1760 is not trapped in either dimpled connector 194 providing more versatility. The inserting end 1070 comprises an inserting-to-inserting connector 1760 attached to a dimpled connector 194 connected to a shaft 106. It can then be connected to any receiving end 1072.

Figure 1Z:
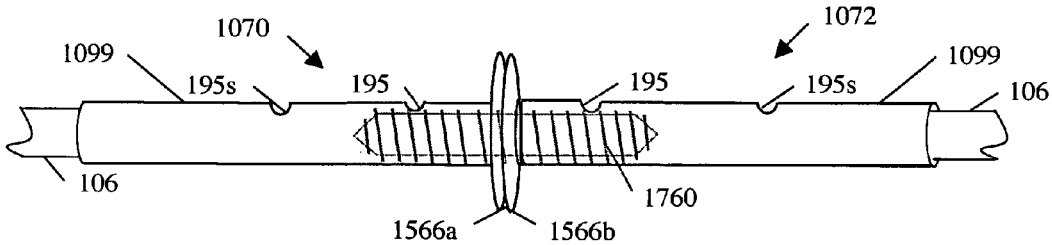

FIG. 1Z shows that the inserting end 1070 and the receiving end 1072 of the alternate shaft segments 1099 have a novel advantage over conventional segmented shafts in that the inserting end 1070 can pass through one or more firm grommets (or eyelets), such as 1566*a* and 1566*b*, and secure them between two alternate shaft segments 1099.

FIG. 2

Figure 2:
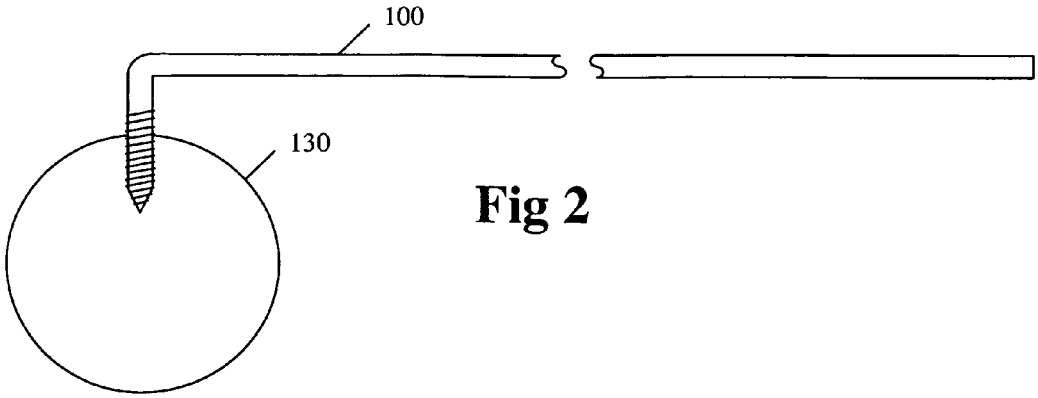
FIG. 2 shows the support attached to an attaching support.

FIG. 2 shows a top cross-sectional view of the attaching pivoting support 100 attached to the attaching structure 130. In this example the attaching structure 130 is shown as tree or a wooden pole. As will be shown later, the attaching structure 130 may comprise scaffolds, buildings, or devices composed of straps, belts, or other components further attached to trees or other structures.

In one normal use, the second leg 160 is extended generally horizontally. In this simplest embodiment of the present invention, the operator could drape a sheet, coat, poncho, garbage bag, tarp, or other available material over the attaching pivoting support 100 to form a means of concealment.

Figure 3A:
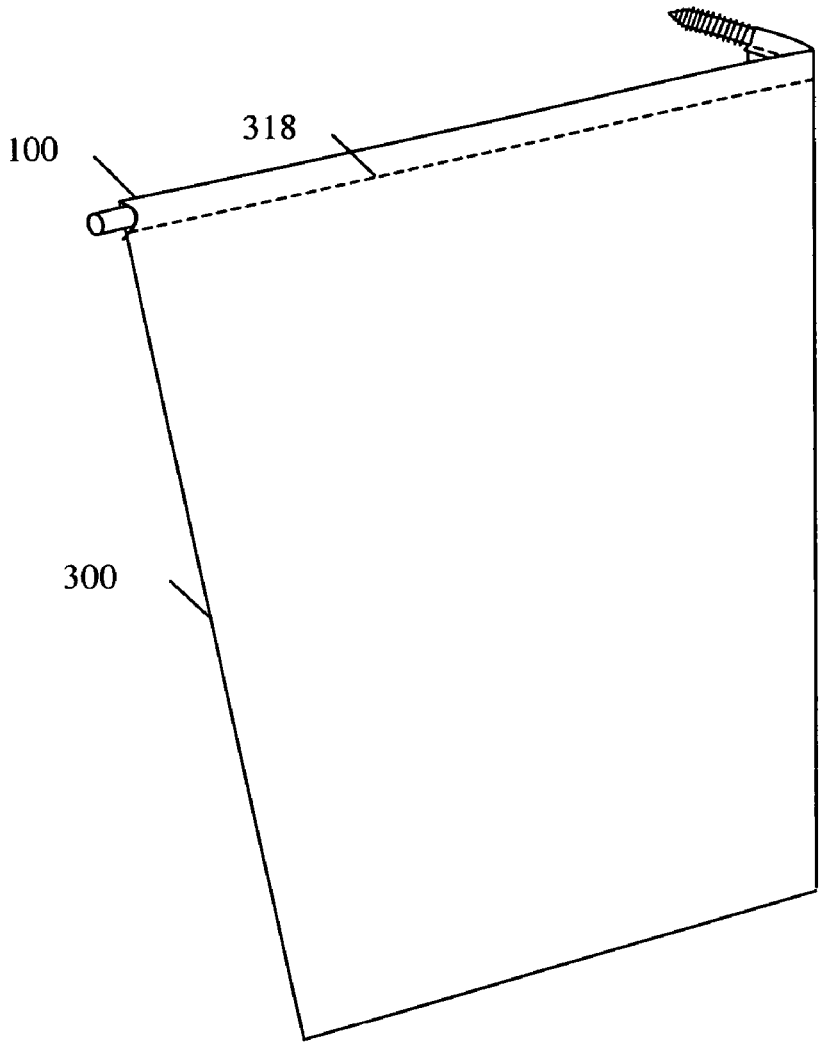
FIG. 3A shows the support combined with a curtain.
Figure 3C:
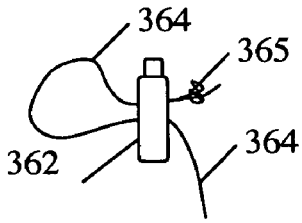
FIG. 3B and FIG. 3C show details of curtain embodiments.
Figure 3B:
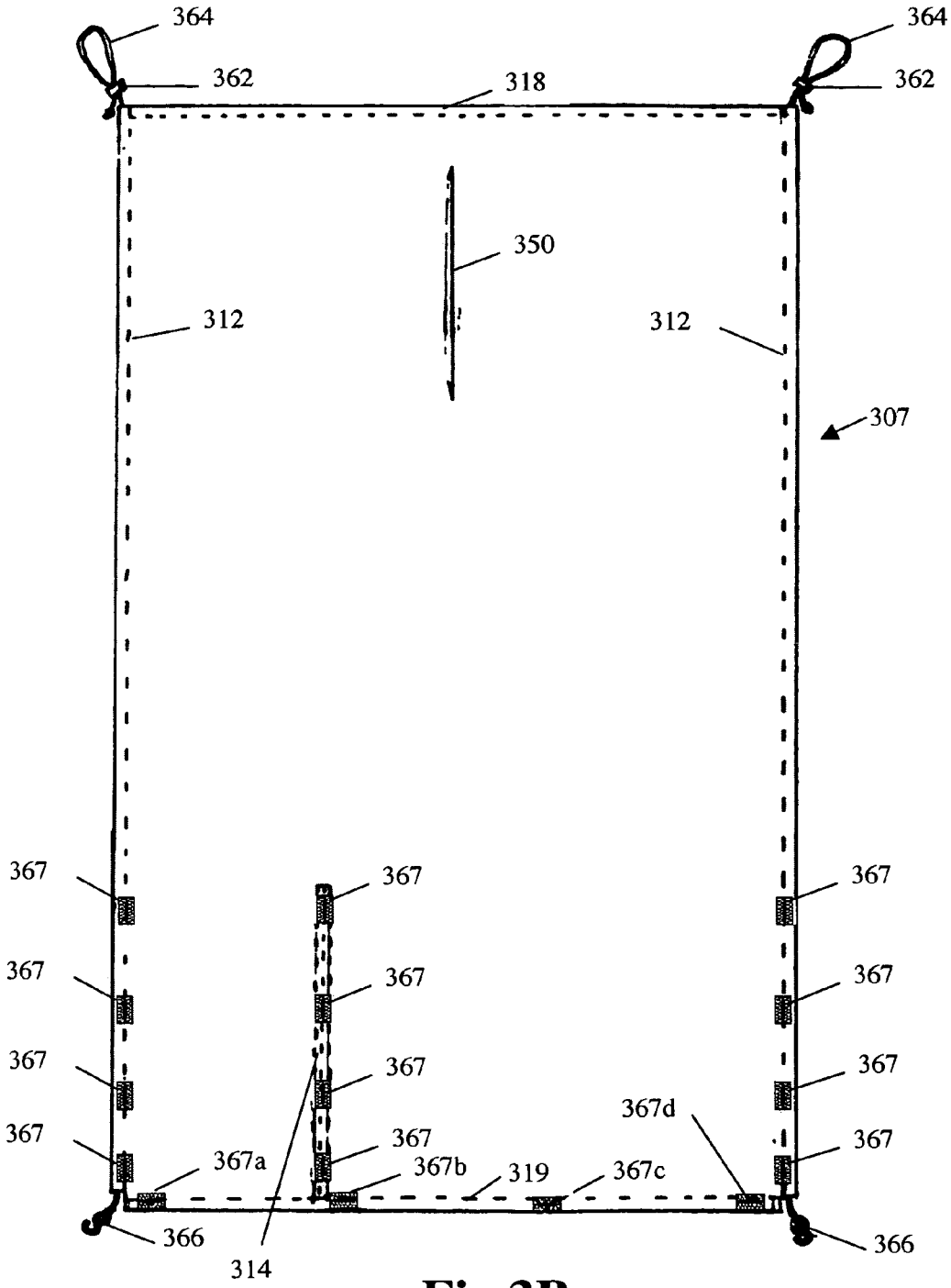

FIG. 3A through FIG. 3C

FIG. 3A shows an embodiment of the present invention where a curtain 300 is hanging from the attaching pivoting support 100. In this example, the curtain is a sheet of material with a support hem 318 sewn or sealed along the top edge. Good results have been obtained by making the curtain from camouflaged woven material or plastic sheeting. The attaching pivoting support 100 is passed through the support hem 318 of the curtain 300.

A slit 350 can optionally be placed in the curtain 300 to allow the person to peek through the curtain 300 without lowering the attaching pivoting support 100.

Regardless of the position, the shaft 106 or second leg 160 of the attaching pivoting support 100 provides tension on the curtain 300 to hold it tight in the wind to avoid noise and movement.

FIG. 3B

FIG. 3B shows an alternate curtain 307, which is an embodiment of the curtain 300 with one or more drawstrings 364. In this exemplary embodiment, in addition to the support hem 318, there is an edge hem 312 on each side of the curtain. Optionally, there could be one (as shown) or more interior hems 314 in the material between the edges. Each edge hem 312 forms a sleeve or path through which a drawstring 364 can pass. One end of the drawstring is attached to a drawstring fastener 366. It is advantageous to have the drawstring fastener 366 be a moveable attachment, such as a hook or snap. A moveable version of the drawstring fastener 366 could be attached to one of a plurality of reinforced holes 367 that are placed in the curtain 300. The other of end of the drawstring 364 is drawn in a loop that is passed through a drawstring clip 362. The drawstring clip 362 prevents this end of the drawstring 364 from going through the respective hem (312). When the drawstring fastener 366 is attached to a reinforced hole 367 above the bottom of the alternate curtain 307, the material at the bottom of the curtain is drawn up shortening the effective length of the curtain 300. Typically, the drawstring fastener 366 end of the drawstring 364 is also passed around a fixed object, such as a tree branch, a tree trunk, a tree stand, or a stake 1320. The extra length of the drawstring 364 can be drawn through the drawstring clip 362. The tension between the fixed object at the drawstring fastener 366 end of the drawstring 364 and the drawstring clip 362 keeps that section of the drawstring 364 and the alternate curtain 307 taut. By securing each drawstring 364 as explained here, the length and shape of the alternate curtain 307 can be adjusted and the alternate curtain 307 is held tight so that its material is less likely to move or make noise in the wind. This layout makes it easier and safer to manipulate or adjust the curtain 300. Being able to move the drawstring fastener 366 and adjust the length of the drawstring 364 using the drawstring clip 362 without bending over and reaching all the way to the bottom of the curtain 300 is valuable when the user is high on a tree stand. The user can make adjustments while sitting or standing.

FIG. 3B shows the interior hem 314 being shorter than the edge hem 312 teaching that the technique can be used with the hem (312 or 314) only going up a portion of the curtain 300. This reduces the cost of the system and provides room for the slit 350 or a window 322.

In this exemplary embodiment, in addition to the reinforced holes 367 near the edge hem, there are reinforced holes 367 placed in the interior hem 314 of the curtain 300. When the drawstring fastener 366 is attached to one of the interior reinforced holes 367 a sideways (lateral) force is added to the force that draws up the bottom of the curtain 300. This sideways force can be used to change the shape of the curtain. The sideways force can be used to secure the curtain 300 around an object such as a tree or the base of the tree stand. The shape of curtain 300 can be changed while maintaining a taut curtain 300 that will not flutter in the wind.

FIG. 3B also shows the optional slit 350 in the alternate curtain 307.

FIG. 3C shows details of the extra length of the drawstring 364 being looped through the drawstring clip 362. A drawstring knot 365 keeps the end of the drawstring from passing through the drawstring clip 362. The user can pull on the loop while opening the drawstring clip 362 to draw more of the drawstring 364 beyond the drawstring clip 362. The user can relax the pressure on the loop while opening the drawstring clip 362 to release some of the drawstring 364 thus loosening or extending the alternate curtain 307.

The alternate support hem 319 contains reinforced holes 367*a* through 367*d*. The reinforced holes 367 shown throughout this curtain are an embodiment of the grommet 368. The reinforced holes 367 can be formed as conventional button holes where during sewing the button hole pattern can be made in the fabric and later cut. In this embodiment, the manufacturer of alternate curtain 307 requires fewer parts and tools than, for example, the use of metal grommets.

FIG. 4A

Figure 4A:
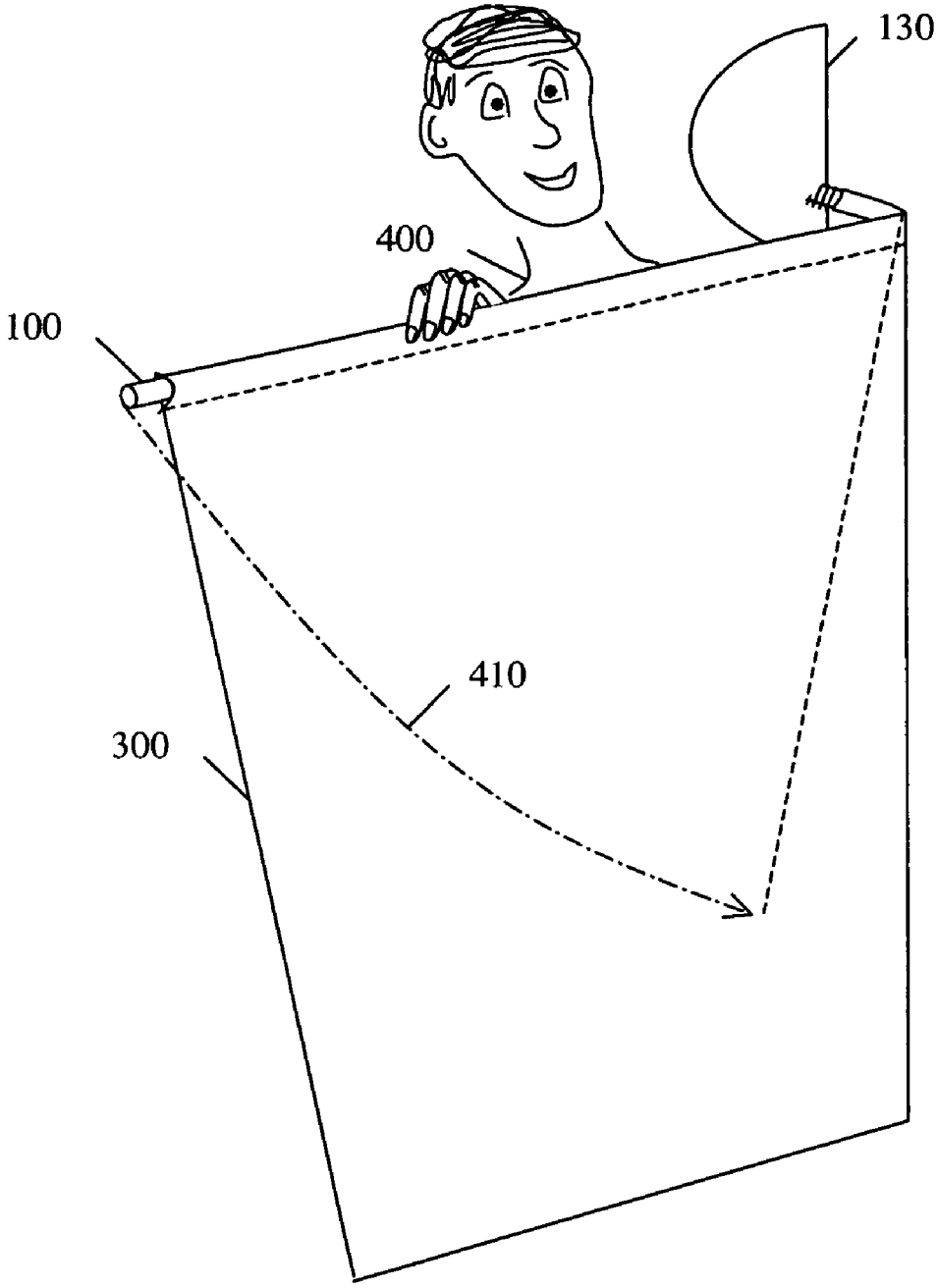
FIG. 4A shows exemplary use of the present invention.

FIG. 4A shows an operator 400 concealed by the present invention. The operator 400 may be washing or taking care of other personal hygiene.

The means of concealment quickly and quietly can be lowered as shown by an angular path 410. This allows the operator 400 to look over the curtain 300 or to shoot an arrow or fire a gun behind them without being obstructed by the means of concealment. After firing the user can quickly and quietly return the curtain 300 into its normal position as shown.

As explained earlier, one objective and advantage of the present invention is maintaining the frictional force of the first leg 150 with the attaching structure 130. This frictional force holds the attaching pivoting support 100 in place when not being moved by the operator 400. The operator 400 can also angularly raise the support 100 so that the operator's head is also concealed by curtain 300.

As explained earlier, the person makes a silhouette against the background and is observable from 360 degrees. In the method of present invention, first, the operator 400 attaches the attaching pivoting support 100 to the attaching structure 130 (in this example a tree). Next the operator 400 hides in front of the curtain 300. This novel approach revolutionizes wildlife observation as explained in the parent application.

FIG. 4B

Figure 4B:
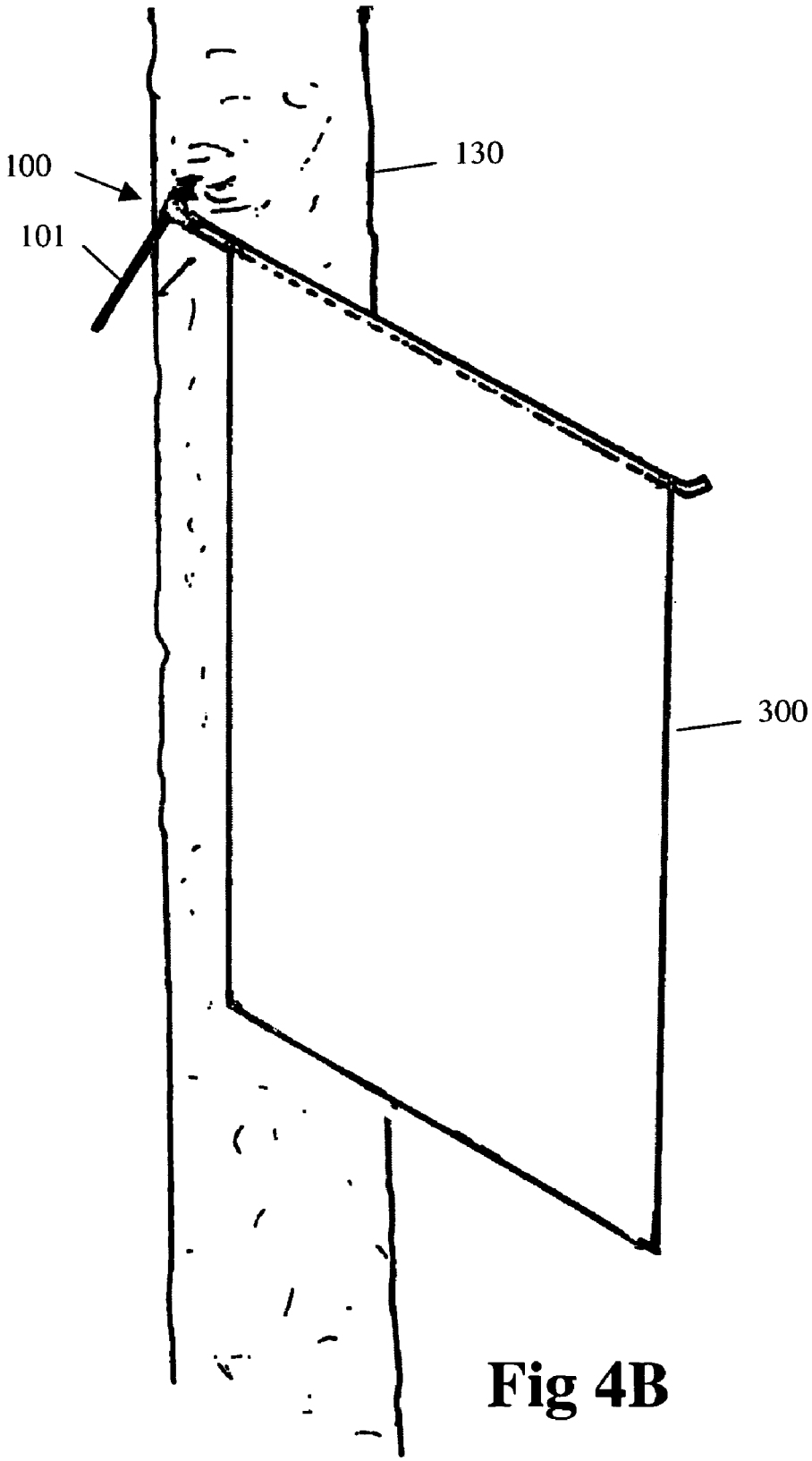
FIG. 4B shows exemplary use of the alternate support embodiment.

FIG. 4B shows an example of the use of alternate support 101 as an attaching pivoting support 100. In this example, either first leg 150 or alternate second leg 192 can be attached to the attaching structure 130 (shown as a tree). The curtain 300 can be quickly and quietly lowered in an angular path as described above in relation to FIG. 4A.

As explained earlier, an objective and advantage of the present invention is maintaining the frictional force. Either first leg 150 or alternate second leg 192 can be used to attach to the attaching structure 130.

FIG. 5A and FIG. 5B

FIG. 5A and FIG. 5B show ground blind embodiments.

FIG. 5A shows the use of three alternate supports 101 and two alternate curtains 307 to form a ground blind. In this example, the alternate second leg 192 of each alternate support 101 is inserted into the ground. Each alternate support 101 is connected to a shaft 106 using either a threaded connector 104 or one of the embodiments of a dimpled connector 194. The alternate support hems 319 of both a first alternate curtain 307*a* and a second alternate curtain 307*b* are placed over the center of alternate support 101. The support hem 318 of the first alternate curtain 307*a* is placed over the shaft of the alternate support 101 on the left. The support hem 318 of the first alternate curtain 307*b* is placed over the shaft of the alternate support 101 on the right. The alternate supports 101 can be placed in a line to form a wall, or diagonally to form a V-shaped blind.

Three or more curtains could be used to form a fully enclosed blind.

FIG. 5B shows an embodiment with more of the optional curtain features, such as, drawstrings 364 and the use of the reinforced holes 167*a* through 367*d* to create an interwoven connection between two alternate curtains 307. This will be explained in more detail in reference to FIG. 5D below.

FIG. 5C and FIG. 5D

FIG. 5C shows an embodiment where the third leg 190 has been inserted into the ground. The alternate second leg 192 has been attached to a shaft 106 or connected shaft 760 using a dimpled connector. In this example, the first leg 150 can be used to assert downward force on the alternate support 101 using a foot to drive the third leg 190 into rocky or frozen soil.

FIG. 5D illustrates an current preferred embodiment where two curtains 300 are joined over a shaft, such as 106, 109, 760, 1099, or 1690.

This embodiment shows joining alternate curtains 307. The first alternate curtain 307*a* and the second alternate curtain 307*b* are joined by passing the shaft (106, 109, 760, or 1099) through the alternate support hem 319 of each curtain. At each of the reinforced holes 367*a* through 367*d*, the rod passes out of the hem of one curtain and into the hem of the other curtain. For example, the shaft would enter through 307*a* and then into the hem of curtain 307*b* at reinforced hole 367*d*. It would exit 307*b* at 367*c* and at that point enter 307*a*'s hem at 367*b*. It would continue along the alternate support hem 319 where it would exit 307*a* at 367*c* and reenter 307*b* at 367*b* where it would continue through the hem 319 of 307*b* until is exited at 367*a* and would finally pass through the final reinforced hole 367*d* of 307*a*. At that point, both alternate curtains 307 would be secured by the tip 1402 of the inserting end 1070 of the shaft. The advantage of this arrangement is that it forms a tight connection that prevents light and wind from passing between the two curtains. This novel alternate support hem 319 also has the advantage of being easy to secure over a shaft by itself or interwoven as described above.

FIG. 6

FIG. 6 shows the detail of the inserting end 1070 of the shaft (e.g. 106. 109, or 1099) which passes through and supports the curtains (e.g. 307*a* and 307*b*). The tip 1402 has a narrow diameter and the rim 1404 has a wider diameter. As shown in FIG. 5D, when inserted through the first alternate curtain 307*a* and the second alternate curtain 307*b* the tip 1402 can pass through reinforced holes 367*d* of 307*a* and 367*a* of 307*b*. The rim 1404 portion of the inserting end 1070 holds both curtains in place while under tension, but easily allows the curtains to be slipped off to break down, or further build up, the blind.

Alternatively, the shaft (e.g. 106 or 109) passes through and supports a portion of the cover 1540 (see FIGS. 12E-F and 16E-16F) or the skirt 2010 (e.g. FIG. 20).

FIG. 7A through FIG. 7B

It is anticipated by the present invention that various components will be made from multiple shafts connected permanently or temporarily by various connectors.

FIG. 7A shows the straight connector 700.

FIG. 7B shows an angled connector 710. The angle is obtuse.

Good results have been obtained by making these connectors with aluminum alloy tubes or plastic.

FIG. 8A through FIG. 8C

FIGS. 8A through FIG. 8C show components and features of an advanced module that can be combined with the basic module (as shown in FIG. 12A and partially in FIG. 5A) to form various covered blind and shelter structures.

FIG. 8A shows a segmented cover shaft 1500. In the embodiment shown, the segmented cover shaft 1500 is comprised of four cover shaft segments 1520 connected together with a cord 126*a*. Both ends of the segmented cover shaft 1500, in this exemplary embodiment, are receiving ends 1072 with dimpled connectors 194. As will be shown later, in other embodiments (e.g. FIG. 11C with 1760 on each end), both ends of the segmented cover shaft 1500 can be inserting ends 1070.

FIG. 8B shows a shelter frame 1530. In this embodiment, the frame is constructed of four attaching pivoting supports 100 (using alternate supports 101, such as 101*b*, and threaded segmented shaft 108) and two segmented cover shafts 1500*a* and 1500*b*. The two segmented cover shafts 1500*a* and 1500*b* cross and connect to supports 100 in opposite corners forming a frame for an arched dome.

This method of construction has other advantages over conventional tents and blinds because the frame 1530 is secured firmly to the ground. A single operator can easily insert each support 100 into the ground and then attach each cover shaft 1500, one at a time, without the conventional difficulty of trying to thread the shafts through the tent or blind material. Also because the structure is secured firmly to the ground it will not move in the wind or slide down steep terrain. The supports 100 can be quickly setup and used independently with curtains 307 as shown in FIG. 5A and FIG. 12 and, later, the fourth support 100*d* and cover shafts (1500 or 1510) and cover 1540 (shown later) can be added as needed for shelter from sun, rain, or snow or for enhanced concealment. This novel method is described in more detail in relation to the two series shown in FIG. 12A through 12E, and FIG. 12D through 12H, respectively.

In the currently preferred embodiment, each shaft segment 199 (as shown in FIG. 1S) is 15.5 inches (or about 39.5 cm) in length (also known as a "half stick"). The standard full size the shaft 106 of each support 100, including connectors, is about 31 inches (or 79 cm) which can be made by using two half sticks. The cover shaft segments 1520 (FIGS. 8A, 8B) are also full size, i.e. about 31 inches. Thus, in the currently preferred embodiment, each segmented cover shaft 1500 comprises four cover shaft segments 1520 for a combined length of about 125 inches, and the full arch (from 101 to 101) is six full lengths for a total length of about 187 inches (or about 474 cm). This results in a shelter frame within which two six feet tall users 400 can stand while being less than six feet wide, so that one person alone can place or adjust two adjacent supports 100 (for example, such as 100*a* and 100*b* in FIGS. 12A through 12H).

FIG. 8C shows a cover 1540 comprised of four cover panels 1542. Adjacent panels are connected together with a cover seam 1544. For example, cover panel 1542*a* is connected to cover panel 1542*b* on its right side and to cover panel 1542*d* on its left side. For concealment uses, the cover is preferably made of camouflaged material.

A novel feature of the present invention is that the cover 1540 can used to cover the shelter frame 1530 including any curtains 307 that are already attached to the shelter frame 1530 (see the transition from FIG. 12A to FIG. 12B). One advantage over a tent with external poles is that the cover 1540 is external to the poles, and is preferably camouflaged, so that the wildlife will not see the poles at the apex of the structure where tent poles would be most noticeable against the sky.

Another novel feature of the present invention is that the cover 1540 can be rolled up or lifted as desired because the cover is not integral to the structure of the shelter, namely the frame 1530 can stand and generally hold its shape on its own.

The present invention anticipates that a number of substantially similar pivoting support structures will be constructed of with any number of supports, shafts, and connectors including those shown in the parent application.

FIG. 9A through FIG. 9B

FIG. 9A shows a knotted connection 926. A knot 902 is tied around a cover shaft (1500 or 1510). Good results have been obtained by tying a lark's head knot over the cover shaft (1500 or 1510). The present invention anticipates that other knots, for example two half hitches, clove hitch, timber hitch, bow line, taut line, bow knot, slip knot, and the like could be substituted. The present invention anticipates that such knots could be tied anywhere on the cover shaft, preferably above a connector, for example, as shown in FIG. 11B and FIG. 11D.

FIG. 9B shows a connector with eye loop 930. Any cord (e.g. 1626 in FIG. 11E) may pass through an eye loop 935 comprising part of the connector.

FIG. 10A

FIG. 10A shows an embodiment of the attaching structure 130 comprising the strap 210 and the attaching fastener 230. In this embodiment the strap 210 passes through holes in each end of, and under, the attaching fastener 230. The strap 210 provides torque resistance. The attaching fastener 230 provides the friction pivot joint 1025 with a threaded leg, for example, the first leg 150. The friction pivot joint 1025 comprises attaching material 1110, attached to the attaching fastener 230, and having a threaded attaching hole 1120.

Good results have been found making the attaching fastener 230 of metal and the attaching material 1110 of a high polymer plastic, the type of plastic being known in the art.

FIG. 10B

FIG. 10B shows an embodiment where the alternate support 101 connects to the attaching fastener 230 (shown in FIG. 10A). As described above the attaching fastener 230 provides the friction pivot joint 1025 with the first leg 150 or alternate second leg 192 (not shown).

A free leg can be used to hang equipment such as a bow, quiver or water bottle.

Figure 11A:
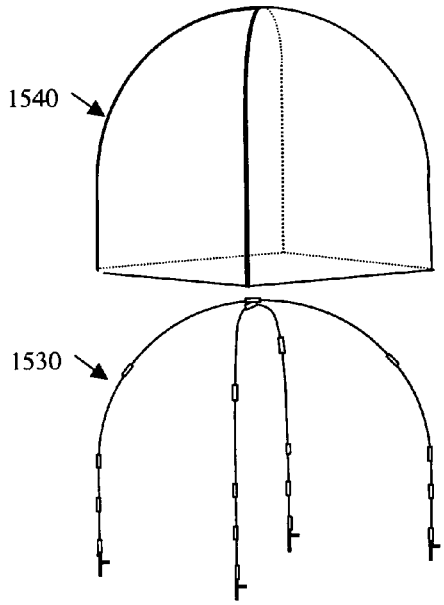
Figure 11B:
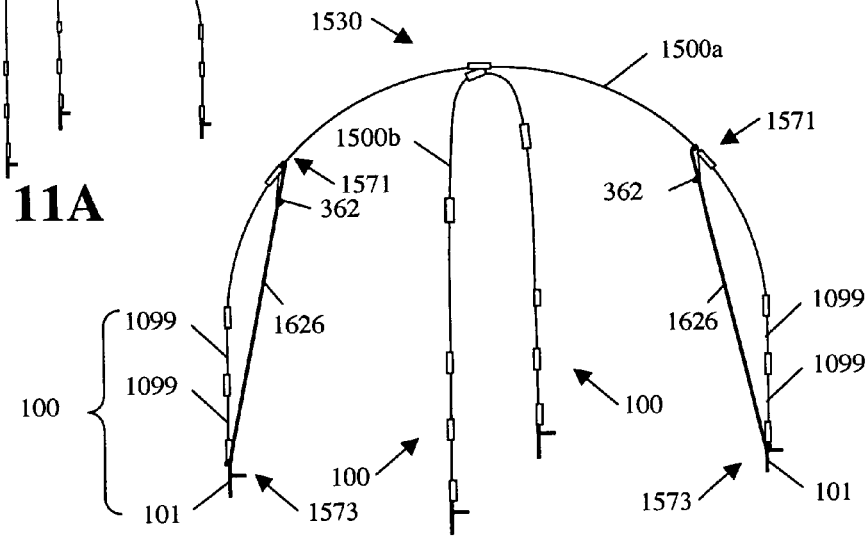
Figure 11C:
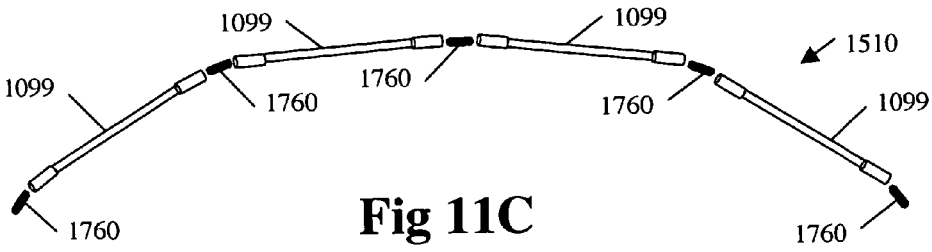
Figure 11D:
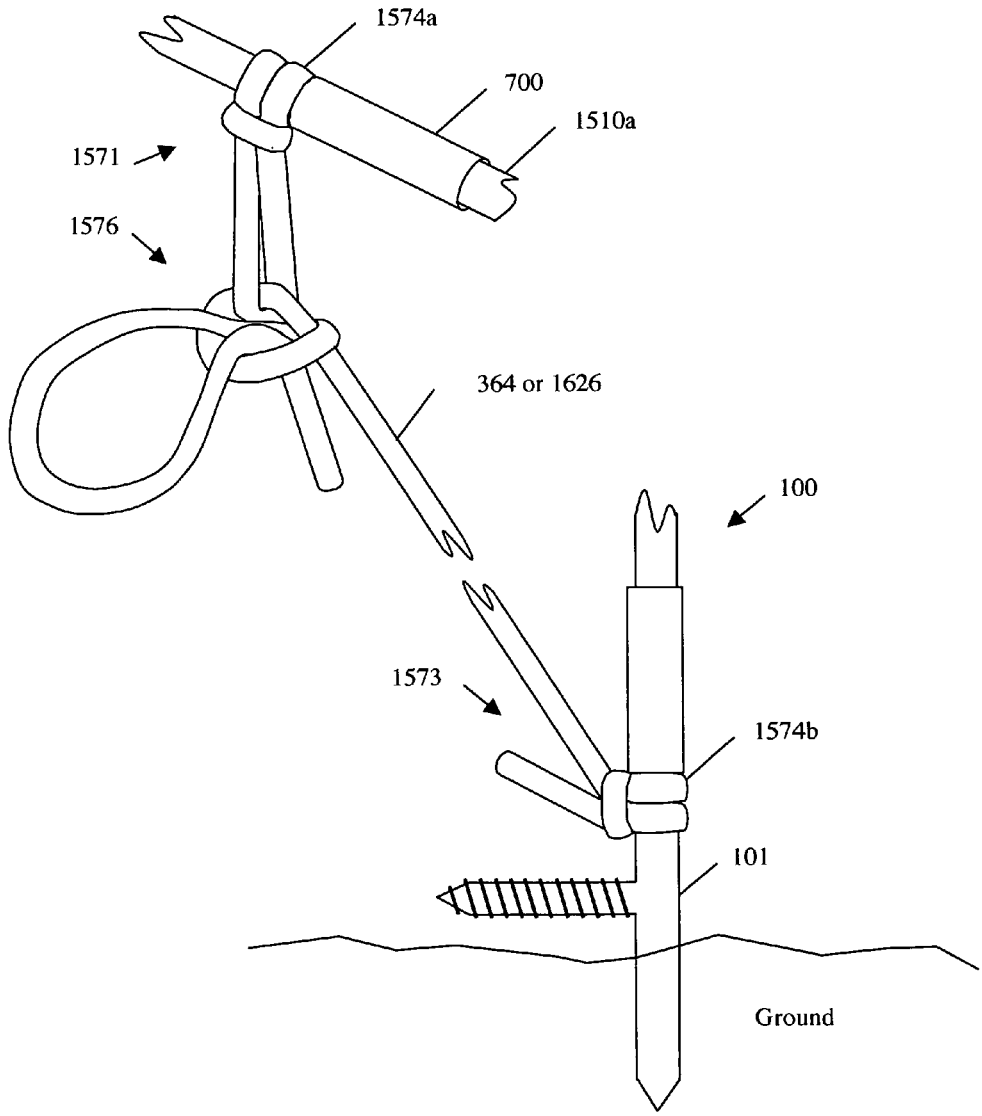

FIG. 11A through FIG. 11C

Figure 12D:
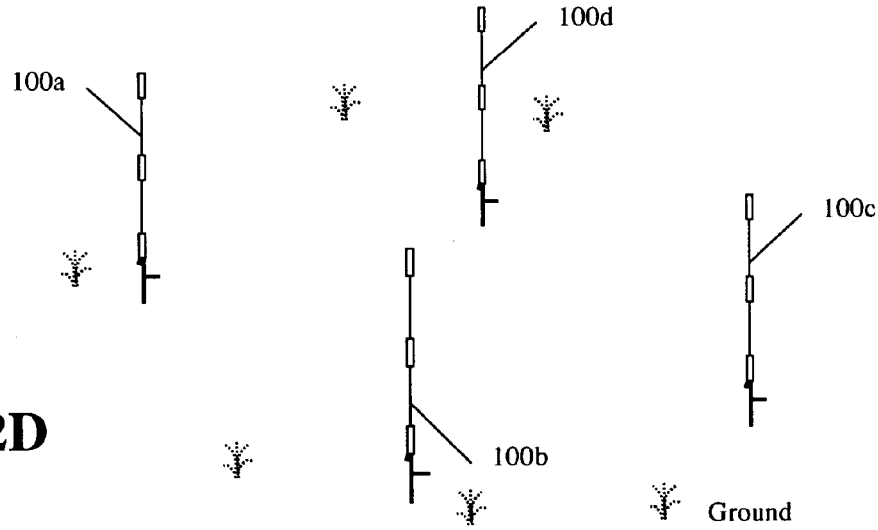

FIG. 11A shows each of the components that comprises one embodiment of a blind or shelter structure. This embodiment would be constructed as follows. The supports 100 would be inserted into the ground (as shown in FIG. 12D). Each cover shaft 1500 would be attached to the supports to form the shelter frame 1530. The cover 1540 would be pulled down over the shelter frame 1530.

FIG. 11B shows the assembled shelter frame 1530 with a novel skin tightening feature. A plurality of bow cords 1626 is attached to the top cover shaft 1500a. Each of the two bow cords 1626 attach near each alternate support 101 at a bottom attachment 1573 and the opposite end of each bow cord 1626 is attached (at a higher point in the arch) at a top attachment 1571. The bow cords are tightened, for example by using a drawstring clip 362 to assert a force on each side of the shelter cover. When tightened, the top cover shaft 1500*a* asserts a force on bottom cover shaft 1500*b*, thus only two bow cords are needed to apply a balanced force on both cover shafts (1500*a* and 1500*b*) and to tighten the skin on all four sides of the cover 1540. This novel feature has the benefit of tightening the skin of the shelter on the sides of the cover to reduce movement and flutter. It does this with less weight and cost than conventional blinds.

The desired tightening works with this novel arrangement and technique because the alternate supports 101 hold the lower end of each cover shaft (1500 or 1510) securely in the corner of the cover 1540 and the bow cord 1626 bends a portion of the cover shaft cause the outward force on each corner.

FIG. 11C shows an alternate cover shaft 1510 comprising a plurality of alternate shaft segments 1099 connected with inserting-to-inserting connectors 1760. FIG. 11C shows four shaft segments 1099 with five connectors 1760, resulting in an alternate cover shaft 1510 with inserting ends 1070 at each end. The inserting-to-inserting connectors 1760 are easily added or removed by the user to attach to the various other components of the modular system of the present invention.

Figure 11E:
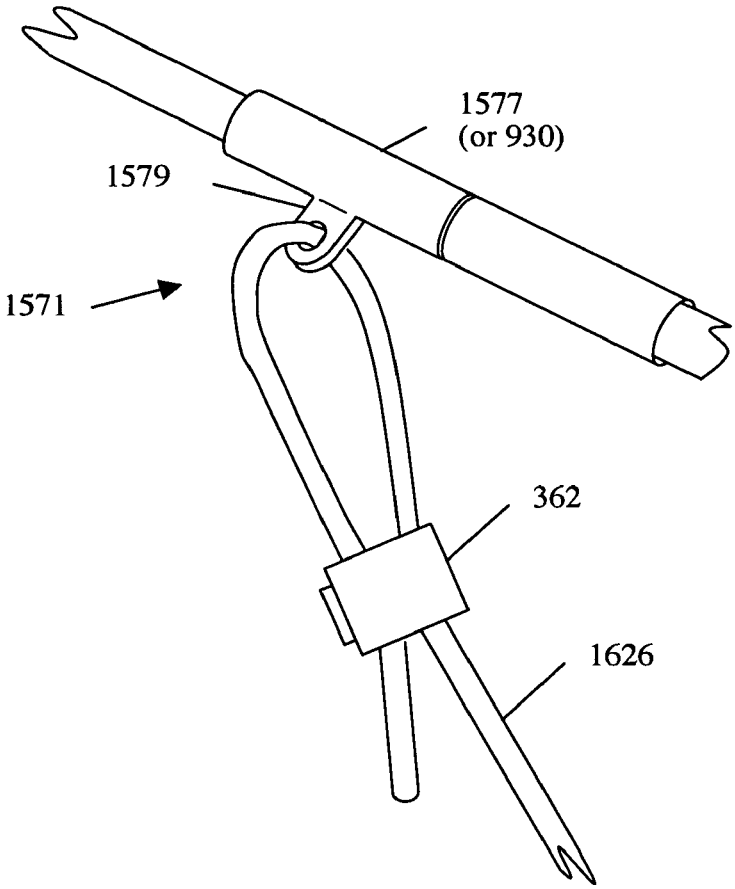
Figure 11F:
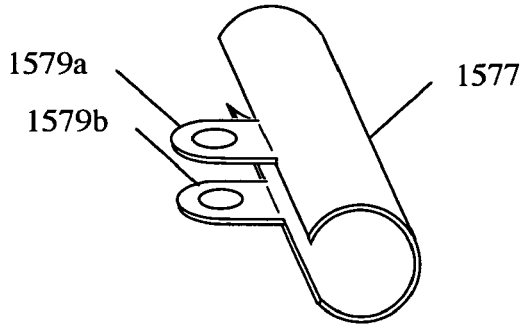

FIG. 11D through FIG. 11F

FIG. 11D through FIG. 11F show various details of the bow cord 1626 embodiments and their operation.

FIG. 11D shows the details of the top attachment 1571 and the bottom attachment 1573. The top attachment 1571 in this embodiment is made with a low-cost loop of cord passed around the shaft (e.g. 1510*a*) and through itself to form a knot that will catch against a connector (such as 700 as shown). The knot forms the upper bow cord attachment 1574*a*. The lower bow cord attachment 1574*b* is formed by tying the bow cord 1626 around the bottom of the support 100 (preferably below the lowest connector). In contrast to the embodiments shown in FIG. 11B and FIG. 11E which use a drawstring clip 362, in this embodiment a quick release knot is used to tighten and hold the bow cord 1626. Specifically, the other end of the bow cord 1626 is passed through the free loop of the upper bow cord attachment 1574*a*, pulling the bow tight as desired, and securing it with a quick release knot, such as a slip knot 1576, as shown).

Alternatively, FIG. 11E shows the use of an attaching clip 1577, instead of the loop of cord, to attach the bow string to the shaft (e.g. 1510). The attaching clip comprises a clip portion that clips over the shaft and at least one tab having a clip eye 1579. The bow cord 1626 passes through the clip eye 1579, and then back through the drawstring clip 362 (or alternatively back to a knot, such as slip knot 1576, or other means of holding a line taut as known in the art).

In yet another embodiment (not shown), a straight connector with an eye loop 930 could be placed in the shaft (for example, between 1520*a* and 1520*b*, and between 1520*c* and 1520*d*, respectively, in the segmented cover shaft 1500, as shown in FIG. 8B; or at the equivalent locations in the alternate cover shaft 1510, as shown if FIG. 11C).

FIG. 11F shows an embodiment of the attaching clip 1577 with two tabs each with a clip eye (1579*a* and 1579*b*). The present invention anticipates that the clip could have many forms that would be a means of fastening to the cover shaft (1500 or 1510) and to the bow cord 1626.

FIG. 12A through 12C

FIG. 12A through 12C show the operation of one embodiment of the shelter or blind of the present invention with the illustrative example of a pair of users who are hunting or observing wildlife. Our pair of users starts out early in the morning when the wind is calm. Each user separately uses a support 100 and an alternate curtain 307 to attach to a tree (as a tree blind as shown in FIG. 4A and FIG. 4B) while scouting out a location to place the bigger blind. After selecting the location the users quickly deploy a ground blind with the two supports (first support 100*a* and second support 100*b*) and a single alternate curtain 307*a*. From that initial cover, they deploy the second alternate curtain 307*b* using a third support 100*c*. This results in a ground blind like those shown in FIG. 10A, 10B, and the front of FIG. 12A. Using the drawstrings in the alternate curtains 307, they keep the curtains taut as the wind picks up throughout the morning.

In the afternoon, the users see storm clouds start to gather. Using the concealment of the two curtain blind, the users place the fourth support 100*d* as shown in the rear of FIG. 12A. Up to this point in the trip, the pair has used only the components found in the basic module 1605. Next, they construct the shelter frame 1530 by adding and attaching the cover shafts (1500 or 1510) to the already standing supports (100*a*, 100*b*, 100*c* and 100*d*) as shown in FIG. 12B. The structure of the frame 1530 adds evening more stability to the curtains against the increasing wind. Later, to achieve greater concealment or shelter from the sun or coming rain, the users quickly add the cover 1540 by throwing it over the already standing shelter frame 1530 and curtains 307*a* and 307*b*. The fully enclosed shelter or blind is shown in FIG. 13C. The cover 1540 of this embodiment further comprises cover windows 1612 and a cover door 1634. The door (as shown) is placed over one of the curtains (i.e. 307*a*). This is not a problem because the cover 1540 provides concealment while the user works inside to take down the now unneeded curtain 307. Alternatively, the users can place the door 1634 on one of the sides adjacent to the fourth support 101*d*.

The above illustrative example shows the flexibility of the modular system of the present invention. The same components are first used as two tree blinds, then used for a series of ground blinds with increasing concealment. It is not necessary to deploy the entire fully enclosed shelter to have initial concealment. A one or two curtain ground blind is used first.

The simpler shelter is easily moved until the right location is determined. Then, based on need for greater concealment or shelter from the elements, more complex modules are deployed.

FIG. 12D through 12H

FIG. 12D through 12H show the operation of another embodiment of the shelter or blind of the present invention with a second illustrative example of a pair of users who are hunting or observing wildlife. In this example, our pair of users wants to start out with a four-sided ground blind. Unlike pitching a conventional tent where quite a bit of time is spent forcing segmented shafts through exterior hems in the tent, and unlike conventional hunting blinds which are heavy, bulky, and difficult to deploy, this embodiment of the present invention is quickly deployed in steps that are less disruptive to the wildlife.

First, as shown in FIG. 12D the four supports (100*a*, 100*b*, 100*c*, and 100*d*) are inserted into the ground in a square (or diamond). In the currently preferred embodiment each adjacent support 100 is placed a little less than six feet apart, or the distance that the average person can comfortably reach with two laterally outstretched arms. Placement does not need to be exact because each support can easily be repositioned later.

Figure 12E:
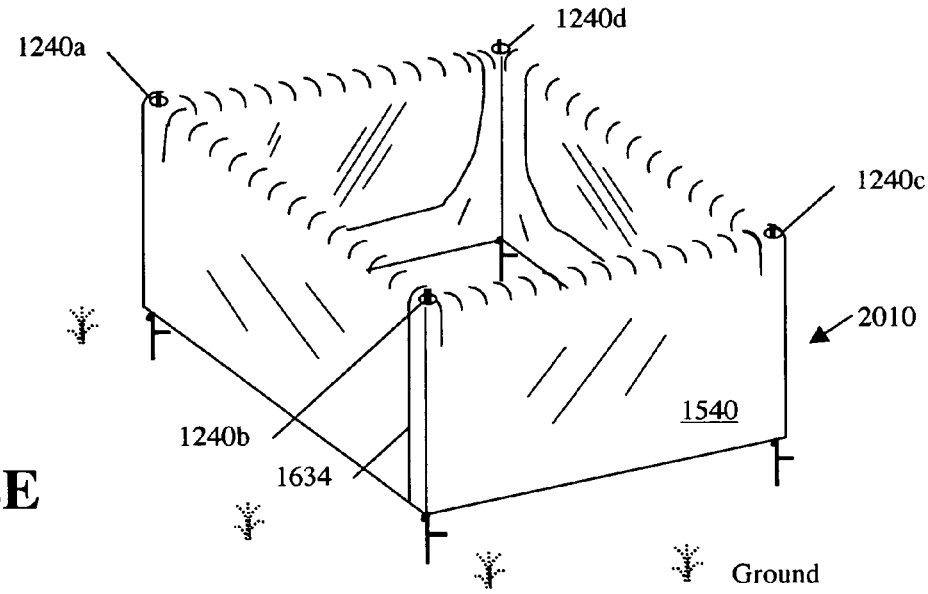

Second, as shown in FIG. 12E, a novel embodiment of the cover 1540 having a top that fully opens, is placed over the four supports 100*a-d*, forming a skirt 2010. The cover has four cover holes 1240 placed in the cover hem 1544 in each corner (see FIG. 16I). The inserting end of each support 100 passes through the cover hole 1240 and holds up the walls of the cover 1540 (see FIG. 6 for detail). For example, the tip 1402 of support 100*a* passes through cover hold 1240*a*, and so forth.

Figure 12F:
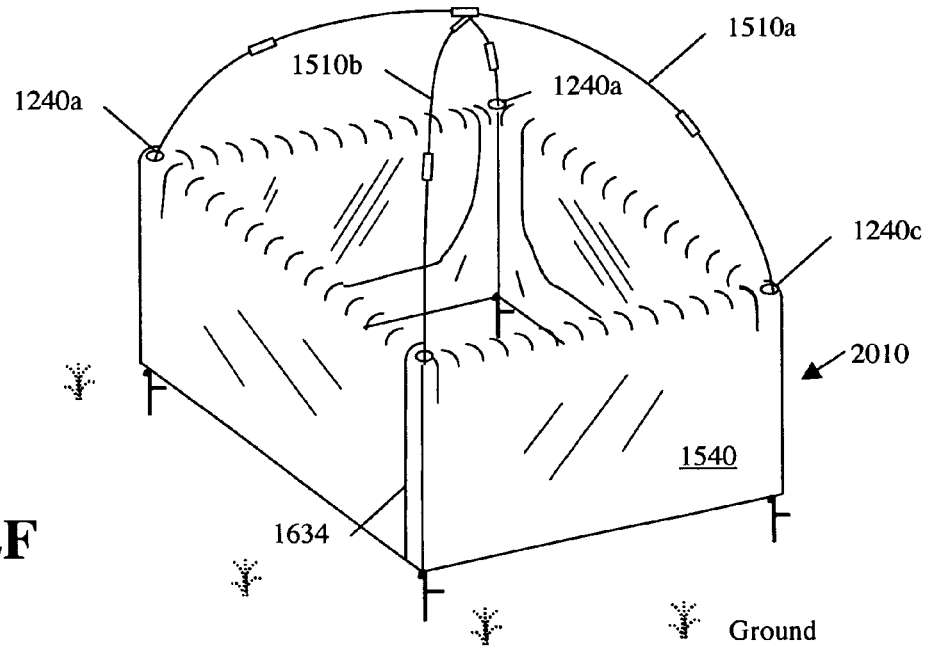

Third, using the initial concealment of the four-sided ground blind, the users attach the cover shafts (1500 or 1510) to supports in opposite corners. For example, as shown in FIG. 12F, the top cover shaft 1510*a* is connected to the first support 100*a* and the third support 100*c*, and the bottom cover shaft 1510*b* is connected to the second support 100*b* and the fourth support 10*d*.

Figure 12G:
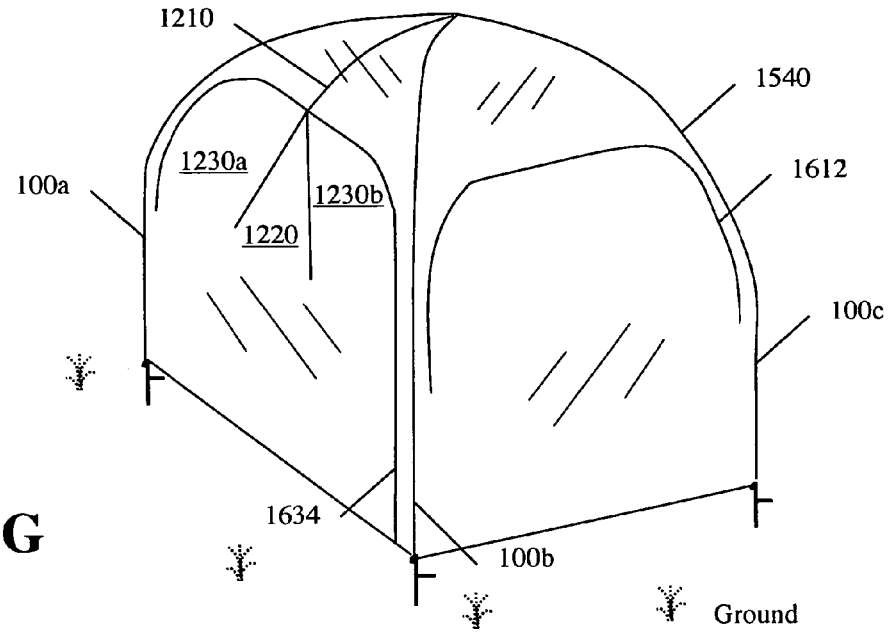

Fourth, when the users want to increase their concealment or shelter, the cover top is closed over the top of the cover shafts (e.g. 1510*a* and 1510*b*), as shown in FIG. 12G. As the top of the cover 1540 is raised, each end of the shaft (e.g. 1510*a* or 1510*b*) is temporarily disconnected, the tip 1420 of the support 100 is withdrawn through the cover hole 1240, and the end of the cover shaft is reconnected under the cover 1540.

Figure 12H:
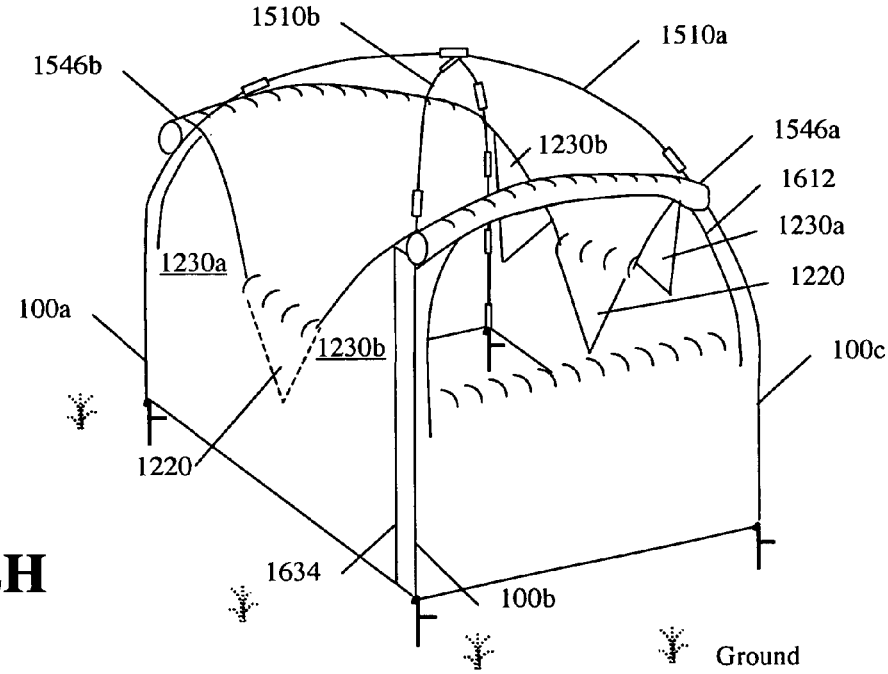

FIG. 12G also shows the novel star window layout (1590) in the window of the door 1632 and top of the cover 1540. As will be explained in more detail in relation to FIG. 15A through 15T. The top window fastener 1210, left window fastener 1212*a*, and right window fastener 1212*b* are unfastened (e.g. unzipped) to allow the top of the cover 1540 to be fully opened as shown in FIG. 12H. The star window layout (1590) comprises multiple sections between the fasteners, including a triangle section 1220, with a left section 1230*a* and a right section 1230*b* on either side.

Returning to the second example of our users, fifth, the users unzip the top window fastener 1210 on opposite sides of the cover and unzip at least partially the other fasteners in the star window layout (1590), resulting in the cover configuration shown in FIG. 12H. The triangle section 1220 is shown hanging down on both sides inside the shelter or blind. The left and right sections (1230*a* and 1230*b*) are partially hanging down, as shown in the inside through open cover window 1612. Each side of the top of the cover 1540 is rolled up on alternate sides, as cover rolls 1546*a* and 1546*b*. In this configuration the blind is used for hunting waterfowl, or for observing up a hill or ridgeline.

Figure 19A:
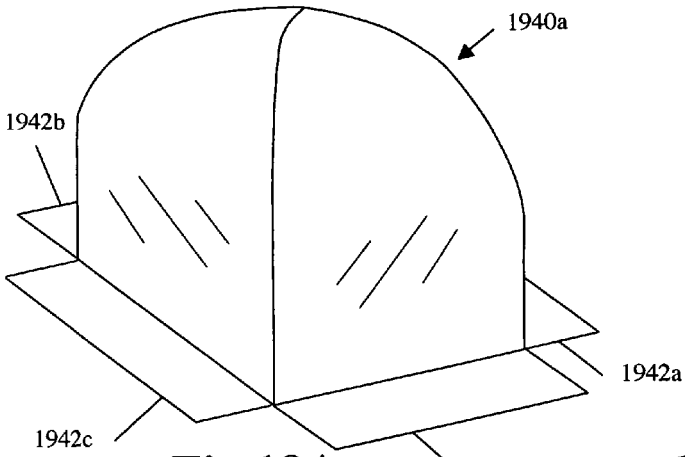
Figure 19B:
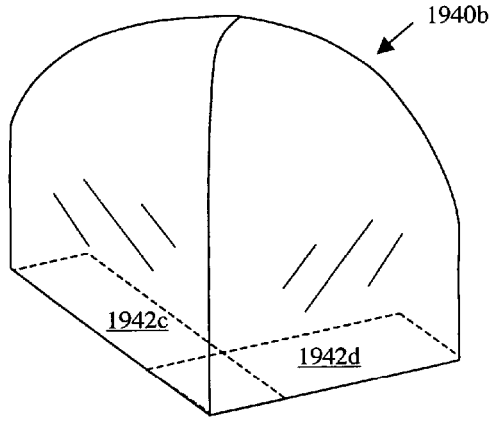
Figure 19C:
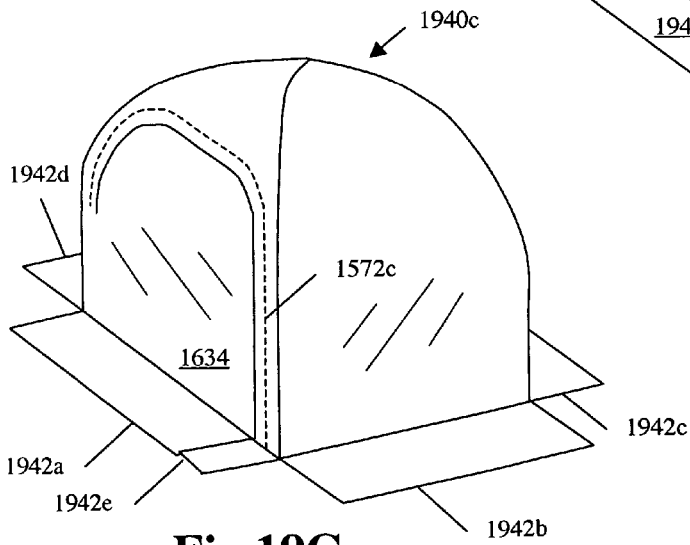
Figure 19D:
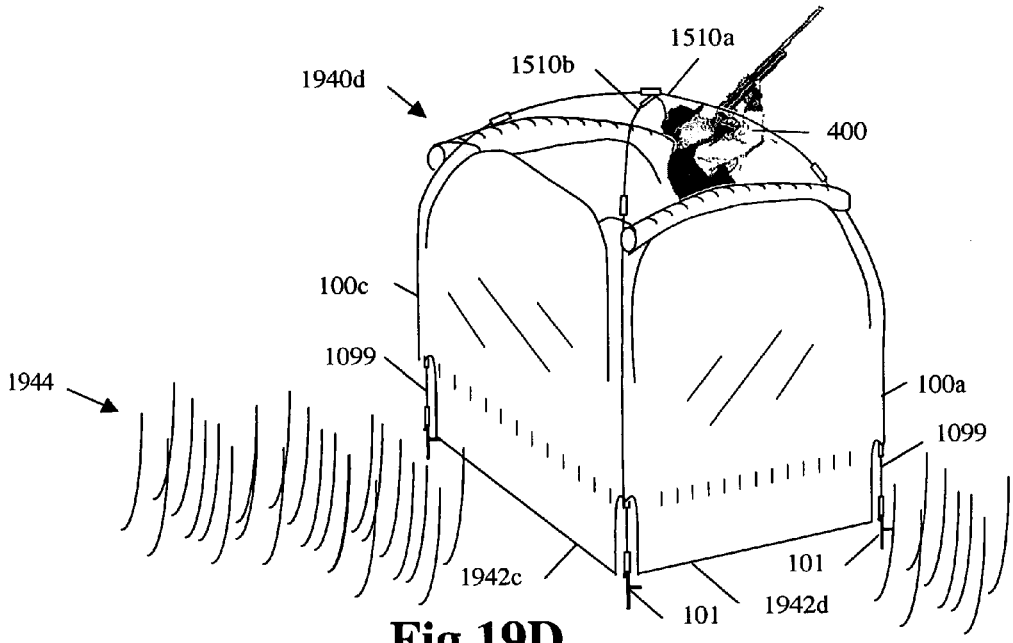

Alternatively, the users could open the top and keep the left and right sections (1230*a* and 1230*b*), the triangle section 1220, and the cover window 1612 closed (similar to the configuration shown in FIG. 19D).

This second illustrative example shows additional flexibility and benefits of the modular system of the present invention.

FIG. 12I through 12L

FIG. 12I through 12L show another embodiment of the shelter or blind of the present invention.

The structures shown in FIG. 12A through 12H were related to square dome type blinds and shelters. The present invention anticipates that same cover shafts (1500 or 1510) components will be used with other shapes of covers 1540.

Figure 12I:
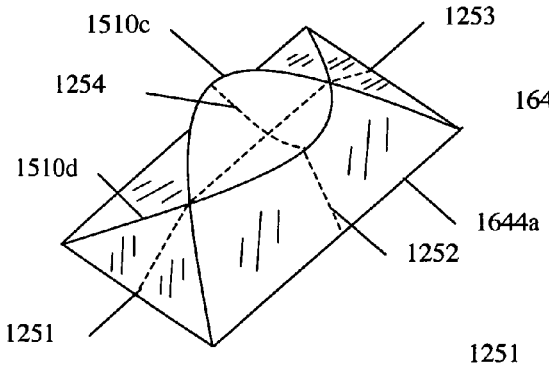
Figure 12J:
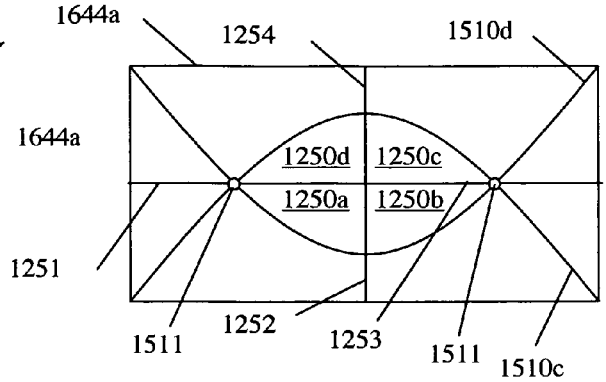

FIG. 12I and FIG. 12J show yet another embodiment of a shelter or blind having cover 1540 which is rectangular shaped at its base, namely a one-man alternate structure 1644*a*. The cover shafts are placed in the ground at an angle such that the arches lean on each other. The base forms a rectangle shape. The cover shaft intersections 1511 can be connected with ring, loop, knot, or clip, for increased stability. The top of the shelter frame (1530) formed in this way forms the shape of an "eye". This is advantageous for waterfowl hunting because the cover shafts do not cross overhead, but on the sides of the opening. In this embodiment the top of the cover 1540 has an opening made with four opening fasteners, namely, a first opening fastener 1251, a second opening fastener 1252, a third opening fastener 1253, and fourth opening fastener 1254.

In the currently preferred embodiment, each opening fastener (1251-1254) is implemented as a zipper that completely opens to allow the cover 1540 to separate into four separate parts, i.e. quarter sections 1250*a*, 1250*b*, 1250*c*, and 1250*d*. For example the first quarter section 1250*a* is connected between the first opening fastener 1251*a* and the second opening fastener 1252, and so forth. In other embodiments the opening fasteners are made with long strips of hook and loop fasteners, or other fasteners.

In the one-man alternate structure 1644*a*, four cover shaft segments (1520) make up the cover shaft 1510*c* and another four cover shaft segments make up cover shaft 1510*d*. The cover shafts 1510*c* and 1510*d* are connected directly to the alternate supports 101. Thus in the currently preferred embodiment, the cover shafts are about 124 inches long (or just over 10 feet long). This size of structure allows a single user to lie on the ground under the structure and look up through one of the cover openings. When, for example, a waterfowl flies overhead, the user can rise up through the openings and aim handheld equipment, such as a gun or camera, at the moving wildlife.

Figure 12K:
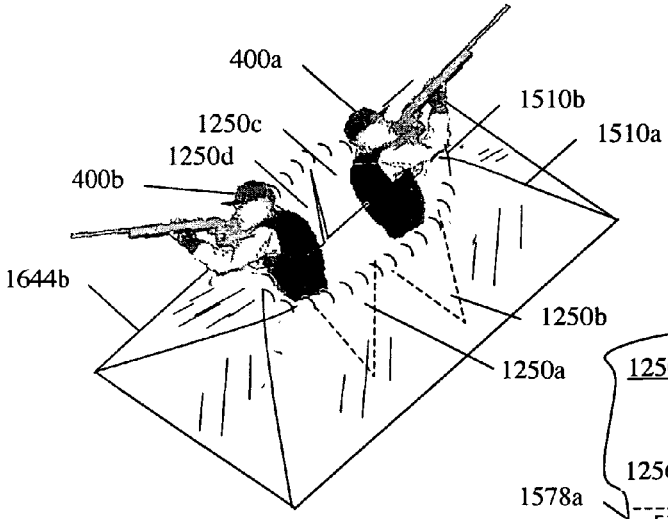
Figure 12L:
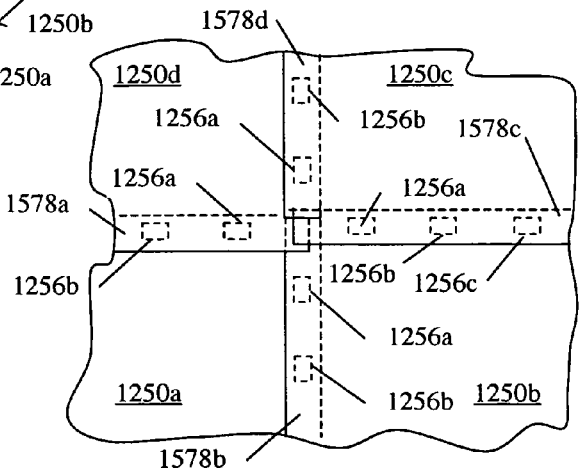

To facilitate quick opening, a preferred embodiment (the detail of which is shown in FIG. 12L) further comprises quarter section flaps 1578*a* through 1578*d* that cover the respective opening fasteners (1251 through 1254). The quarter section flaps 1578 keep out rain and snow and also provide a means of holding the quarter sections 1250 together with fastening points 1265 that can be quickly opened. In the currently preferred embodiment, the fastening points 1265 are made with short strips of hook and loop fasteners. In other embodiments, the fastening points 1265 are made with snaps, buttons, clips, and so forth.

Alternatively, the frame as shown in FIG. 12I through 12K can be used with a yet another embodiment of a cover 1540 which is simply a rectangular sheet of camouflaged material thrown over the frame. In this simpler embodiment, a slit 350 (as shown if FIG. 3B) can be made in the line segment between the cover shaft intersections 511 (see FIG. 12J) and the slit 350 temporarily held together with a one or more fastening points 1256.

FIG. 12K shows a similar embodiment of a two-man alternate structure 1644*b*. In this embodiment the cover shafts 1510*a* and 1510*b* are the full length of about 187 inches including the standard supports. This size of structure allows two users to lie on the ground under the structure and look up through one or more of the cover openings. When, for example, waterfowl flies overhead, the users (400*a* and 400*b*) can rise up through the openings and aim handheld equipment, such as a gun or camera, at the moving wildlife, as shown in FIG. 12K. A portion of each quarter section 1250 is shown hanging down inside the opening after the hunters, for example, have burst through the top. The cover for two-man alternate structure 1644b is larger than, but similar in design to, the cover for the one-man alternate structure 1644*a* (FIG. 12I). Both of these covers would be different than the covers shown in FIG. 12A through FIG. 12H.

These embodiments show the flexibility and economy of the modular system of the present invention. The same hard components can be used to construct a variety of blinds using a variety of different soft components, i.e. curtains 300 (e.g. 307) and covers 1540. Different camouflage patterns can be used to make the various curtains and covers. Examples of different camouflage patterns include woodland, grassland, marsh, desert, alpine, snow, etc.

FIG. 13

Figure 13:
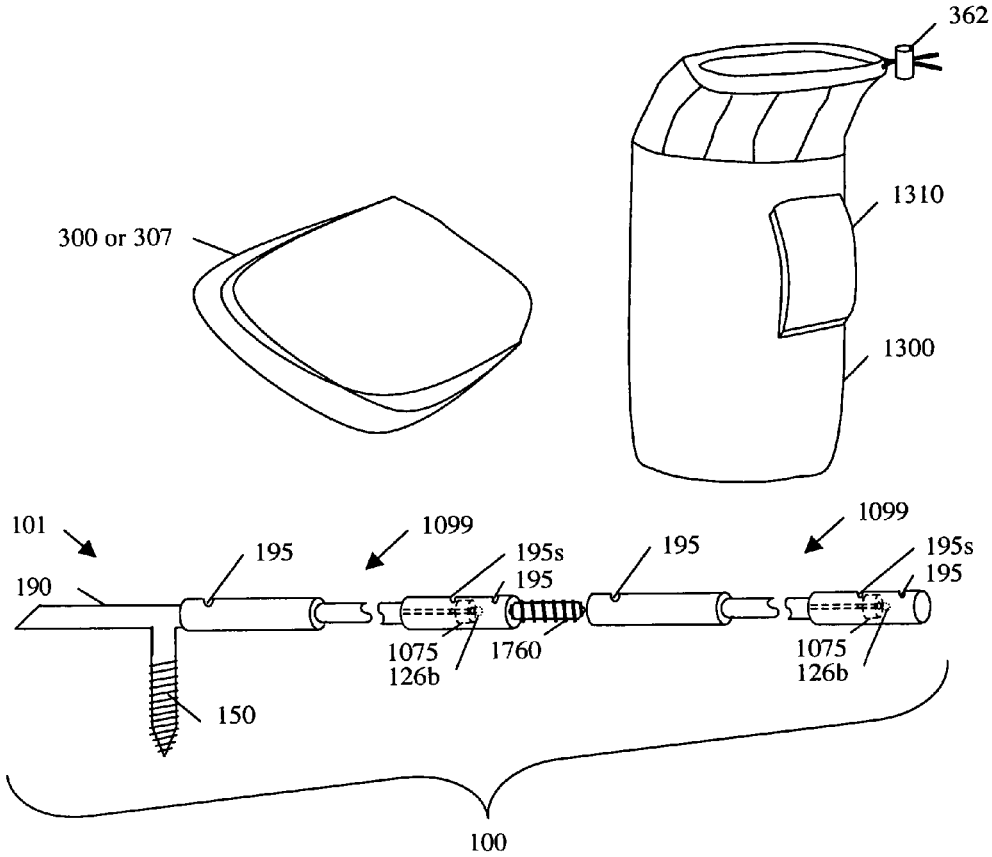

FIG. 13 shows a lightweight, portable embodiment of the present invention, known as the Pocket UnBlind™. FIG. 13 shows a folded curtain 300; an attaching pivoting support 100 (shown exploded with two half length, alternate shaft segments 1099 and an inserting-to-inserting connector 1760) comprised of the alternate support 101 (as shown, or alternatively, the threaded support 102—not shown) and the exploded segmented shaft 107; and a carrying case 1300. The case 1300, which can hold all of the other components, is shown with a belt loop 1310, which makes it easy to carry. The case is closed with the drawstring 364, which can be held closed with a knot or the drawstring clip 362.

FIG. 14A and FIG. 14C

FIG. 14A show a shaft intersection clip 1410. FIG. 14B shows the use of the intersection clip 1410 which has two clip members (1412*a* and 1412*b*), which removably attach to one shaft (e.g. top cover shaft 1510*a*), and two opposite facing, orthogonal members (1412*c* and 1412*d*), which removably attach the other shaft (e.g. bottom cover shaft 1510*b*).

FIG. 14C shows a 4-way receiving end connector 1420. In one embodiment the two alternate cover shafts 1510 can replace the center connectors of each respective cover shaft 1510*a* and 1510*b* with a single 4-way receiving end connector 1420.

The use of either the shaft intersection clip 1410 or the 4-way receiving end connector 1420 will increase the stability of the shelter frame 1530 and ensure that the force of the bow cords 1626 (FIG. 11B) are distributed evenly on both shafts (e.g. 1510*a* and 1510*b*). Further, either of these devices can be used to join the cover shaft intersections 1511 shown in FIG. 12J.

Alternatively, the shaft intersection clip 1410 or the 4-way receiving end connector 1420 could further comprise a downward hanging hook member (not shown) which could be used to hang equipment, such as a flashlight or a hunting bow from the highest part of the doom.

Modular System For Concealment and Shelter

The components described thus far provide the basic components for a blind or shelter system. These basic components can be sold as kits that can be combined with other basic kits or more advanced kits for become the building blocks for a variety of blind and shelter structures.

For example, an attaching pivoting support 100 (comprising a shaft and alternate support 101 as shown in FIG. 13, comprising 109 and 101 as shown in FIG. 1T, or comprising 109*b* and 101*c* as shown FIG. 1OO) and a curtain 300 (or 307) can be sold as a starter kit in a small case 1300. The starter kit can be used configure a tree blind as shown in FIGS. 4A and 4B. A basic blind kit can be comprised of two attaching pivoting supports 100 (e.g. 109 and 101*b*) and an alternate curtain 307. The basic blind kit can be used to configure tree blinds and ground blinds, for example, as shown in one side of FIG. 5A. With two basic blind kits, a two sided tree blind, a covered tree blind shown in FIG. 17A, and ground blind configuration shown in FIG. 5A or 5B can be constructed. By adding more basic kits, more complex structures can be constructed; for example, with five curtains 307 and five supports 100 (such as shown in FIG. 1T or FIG. 1X) a pentagon ground blind (not shown) can be constructed.

Advanced kits can be combined with basic kits to provide even more flexibility in constructing various blinds and shelters. One advantage of this modular system is that the operator 400 does not have to wait till he can afford the entire system. A starter kit or basic kit can be purchased first and then enhanced later without losing the initial investment. Another advantage is that a group of operators 400 can meet in the field and combine their individual basic components to form a more complex structure that meets their combined needs.

FIG. 15A through FIG. 15D—Star Windows

FIG. 15A through FIG. 15T show details and features of the novel star windows 1591 of the present invention.

FIG. 15A shows the star window layout 1590 in relation the cover 1540 of a dome type structure, as indicated by the dashed line show the cover panel 1542. As shown in FIG. 15A, five window fasteners comprise a star-like layout with each window fastener being one of the five parts of the star. A top window fastener 1210 extends upward from the center. A left window fastener 1212*a* extends laterally to the left from the center. A right window fastener 1212*b* extends laterally to the right from the center. A bottom left window fastener 1214 and a bottom right window fastener 1216 extend downward at opposite angles from the center forming a triangle section 1220 in the opening. The left and right window fasteners (1212*a* and 1212*b*) preferably curve downward when they reach the edge of the panel 1542, forming the shape of a frown or gull wings on a "flying star".

As shown in FIG. 15A, the five window fasteners (1210, 1212*a*, 1212*b*, 1214, 1216 divide the upper portion of the cover panel 1542 into five window sections (1218*a*, 1218*b*, 1220, 1230*a*, and 1230*b*). A top left section 1218*a* is bounded on two sides by the top window fastener 1210 and the left window fastener 1212*a*. A top right section 1218*b* is bounded on two sides by the top window fastener 1210 and the right window fastener 1212*b*. A left section 1230*a* is bounded on two sides by the left window fastener 1212*a* and the bottom left window fastener 1214. A right section 1230*b* is bounded on two sides by the right window fastener 1212*b* and the bottom right window fastener 1216. As explained above the triangle section 1220 is bounded on two sides by bottom left window fastener 1214 and the bottom right window fastener 1216. By unfastening two adjacent window fasteners any of the sections can be independently opened.

Similar to the overhead window 1632 (as described in the parent application), the triangle section 1220 is attached on two sides by a zipper, 1214 and 1216, respectively, which end where the two zippers come together.

Each section is removably fastened with a window fastener such as a zipper (as shown), strips of hook and loop fasteners, or other fasteners. In the currently preferred embodiment a single zipper is used for each window fastener (1210, 1212*a*, 1212*b*, 1214, 1216). For the lower window fasteners (1212*a*, 1212*b*, 1214, and 1216) the zipper end 1666 is located at the center of the star where they meets, and zipper start 1664 is located on the far end of each "ray" of the star. The top window fastener 1210 optionally is positioned such that the zipper start 1664 is placed at the center of the star. However, in the currently preferred embodiment, the top window fastener 1210 is handled specially (see discussion below regarding FIG. 15T).

In the currently preferred embodiment at least one cover panel 1542 has star window with door 1591. Either the left window fastener 1212*a* or the right window fastener 1212*b* (as shown) is extended with door fastener 1212*c* so that the door 1634 can be fully opened. For example, if the window fasteners are implemented as zippers, the zipper start 1664 is a separable zipper start 1664 and the zipper end 1666 is located at the center of the star. The separable zipper start at the bottom of the cover panel 1542 can be disconnected allowing the door 1634 to be opened at the base (as shown in FIG. 16E) which would allow a user in a wheel chair, for example, to enter and exit the shelter. In embodiments with doors the door fastener 1212*c* could be a separate fastener or a continuation (extended longer part) of the right or left window fastener (1212*a* or 1212*b*). For example, as shown in FIG. 16E, a single zipper forms the right window fastener 1212*b* and the door fastener 1212*c*. In an alternative implementation where each fastener is a separate zipper, both zippers (1212*c* and 1212*b*) would need to be of the type that can be fully separated at the bottom. Of course in an embodiment where the fasteners are implemented as strips of hook and loop fasteners the number and length of the strips that comprise the widow fastener can vary.

In the currently preferred embodiment of the cover 1540 as shown the top view in FIG. 15T, one cover panel has a star window with door 1591.

While FIG. 15A shows the layout of the window fasteners relative to the dashed outline of a cover panel 1542, FIG. 15B shows the external view of the window fasteners shown in FIG. 15A. In the currently preferred embodiment of the cover 1540, each window fastener (1210, 1212*a*, 1212*b*, 1214, 1216, and 1212*c*, if applicable) is covered with a flap that a) covers the visible line of the window fastener, b) provides continuous camouflage, and c) deflects moisture such as rain or snow. FIG. 15B shows the rain flap configuration 1592. An optional top flap 1570 covers the optional top window fastener 1210. A first flap 1572*a* covers the left window fastener 1212*a*. A second flap 1547 covers the bottom left window fastener 1214. A third flap 1548 covers the bottom right window fastener 1216. A fourth flap 1572*b* covers the right window fastener 1212*b*. Either the first flap 1572*a* or the fourth flap 1572*b* is optionally extended to cover the optional door fastener 1212*c* with an optional door flap 1572*c*.

FIG. 15C shows a four-fastener star window 1594 comprising only the left window fastener 1212*a*, the bottom left window fastener 1214, the bottom right window fastener 1216, and the right window fastener 1212*b*. The optional top window fastener 1210 and the optional door fastener 1212*c* are omitted from this type of window. In the currently preferred embodiment of the cover 1540 as shown the top view in FIG. 15T, two opposite cover panels have four-fastener star windows 1594.

FIG. 15D shows a five-fastener star window 1596 comprising only top window fastener 1210, the left window fastener 1212*a*, the bottom left window fastener 1214, the bottom right window fastener 1216, and the right window fastener 1212*b*. The optional door fastener 1212*c* is omitted from this type of window. Unlike the currently preferred embodiment of the cover 1540 as shown the top view in FIG. 15T, in an alternate embodiment, the two opposite cover panels are five-fastener star windows 1594. In this case, the zipper start 1664 for the top window fastener 1210 is at the top of the panel 1542 and the zipper end 1666 is at the center of the star (consistent with the other four windows fasteners, i.e. 1212*a*, 1212*b*, 1214, and 1216). The extra zipper adds a small additional cost to manufacture and a small increment in functionality over a currently preferred embodiment.

FIG. 15E through FIG. 15P—Star Window Configurations

FIG. 15E through FIG. 15P show some of the ways in which the novel star window of the present invention may be configured by the user 400. These are only exemplary. The present invention anticipates that each of these configurations, their mirror image configurations, and other configuration enabled by the star window layout will be used.

FIG. 15E through 15M apply to both the four-fastener star window 1594 or the five-fastener star window 1596, so only the common sections are shown.

FIG. 15E shows a configuration where the left section 1230*a* and the right section 1230*b* are open (down) while the triangle section 1220 is closed, or held up (as shown in more detail in FIG. 15Q through FIG. 15R).

FIG. 15F shows a configuration where the left section 1230*a* is open (down) while the triangle section 1220 and the right section 1230*b* are closed (up).

FIG. 15G shows a configuration where the left section 1230*a* and the triangle section 1220 are open (down) while the right section 1230*b* is closed (up).

FIG. 15H shows a configuration where the triangle section 1220 is open (down) while the left section 1230*a* and the right section 1230*b* are closed (up).

FIG. 15I shows a saw tooth-like configuration where the triangle section 1220 is up and the left section 1230*a* and the right section 1230*b* are partially opened (and partially closed). This is accomplished by partially unfastening the left and right window fasteners (1212*a* and 1212*b*) from the center out to the start of the curved section near the edge of the cover panel 1542. The free portions of the left and right sections (1230*a* and 1230*b*, respectively) hang down due to gravity.

FIG. 15J shows a square-like configuration where the triangle section 1220 is open (down) and the left section 1230*a* and the right section 1230*b* are partially opened (and partially closed). This is accomplished by partially unfastening the left and right window fasteners (1212*a* and 1212*b*) from the center out to a point above the start of the bottom left window fastener 1214 and the bottom right window fastener 1216, respectively. The free portions of the left and right sections (1230*a* and 1230*b*, respectively) hang down due to gravity. Alternatively, by adjusting the amount of opening in the left and right window fasteners (1212*a* and 1212*b*), trapezoid-shaped and parallelogram-shaped openings are made.

FIG. 15K shows a narrow horizontal slit configuration where the triangle section 1220, the left section 1230*a* and the right section 1230*b* are mostly closed and bottom left window fastener 1214 and the bottom right window fastener 1216 are still full fastened, but the left and right window fasteners (1212*a* and 1212*b*) are partially unfastened from the center out to a point along the edge in the downward curved portion. The connected free portion of the triangle section 1220 and left and right sections (1230*a* and 1230*b*, respectively) hangs down due to gravity. By raising or lowering the left and right window fasteners (1212*a* and 1212*b*) in unison, a user may vary the height of the horizontal slit. Alternatively, by unequally adjusting of the left and right window fasteners (1212*a* and 1212*b*) from the configuration shown, wedge-shaped openings may be made.

FIG. 15L shows an hour glass-like configuration. This is accomplished by forming the square as shown in FIG. 15J, and then pulling the near edges of the left and right sections (1230*a* and 1230*b*) with a tie attached to each edge and tying a knot (as shown by connected ties 1598).

FIG. 15L shows a configuration where the left section 1230*a* and the triangle section 1220 is open (down) and the right section 1230*b* are partially opened (and partially closed). This is accomplished by partially unfastening the right window fasteners 1212*b* from the center out to a point above the start of the bottom right window fastener 1216. The free portion of the right section 1230*b* hangs down due to gravity.

FIG. 15N through 15P show configurations of the five-fastener star window 1596 which includes the top window fastener 1210.

FIG. 15N shows a configuration where all five sections (1218*a*, 1218*b*, 1220, 1230*a*, and 1230*b*) are closed but the top window fastener 1210 is unfastened to form a vertical slit, which may be used similar to slit 350.

FIG. 15O shows a configuration where the top left section 1218*a* is opened (and held up). This is accomplished by unfastening the top window fastener 1210 and by partially unfastening the left window fasteners 1212*a* from the center out to edge of the panel 1542. The free portion of the top left section 1218*a* preferably is tucked back and held between the nearest cover shaft (1500 or 1510) and the cover 1540.

FIG. 15P shows a configuration where the top left section 1218*a* and the left section 1230*a* is opened (and held up). This is accomplished by fully unfastening the top window fastener 1210, the bottom left window fastener 1214, and the left window fasteners 1212*a*. The free portion of the top left section 1218*a* preferably is tucked back and held between the nearest cover shaft (1500 or 1510) and the cover 1540. The left section 1230*a* hangs down due to gravity. This creates a large opening on one side of the panel while maintaining concealment on the other side.

It is anticipated that the user will configure the novel star windows in even more configuration based on the needs of a particular situation.

FIG. 15Q through FIG. 15R—Nonadjacent Section Attachment

FIG. 15Q shows the inside a five-fastener star window 1596. Similar to the configuration in FIG. 15E, the left section 1230*a* and the right section 1230*b* are shown hanging down. The triangle section 1220 held up by a window section loop 1580.

FIG. 15R shows the window section loop 1580 in more detail. The triangle section 1220 held up by attaching the window section loop 1580 to a window section attachment 1582, such as a hook or a tie. In a four-fastener star window 1594, only one window section attachment 1582 is needed. In a five-fastener star window 1596 (as shown), although one window section attachment 1582 is needed, having a window section attachment 1582 on each top section (1218*a* and 1218*b*) allows either top section (1218*a* or 1218*b*) to be opened.

FIG. 15S shows the window section loop 1580 being attached to an alternate embodiment of the window section attachment 1582, a loop clasp 1582*b*.

While any two adjacent sections can be attached by the window fastener between them, any two non-adjacent sections can be attached with a window section loop 1580 and a window section attachment 1582, or other means of attachment such as a snap, clip, or piece of hook and loop fasters.

FIG. 15T—Interconnected Star Windows

FIG. 15T shows the top view of the currently preferred cover 1540. As explained above, at least one of the four cover panels 1542 has a star window with door 1591, as shown as five-fastener star window 1596 with a door fastener 1212*c* extension. Also as explained above, preferably two opposite panels of the four cover panels 1542 have a four-fastener star window 1594. The cover panel 1542 opposite the start window with door 1591 is a five-fastener star window 1596.

A novel feature of the currently preferred cover 1540 is that the top cover window attachments 1210 of the star window with door 1591 and of the five-fastener star window 1596 are interconnected, namely are formed from a single pair of zipper teeth tracks. The special zipper has two zipper pulls, each starting in the center of the opposite stars (1591 and 1596, respectively). Each zipper pull is of the type that it is permanently attached on one zipper track with a box and is removably attached using a pin at the end of the teeth of the other track. Thus, the two tracks of the special zipper can be totally separated by unzipping to the respective ends of the tracks and removing the respective pins from the boxes on each end. This allows the configurations shown in FIG. 12E, FIG. 12F, FIG. 12H and FIG. 19D. With one pull attached the special zipper can be opened to any point from end to end. This allows the configurations shown in FIG. 15N through FIG. 15P, and FIG. 16G, for example.

An alternate embodiment of the cover 1540 comprises one star window with door 1591 and three five-fastener star windows 1596. In this alternate embodiment (not shown), only the star window with door 1591 and one of the five-fastener star windows 1596 are interconnected as described above. The other two five-fastener star windows 1596 have top window fasteners 1210 that start at the top of the cover panel 1540 and end at the center of each respective star.

In yet another alternative embodiment, the cover 1540 has two star windows with doors 1591.

Although all of the examples show a cover 1540 with four panels, the present invention anticipates that shelters or blinds with three, five, or more panels, could be constructed with the components of the module system. For example, in an anticipated alternative embodiment, the cover 1540 has three cover panels (e.g. one star window with door 1591 and two four-fastener star windows 1594) and the shelter frame has three shafts that connect at the apex with a 3-way connector (not shown).

FIG. 16A through FIG. 16G

FIG. 16A shows one side of the covered blind or shelter 1600 constructed with the modular components of the present invention. The operator 400 is shown behind a curtain 307*a*, which forms a wall of the structure. The wall is stretched between two adjacent supports 100 that have been inserted into the ground using alternate supports 101. The shelter frame is further comprised of two cover shafts 1500 that cross at the peak of the structure. The cover 1540 provides a shadow that further conceals the operator, and provides protection from the sun and weather. In this embodiment the cover 1540 is rolled up, as a cover roll 1546, on at least one side (the side shown) leaving an opening 1602. A novel feature of this structure is that the opening is unobstructed along the entire length of the side. Further, the height of the opening 1602 can be adjusted or removed entirely by rolling up or down (or otherwise raising or lowering the side of the cover 1540).

FIG. 16B shows another embodiment of the covered blind or shelter 1600 with four walls formed by curtains 307*a* through 307*d*. In this embodiment, the cover 1540 has cover windows 1612 in each cover panel 1542. Each cover window 1612 may be closed by with a window fastener 1610 such as a zipper or a strip of hook and loop fastener material.

FIG. 16C shows an alternate cover 1630 having additional novel features of the present invention. One or more overhead windows 1632 can be placed near the top of each cover panel 1542. A cover window 1612 on at least one side can be extended to form a door 1634 by extending the window fastener to the bottom of the cover as a door fastener. A lower window 1638 can also be formed below the center window.

FIG. 16D shows a number of novel features of the modular system of the present invention. Because the shelter frame is constructed with removable, interchangeable segments and because the frame is anchored to the ground, the blind or shelter structure can be positioned on the side of a steep hill or rough, uneven terrain or over obstacles such as boulders or tree trunks. This provides a number of advantages not available with conventional blinds or tents that are limited to being placed on flat, open spaces. If placed on even a slight grade conventional tents will be distorted and their skins will droop and flutter. The structures of the present invention can be located on steep terrain or among large obstacles that will enhance its concealment features and take it out of normal wildlife paths.

As shown in FIG. 16D the cover shafts 1500 can be connected directly to the alternate support 101 on the high side of the steep slope and the extra segments can be moved to the low side of the steep slope in an extended configuration 1640. The cover 1540 can be adjusted to meet the ground on all sides.

The embodiment of FIG. 16D also includes a shoot-through panel 1642 positioned within a closed cover window 1612. A shoot-through panel 1642 is a lightweight see-through material that reflects enough light to maintain the camouflaged effect but that can be see through so that an projectile, such as a bullet or arrow, can pass through. Shoot-through panels have some disadvantage in that they are damaged by each shot and affect the flight of the projectile that limits the range and accuracy of the shot.

FIG. 16E shows an alternate extended configuration 1643 anchored on a steep hillside. The excess cover material is rolled up in cover roll 1546*c*. The cover 1540 has star windows (as explained above in regard to FIG. 15A through 15T). The door 1634 is shown opened on one side. In this configuration wildlife is likely to be seen down the slope. In the currently preferred embodiment, the cover 1540 is made of a lightweight, rip stop nylon, camouflaged material. The ability to place the modular system on a steep hill and shoot down the slope through a window or door opening provides a benefit not available with conventional blinds or tents.

FIG. 16F shows a side view of the alternate extended configuration 1643 of FIG. 16E anchored on a steep hillside. The uphill supports 100 are removed. The uphill end of each cover shaft (1500 or 1510) passes through the novel cover hole 1240 where it is re-attached to the alternate support 101. The cover bottom arc 1695 shows the path of the lower corner of the cover 1540 when it is raised. Without the cover hole 1240, when the cover 1540 is rolled up, forming cover roll 1546*c*, the cover material would pull the cover shaft (1500 or 1510) and distort the shape of the tent, resulting in loose material that would flutter in the wind and scare off wildlife. The cover hole 1240 provides the benefits of a) maintaining the shape of the shelter frame 1530, b) allowing the shortened end of the cover shaft (1500 or 1510) to be anchored firmly to the ground, and c) allowing the novel skin tightening feature to work even when mounted on the side of a steep hill.

In the currently preferred embodiment, the cover hole 1240 is placed in each cover seam 1544 about 31 inches above the bottom edge of the cover (see FIG. 16I). The cover hole 1240 optionally is covered externally with a small flap of material (not shown) to prevent water from coming inside the cover in heavy rain.

Note that on a hill that is even steeper than the one shown, the extra half length shafts (e.g. 1099) from each removed support 100 are added as needed to the downhill side of the structure. One or more such half-length shafts are added to match the terrain. For example, one corner could have only the alternate support 101, the second corner could have one half-length shaft, the second corner could have a full-length shaft and a third corner could have three half-length shafts. The novel ability to dynamically configure the structure provides the benefit of having a generally level structure that maintains the forces necessary to keep the skin on the structure taut in the wind even when located in rough or steep terrain. The alternate curtains 307 may be used to cover the opening below the cover 1540. Alternatively, in an embodiment of the cover having scent flaps (see FIG. 19D) the downhill flaps extend to cover the new opening.

FIG. 16G shows another configuration where the cover 1540 is only long enough to cover the cover shafts (1500 or 1510) (not the threaded segmented shafts 109 of supports 100), forming a cover cap 1631. The cover cap 1631 can be mounted directly to the ground using alternate supports 101. For situations where it is desired to stay low to the ground and shoot towards the sky, the operator can lie inside the cover cap 1631 and raise up through the overhead opening of the top window fastener 1210 when desired. The cover cap 1631 can also be used in a configuration like FIG. 16B except that the cover roll 1546 is eliminated. The cover cap 1631 can also be a component of configuration as will be shown later in reference to FIG. 16N.

Battens 1558 (not shown) optionally are used to stiffen the windows (1612 or 1632) to further reduce flutter in any of these embodiments.

FIG. 16H through FIG. 16K

FIG. 16H through FIG. 16K show optional details of the cover 1540.

FIG. 16H shows two corner loops (1622*a* and 1622*b*) attached at intervals in to the cover seam 1240. The cover loops are placed in each corner of the cover 1540.

In a currently preferred embodiment the corner loops 1622 are made from about 10 inches of cord attached to the cover seam 1544 leaving a loop that can extend about 4 inches to pass over the free leg (e.g. first leg 150). A low cost means of attachment would be sewing the cord to or in the cover seam 1544. The cord is preferably similar to draw string 364 or bow cord 1626, but an elastic cord 126 may also be used.

FIG. 16I shows the placement of cover loops (1622*a* through 1622*c*) at points that correspond to the bottom end of the support 100 where a corner loop 1622*a* is placed over a free leg (e.g. first leg 150) of alternate support 101 to hold the cover securely against the shelter frame 1530. When on a moderate hillside, the lower alternate shaft segment 1099*a* (shown as a half-length shaft) is removed, the alternate support 101 is attached half way up, and the middle corner loop 1622*b* is placed over the free leg of the alternate support 101 to hold the cover securely against the shelter frame. When on a steep hillside (as shown in FIG. 16E and FIG. 16F), both alternate shaft segment 1099*a* and 1099*b* are removed, the alternate support 101 is attached directly to the cover shaft 1500, and the top corner loop 1622*c* is placed over the free leg of the alternate support 101 to hold the cover securely against the shelter frame. A cover hole 1240 is also placed in the cover seam 1544 so that the third leg 190 can exit the cover and enter the ground as explained in more detail in reference to FIG. 16F.

Although only one corner hole is shown here in FIG. 161, two corner holes 1240 could be placed at the top and the bottom of the support 100 as suggested by the corner grommets 1566*f* and 1566*g* in FIG. 20. Three or more corner holes 1240 could be placed in each corner near each corner loop. For some uses, a portion of the corner loop 1622 is passed out through the corner hole 1240 where, for example, it could be attached to a shaft or stake (such as a stake with hook 2252 as shown in FIG. 22G).

In a simpler embodiment, the corner loops 1622 are replaced with corner holes 1240 at the respective locations of corner loops 1622*a*, 1622*b*, and 1622*c*. In this simpler embodiment, for example, any of the legs of a support 100 (such as alternate support 101) passes through the desired cover hole 1622 with the same result of holding the cover 1540 taut. This eliminates the marginal cost, and associated convenience of the cover loop 1240.

FIG. 16J shows a cover bag 1668 being attached to the cover 1540. The cover bag 1668 is larger enough to hold the entire cover. The cover bag 1668 is attached to the cover 1540 with a cover bag attachment 1670. In a low cost embodiment the cover bag is sewn to the cover near the cover seam 1544 (as shown, or preferably sewn in the cover seam 1544 near the bottom of the cover 1540 to make it easier to stuff the cover 1540 into the cover bag 1668). Alternatively, the cover back could be removably attached, with a button, snap, or a strip of hook and loop fastening material.

As shown in FIG. 16J the cover bag 1668 further comprises a smaller compartment 1669 for holding loose components such as brackets and supports (e.g. 101, 101*b*, 101*c*, 1082, 184, 2236), connectors (e.g. 930, 1752, 1740, 1760, 1762,), stakes (e.g. 2231, 2232, 2238, 2240, or 2252), clips (e.g. 1577, 2242, 2246), attaching fasteners 230, bow cords 1626, or other small loose parts (such as 1782). Preferably the cover bag 1668 has means of closure such as cover bag closure 1667, which could be zipper, flap with hook and loop fasteners, of a loop of drawstring.

FIG. 16K illustrates the novel feature of the module systems of the present invention where the inserting end 1070 can pass through and hold material (such as cover 1540, tarp material 1568 (see parent), or skirt 2010, via cover holes 1240, corner grommets 1566, other reinforced holes 367 or grommets 368 and so forth). After passing through the material inserting end 1070 is secured to the receiving end 1072 to securely hold the material.

Figure 16L:
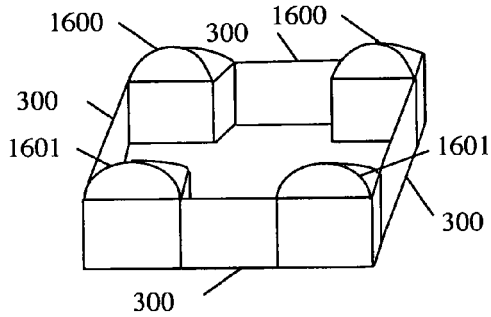
Figure 16M:
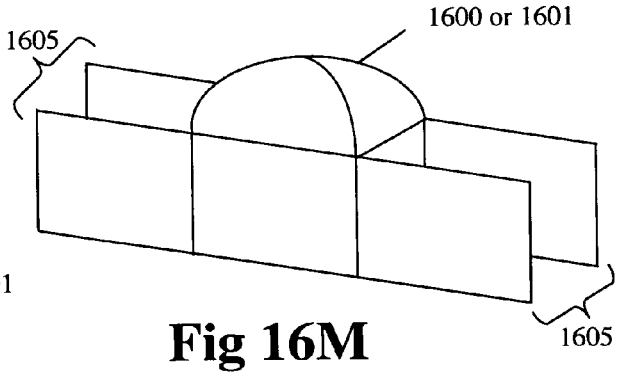
Figure 16N:
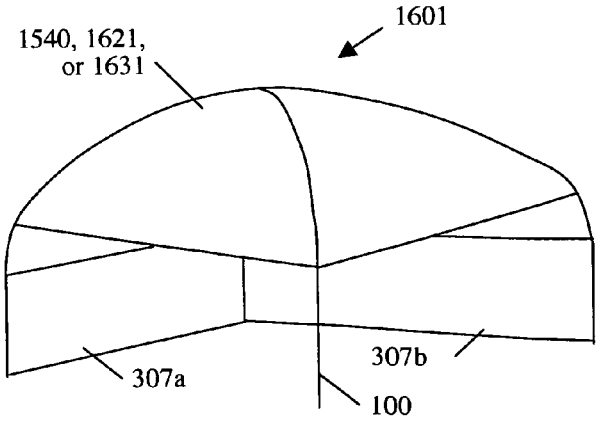

FIG. 16L through FIG. 16N Multiple units can be interconnected to form a more complex blind or shelter. FIG. 16L shows fort-like configuration comprising four advanced modules (1600 and 1601) such as those shown in 16B and 16N with four single curtains 300 connected between each of the corner modules. Note that the configuration shown could be constructed with eight basic modules 1605 (for a total of sixteen curtains 300 and sixteen supports 100) and four covers 1540 (or cover caps 1631 as shown in FIG. 16G or pyramid caps 1621, as shown in the parent application). FIG. 16M shows one advanced module (1600 or 1601) such as the one shown in FIG. 16B (or 16N with the two walls in parallel rather than a V-shape) with parallel extensions on two sides. The parallel extensions would require two basic modules 1605. Users may want to mount a modular blind on a vessel, as shown in the parent application, or vehicle such as a truck or ATV (not shown). Any receiving end of a shaft (e.g. 109, 1099, 1690) is securely attached to a vessel or vehicle by passing a standard bolt 1088 through a bolt hole in the body or frame of the vessel or vehicle. Washers optionally are used to protect the area around the hole.

These various configurations illustrate the advantages that the modular system of the present invention has over convention blinds or tents. A group of operators can combine their individual modules to better accommodate the needs of a group. For example, a backpacking group could have each member carry one component of the system compared to having one member carry one heavy multi-person tent. Further, in recent years there has been growing popularity for television programs showing outdoor experts using various equipment and techniques among wildlife. In order to produce such shows, a blind is needed that can house a large group including the outdoor expert, the producer, the sound guy, and the cameraman. The modular system of the present invention meets the varied needs of such a production.

FIG. 16N shows a 2-walled covered blind or shelter 1601 where only the two walls of a covered blind need to be present. In the configuration shown only the rear two walls are present. The cover 1540, pyramid cap 1621 (not shown), or cover cap 1631 provides additional concealment due to the shadow of the cover and the elimination of silhouettes on a slope. In this configuration, the operators can apply the "hide in front of" principle of the present invention to move freely in front of the rear, camouflaged walls. In this configuration the operator has an unobstructed 180 degree view and shooting area. No dark areas are created by windows or doors.

Figure 16O:
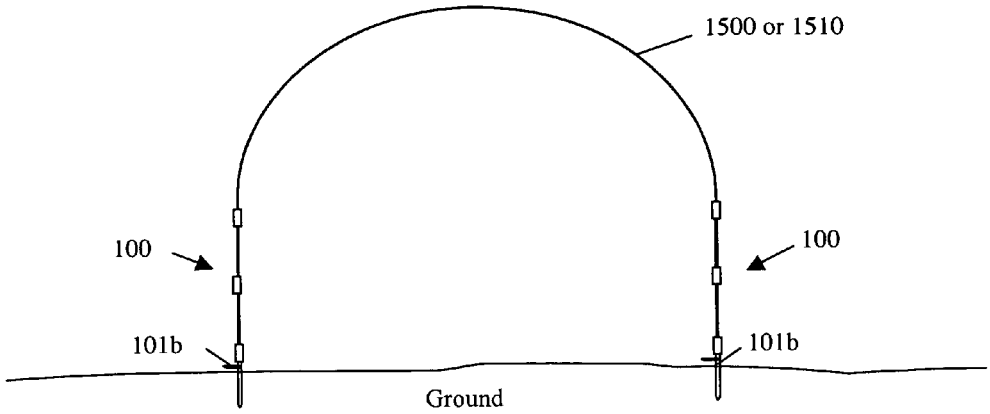

FIG. 16O and FIG. 1P

Figure 16P:
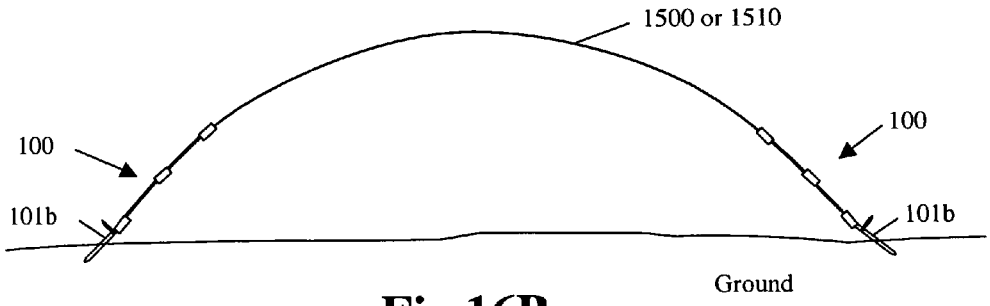
Figure 16Q:
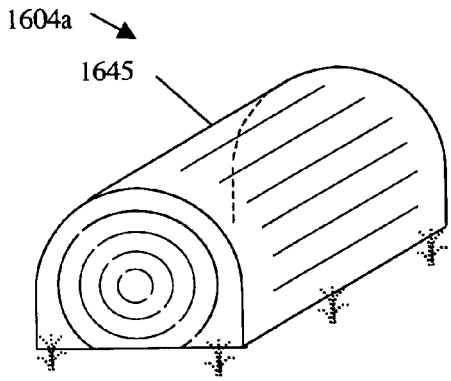

FIG. 16O shows some of the detail of how the modular components can be used to form each arch, for example, of a cylindrical arched roof unit 1604*a* (FIG. 16Q). Each support 100 is attached to an end of a cover shaft 1500 or 1510 (segment details not shown) and then inserted in the ground such that it forms an arch. Multiple arches are placed in line to form the frame for the cylindrical unit or units 1604. The rectangular piece of material, such as tarp 1560 is placed over the top as a roof and curtains 300 (or a skirt 2010) can be attached to form walls. The arches comprised of cover shafts (1500 or 1510) are also crossed to form dome configurations as shown in FIG. 8B and FIG. 11B.

FIGS. 16O and 16P show that the legs of the arched configuration can be straight below the roof (FIG. 16O) or slanted (FIG. 16P) to form a structure that is lower to the ground and covers more area. The taller position of FIG. 16O allows for the operator 400 to stand up and easily move around. The lower position of FIG. 16P allows for coverage of more people or equipment. Thus, the same configuration can be used, for example, for cooking or hunting while standing during the day and then repositioned for sleeping at night. Also, the lower position is advantageous in locations, such as an open, grassy meadow, where the taller profile would be more noticed. Also, the low profile is advantageous in high wind or blizzards. As discussed above (in reference to FIG. 16E, FIG. 16F, and FIG. 16I), one of more of the half-length shafts 1099, can be removed to bring the structure lower. Both the cylindrical arched roof unit 1604 and a dome shaped embodiment with three cover holes 1240 in each corner seam 1544 are lowered in a similar manner.

This novel technique of the present invention is also useful in a tent. For example, an Everest expedition could carry one tent cover comprising an integral floor (or alternatively a removable floor 1560) and cover holes 1240 in the corner seams. While at base camp, the tent could be used at full height. However, during the final assault of the peak, unwanted components such as extra the half length shafts 1099 (and the alternatively removable floor) are left at the base camp in the removable cover bag 1668. Then, the lighter weight, lower profile configuration with just the cover shafts (1500 or 1510) and the cover 1540 are used to protect from the high wind, blizzard conditions, and colder temperatures encountered on the way to the peak. In the removable floor embodiment, the unused lower walls of the cover 1540 can be drawn together to from an alternate floor.

Figure 16R:
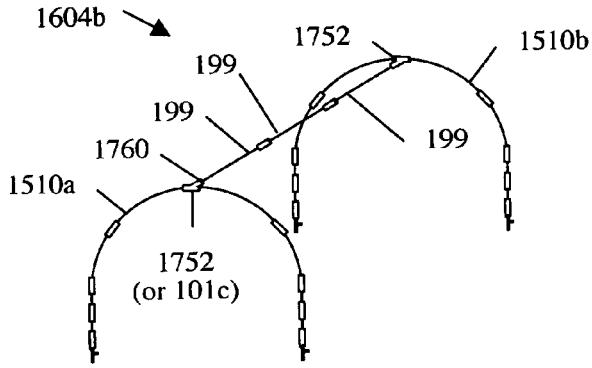
Figure 16S:
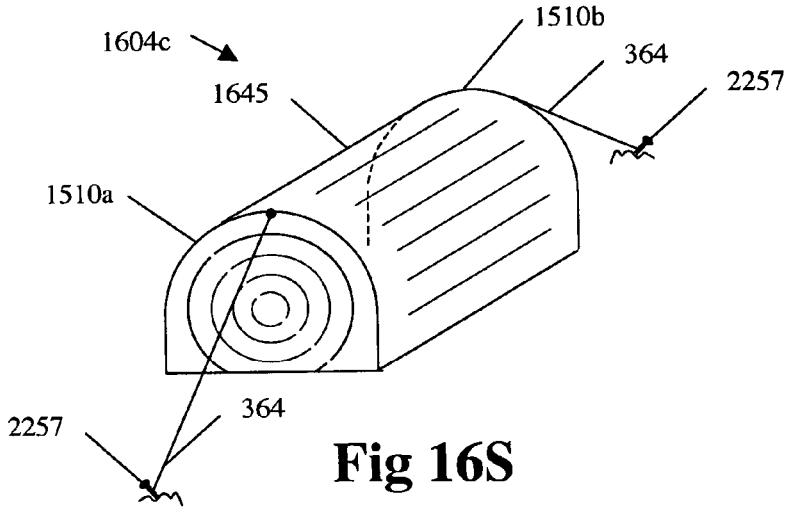

FIG. 16Q cylindrical arch exterior 1604*a* that is camouflaged to look like a hay roll commonly found in fields. The hay roll cover 1645 is a fitted version of cover 1540 in the same of a cylindrical arch. The weight of the hay roll cover 1645 would pull the arches in cause the center to sag a flutter in the wind. FIG. 16R and FIG. 16S show two methods of avoiding cover sag and flutter.

FIG. 16R shows an arch with ceiling shaft 1604*b* which is a form of the shelter frame 1530, that is used with the cylindrical arch roof unit 1640*a* shown if FIG. 16Q. The ceiling shaft is formed, for example, with three shaft segments 199. The receiving end 1072 of the combined shaft segments 199 is connected to the near cover shaft (1510 a with a 3-way receiving end connector 1752 at the apex of the arch) with an inserting-to-inserting connector 1760. The inserting end 1070 of the combined shaft segments 199 is connected to another 3-way receiving end connector 1752 at the apex of the rear arch 1510*b*. Alternatively the 3-way receiving end connector(s) 1752 could be substituted with a 101*b* 3-legged alternate support in place of one of the inserting-to-inserting connector 1760 (such the center one shown in FIG. 11C).

FIG. 16S shows a similar cylindrical arch roof unit with staked arches 1604*c*. Instead of the ceiling shaft of FIG. 16R, the arches are held apart with cords (such as drawstring 364 or bow cord 1626, shown) attached to stakes (such as 2257).

FIG. 17A through FIG. 17D

Figure 17A:
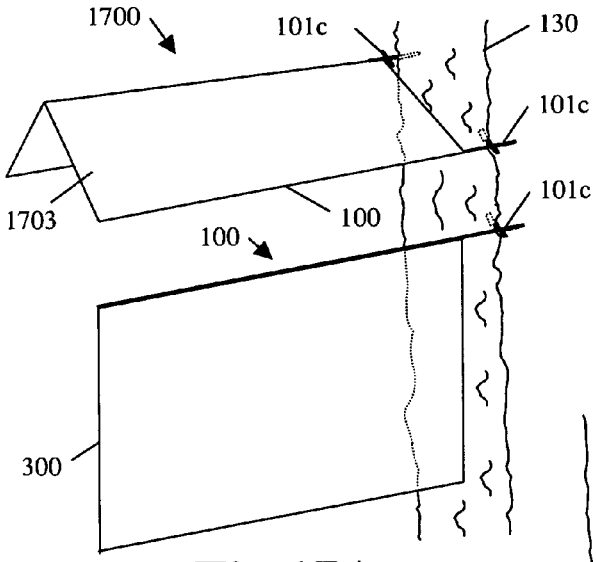

FIG. 17A shows a tree fly 1700 configuration that could be constructed with one basic module 1605 (for a total of two curtains 300 and four supports 100). These is the same components shown in FIG. 12A. One attaching pivoting support 100 is attached to the attaching structure 130 (shown as a tree) with an alternate support (shown as a 4-legged support 101c) and supports a vertically hanging curtain 300. The remaining three supports 100 are attached to the tree in three points forming an inverted V. The remaining curtain 300 of the basic module 1605 is passed over the top center support 100 and attached to the two lower side supports 100 forming a curtain fly 1703. Thus, the same basic module 1605 that can used to form the ground blind configuration of FIG. 14A or the base of a 2-walled covered blind as shown in FIG. 16BB, can be used to form a tree blind (such as shown in FIG. 4C) with a rain fly. The curtain fly provides protection from the elements and additional concealment due to the shadow of the fly and the elimination of silhouettes against the sky from directly below.

Figure 17B:
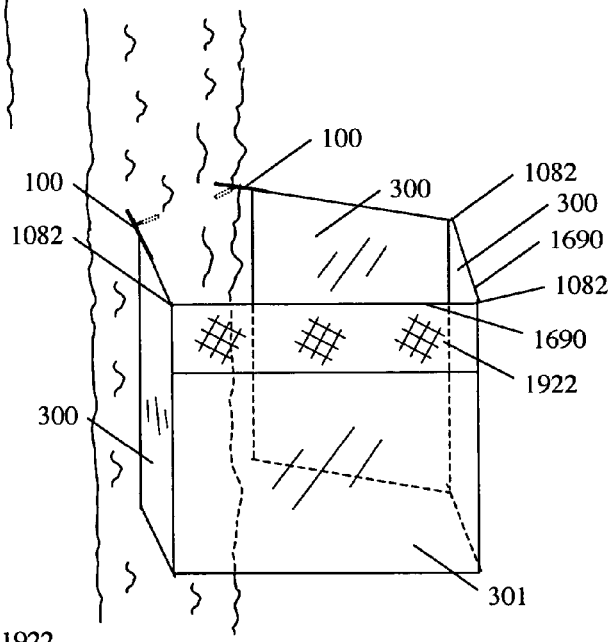

FIG. 17B shows an alternate tree stand module comprising a two supports 100 (shown attached to a tree with an alternate support 101), two 2-receptor shafts, connected with three 2-legged threaded support 1082 to form a structure with four sided connected to a tree as shown. The shafts each support a curtain 300. One of the curtains is shown as a curtain with shoot-through panel 301 where a shoot-through panel 1922 is placed in the curtain 300.

Figure 17C:
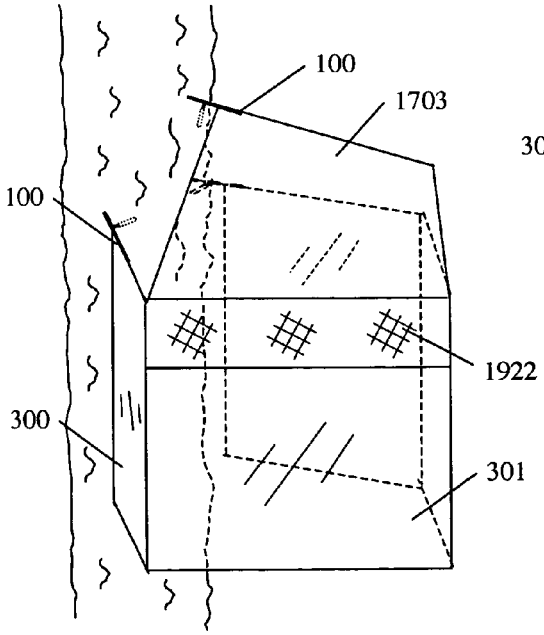

FIG. 17C shows the alternate tree stand module of FIG. 17B covered with a curtain fly 1703 (as shown in the parent application). The curtain fly 1703 is attached to a fifth support 100 and angled over the top of the alternate tree stand module of FIG. 17B where the other side attaches to one of the four supports 100.

Figure 17D:
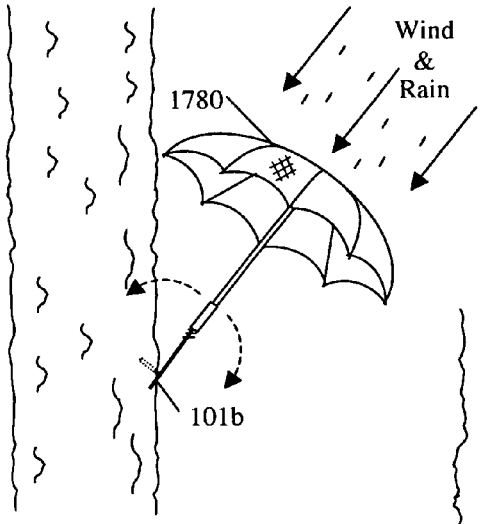

FIG. 17D shows a novel use of the supports 100 of the present invention. The support 100 (shown, for example as 101*b*) attaches to a tree, for example, with first leg 150. pivots around the attaching leg, and holds the angular position due the friction of the attachment (e.g. the teeth friction in the wood), An umbrella 1780 can be attached with a dimpled connector 194 (such as receiving-to-receiving connector 1740) to the other leg (e.g. 190 or 192) and position at any angle. This has the advantage of allowing the user 400 to dynamically position the umbrella at any angle, so that user is protected from rain coming in at an angle due to heavy wind. It also has the advantage that the umbrella can be positioned in a downward angle to act as blind between the user and people or animals on the ground.

Preferably the umbrella 1780 is made with camouflage material. Like the moving shield 1852 (shown in FIG. 18A and detailed in the parent application), the umbrella 1780 preferably has a shoot-through section 1860 embodied as a shoot-through umbrella section 1860*b*. Unlike a conventional umbrella, the umbrella 1780 of the present invention preferable is one with a wider umbrella section 1862 which may be collapsed partially around the tree (when used in a configuration like FIG. 17E) or on the ground (when used in a configuration like FIG. 17F).

Figure 17E:
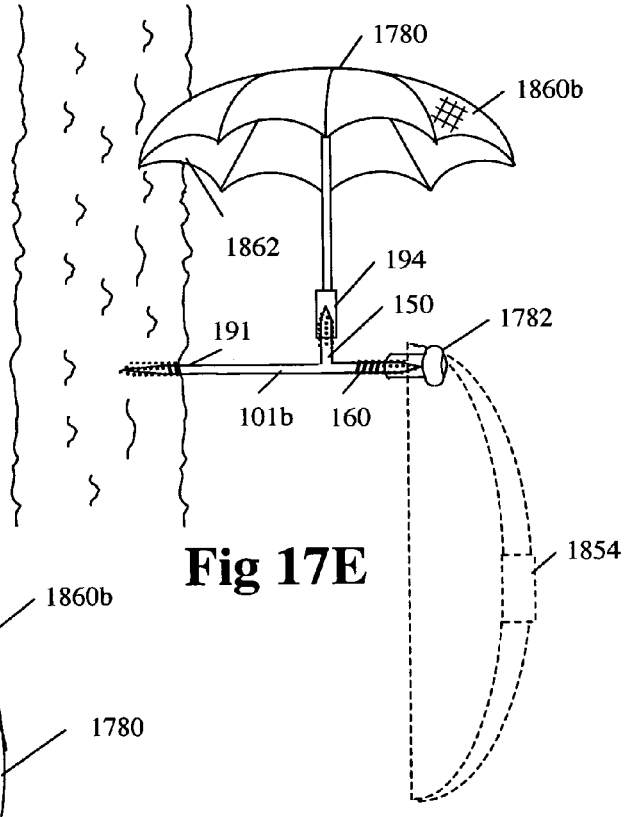
Figure 17F:
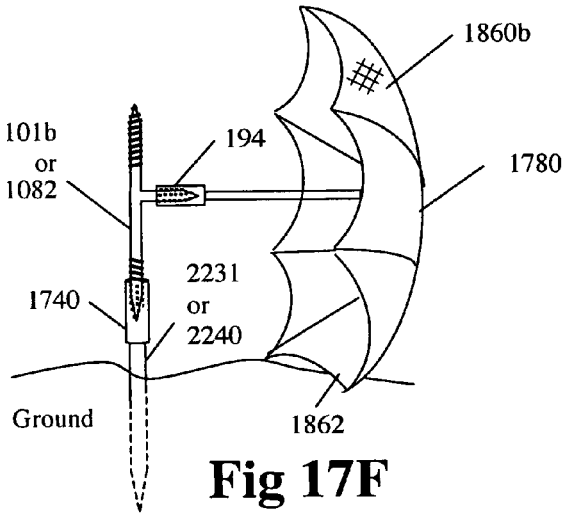

FIG. 17E shows another configuration where the third leg 191 is attached to the tree, the umbrella 1780 is attached to the first leg 150, an end piece 1782 is attached to the second leg 160. The end piece 1782 protects the user from the sharp point of support 101*b*, and preferably has a slightly protruding ring around the edge so that hand held equipment 1854, such as a bow as shown, can be hung from the free leg but easily lifted and slide off when needed. Like the use described in reference to FIG. 17D, the support 101*b* can be pivoted around the axis of the leg that is in the tree and the umbrella can be positioned in any angle to protect against rain or snow, or to provide additional concealment. The protruding ring allows the end piece 1782 to rotate and not drop the hand held equipment 1854.

Alternatively a receiving-to-receiving connector 1740 (FIG. 17G) or a 3-way receiving end connector 1752 (FIG. 17H) could be used to protect the user from the sharp point and to hold the hand held equipment 1854.

Figure 17G:
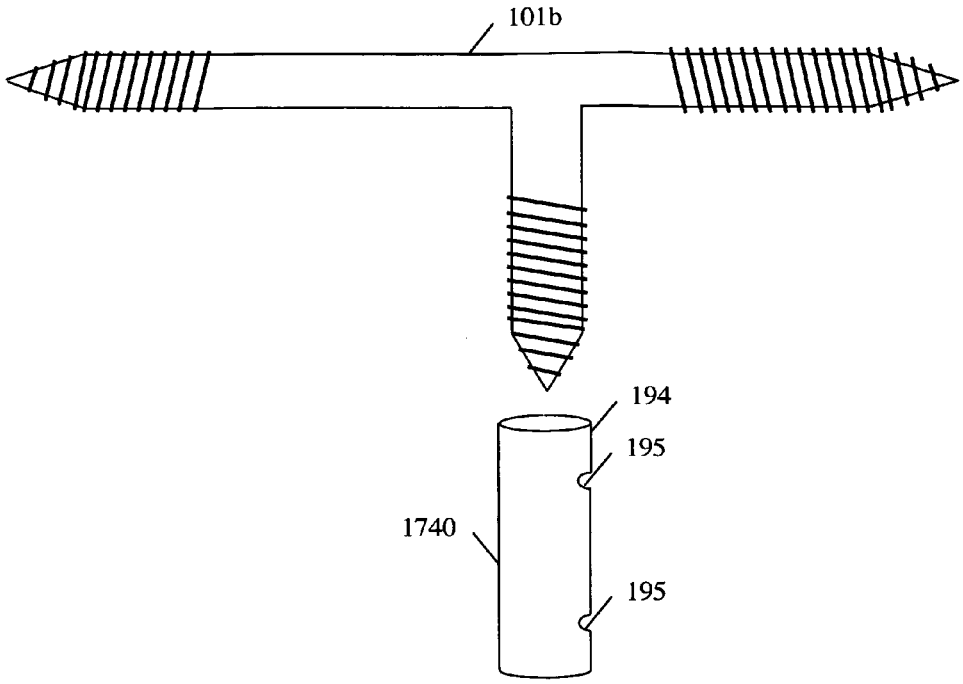
Figure 17H:
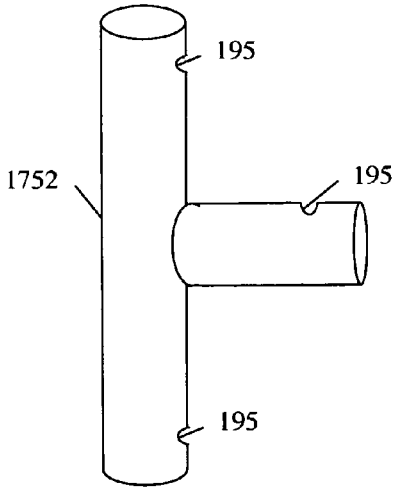
Figure 17I:
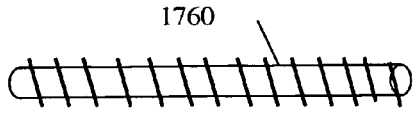

FIG. 17G through FIG. 17H

FIG. 17G shows a dimpled connector 194 with at least one dimple on each end forming a receiving-to-receiving connector 1740. The receiving-to-receiving connector 1740 can connect any two inserting ends 1070 whether they are on a support (100, 101, 101*b*, 101*c*, 102, 1082, 1084, 1760, etc.), connector (1086, etc.), bracket 1800, or shaft (109, 199, 1077, 1500/1510 with receiving ends, 1910, etc.).

The receiving-to-receiving connector 1740 has an additional novel use in the system in that it can be used to cover a threaded leg of a support, such as alternate support 101*b* (as shown), to make it easier to apply force to the support when attaching another leg to an attaching structure 130, such as a tree. Further, it can be installed over unused, exposed points and threads of a structure to shield the operator from injury.

FIG. 17H shows a 3-way receiving connector 1752, that optionally is used to interconnect various modules such as the walls, curtains, and covers shown in FIGS. 16L and 16M. The 3-way receiving connector 1752 has at least one dimple 195 in each of the receiving ends.

FIG. 171 shows a headless bolt 1088 with threads on each end forming an inserting-to-inserting connector 1760. Alternatively, the inserting-to-inserting connector 1760 could have locking slots 1094 instead of threads, such as slotted connector 1762 (shown in FIG. 17J). The inserting-to-inserting connector 1760 (or slotted connector 1762) can connect any two receiving ends 1072 whether they are on a connector (104, 194, 700, 710, 720, 760, 770, 1086, 1740, 1750 etc.), an attaching fastener 230, or shafts (109, 199, 1091, 1099, 1500/1510 with receiving ends, 1910, etc.)

Figure 17J:
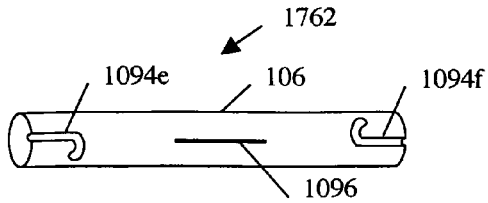

FIG. 17J shows an embodiment of a inserting-to-inserting connector 1760, the slotted connector 1762 which comprises a short shaft having opposing locking slots (1094*e* and 1094*e*) on opposite ends. In a currently preferred embodiment, two shaft segments, for example 199, 1099, 1690, are connected by inserting the slotted connector 1762 in the receiving end 1072 of adjacent shafts (e.g. threaded segmented shaft 109*b* as shown in FIG. 1X or alternate cover shaft 1510 as shown in FIG. 11C) and twisting clockwise to lock. The shafts can be disconnected by twisting both shafts counterclockwise.

FIG. 18A and FIG. 18B

FIG. 18A shows a novel use for a fan fly as shown in the parent application. In this moving shield 1852 embodiment, the fan is attached to a piece of hand held equipment 1854 (such as a weapon, e.g. a bow as shown or a gun; camera; or other piece of equipment be carried by the operator 400). The moving shield 1852 is connected to the equipment 1854 with an equipment attachment 1853. The moving shield 1852 may optionally have a shoot-through section 1860. The shoot-through section 1860 could be a shoot-through panel 1642 in a portion of the shield 1852 material (as shown) or could be a V-shaped opening between the two ends of the fan, i.e. 760*a* and 760*b*. This embodiment provides moving concealment to the operator 400 while the operator's hands are otherwise occupied with the operation of the equipment.

FIG. 18B shows a similar umbrella shield 1852*b*, comprising a umbrella 1780 attached to the hand held equipment 1854. The umbrella shield 1852*b* is connected to the equipment 1854 with an equipment attachment 1853. The equipment attachment 1853 uses a novel dimpled connector 194 (such as 1740) of the present invention to attach to the umbrella shield 1852*b*. The umbrella shield 1852*b* optionally has a shoot-through umbrella section 1860*b* that is a V-shaped section between two ribs of the umbrella 1780. This embodiment also provides moving concealment to the operator 400 while the operator's hands are otherwise occupied with the operation of the equipment.

FIG. 19A through FIG. 19F

FIG. 19A through FIG. 19F show various embodiments of covers 1540 with scent limiting features, namely a scent cover 1940. Wildlife uses scent to detect the presence of users. In is beneficial to provide scent barriers and means to lift the scent of the users higher in the wind. A tree stand is one way users avoid having their scent in the wind at the level of the wildlife.

FIG. 19A shows scent covers 1940*a* with four scent flaps (1942*a*, 1942*b*, 1942*c*, and 1942*d*) extending out from the cover 1540 and laying flat on the ground. The flaps can be covered with dirt, rocks, or limbs to create a scent barrier.

FIG. 19B shows scent covers 1940*b* with the scent flaps (1942*a*, 1942*b*, 1942*c*, and 1942*d*) extending inside the cover 1540 and laying flat on the ground. Only two hidden scent flaps are shown to demonstrate how the flaps overlap inside the shelter or blind.

FIG. 19C shows a currently preferred embodiment of a scent cover 1940*c* having a door 1634. As shown in FIG. 15B, the door fastener 1212*c* is covered by a door flap 1572. In this scent cover 1940 embodiment, the door flap is extended with a door scent flap 1942*e* that is separate from the first scent flap 1942*a* so that the door 1634 can be fully opened as described above. The door scent flap 1942*e* overlaps the first scent flap 1942*a* helping keep moisture from rain or snow out of the shelter or blind.

FIG. 19D shows an extended configuration of scent cover 1940*d*. As discussed earlier, additional half-length shafts 1099 can be added to the ends of the cover shafts (1500 or 1510). FIG. 19D shows a configuration being used in tall grass 1944 where each end has been extended. The scent cover 1940*d* is configured similar to the cover 1540 shown in FIG. 12H in that the top of the cover is opened. Due the extension the scent flaps hang down and provide sufficient concealment in the tall grass (or similar ground cover). A user 400 is shown hunting, for example, waterfowl or pheasants from this extended configuration.

Figure 19E:
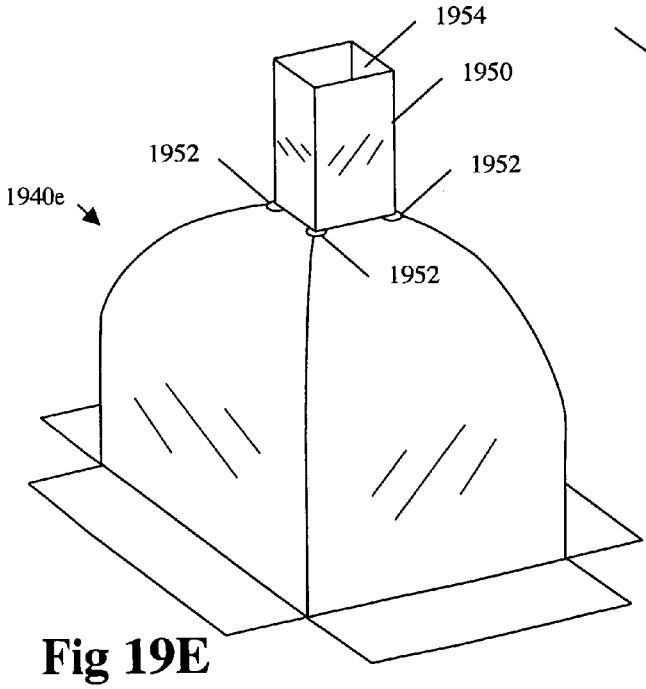

Various scent chimneys are known in the art. The modular system of the present invention uses the components (shafts and connectors) and materials to construct and attach a scent chimney 1950. As shown in FIG. 19E, the scent chimney 1950 is attached to the cover shafts (1500 or 1510) using chimney attachments 1952. The chimney attachment could be ties, strips of hook and loop fasteners, or a clip similar to the attaching clip 1477 shown in FIG. 11E. Alternatively, the chimney attachment could be a clip similar to one side of the intersection clip 1410 that clips to the cover shaft and another side that provides a means for attaching to a shaft in the corner of the scent chimney 1950. Air inside the scent cover 1950*e* will be heated by the body heat of the users, and will rise up the scent chimney 1950 and out the chimney opening 1954.

Figure 19F:
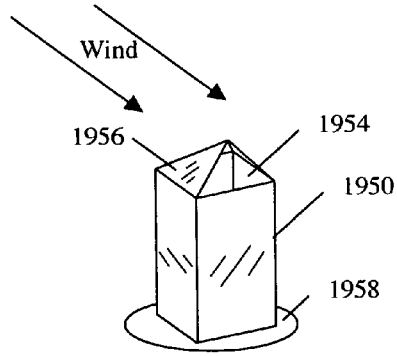

FIG. 19F shows an optional chimney cover 1956 which keeps out moisture from rain and snow and which positions the chimney opening downwind. The wind passing by the opening will create a vacuum that will also draw scent up and away with the wind.

FIG. 19F also shows an alternate chimney skirt 1958, which can be tucked in the top window fasteners 1210 under the respective top sections 1218*a* and 1218*b* (see FIG. 15A and FIG. 15T, in particular the location pointed to by reference arrow 1210). The chimney skirt 1958 also acts as an alternate means of chimney attachment 1952.

The scent chimney is preferably taller than shown. An extremely tall scent chimney is further supported and stabilized by a cord attached to the chimney opening 1954 and passed over an overhead tree limb.

FIG. 20A through 20D

Figure 20A:
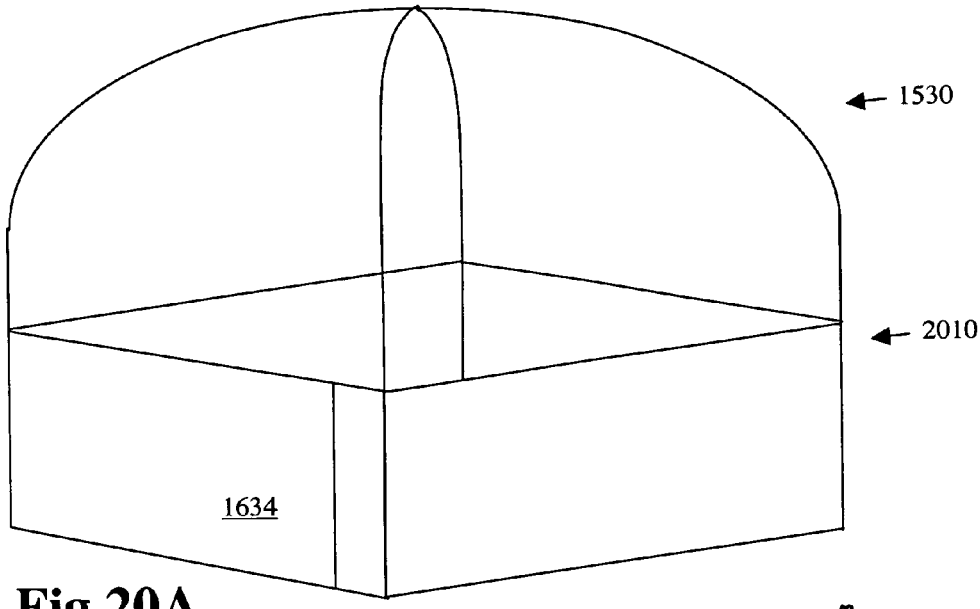

FIG. 20A shows yet another embodiment of a covered shelter. FIG. 20A illustrates a novel single piece skirt 2010. This embodiment comprises a shelter frame 1530 with a skirt 2010. The skirt 2010 is a single piece of material that covers the base of the shelter on a plurality of sides. A door 1634 is shown on one side. In a currently preferred embodiment the opening of the door 1634 is a door fastener 1212*c* (see FIG. 15A).

Figure 20B:
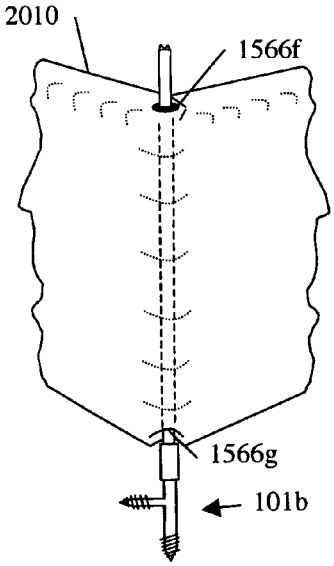

FIG. 20B shows the details of the skirt attachment around one of the supports 100. At the top, one or more eyelets (e.g. 1566*f*) in the skirt 2010 material are folded inward to form a corner that is held by the shaft connection (as shown in FIGS. 1Z, and 16J). Alternatively, the skirt is formed from a cover 1540 having the novel fastener layout (FIG. 15T) such that the top of the cover can be completely opened as shown in FIG. 12E and FIG. 12F.

Figure 20C:
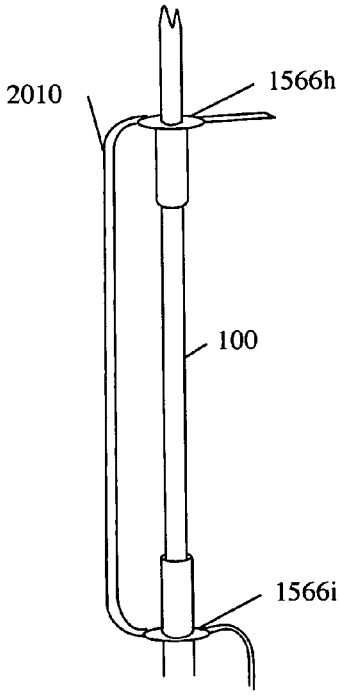
Figure 20D:
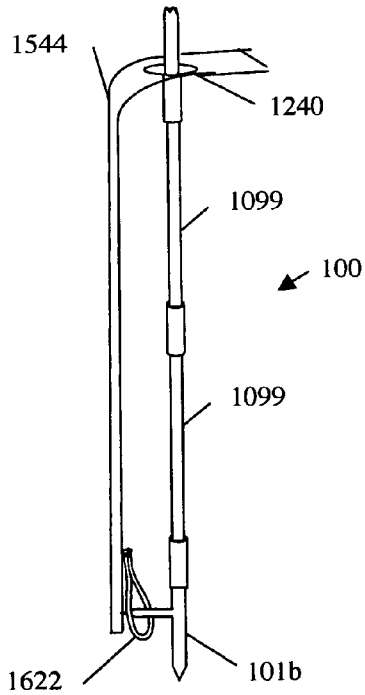

FIG. 20C shows the details of the skirt 2010 attachment. The support 100 passes through and outside the skirt 2010 at the top and back in at the bottom (see top grommet 1566*h* and bottom grommet 1566*i*). FIG. 20D shows a current preferred embodiment where the cover 1540 is used to form the skirt. Each support 100 passes through the cover hole 1240 in each cover seam 1544 (see 16I). The bottom of the skirt of this embodiment is held taut by placing the corner loop 1622 over the free leg of alternate support 101. As shown in FIG. 20D, the support 100 comprises two half-length alternate shaft segments 1099.

FIG. 21A through 21C

FIG. 21A through FIG. 21C show a currently preferred embodiment of the modular system of the present invention further comprising a fully detachable, shoot-through window 2140. The shoot-through window 2140 is removably fastened with strips of hook and loop fasteners (as shown in a currently preferred embodiment), or alternatively with other fasteners such as zippers (not shown). The shoot-through window 2140 is preferably made from a camouflaged mesh, similar to the see-through panel 1922 described in the parent applications. The shoot-through window 2140 comprises a number of shoot-through fastening points 2144 at intervals along the front top of the shoot through window 2140 and in the front corners. Preferably, the shoot-through fastening points 2144 are the loop side of strips of hook and loop material. Alternatively the shoot-through fastening points 2144 are snaps or button holes. The shoot-through window 2140 further comprises two lower fastening points 2142*a* and 2142*b* which are preferably placed a few inches above the bottom edge of the material and positioned to match with the cover 1540 as discussed below. The lower fastening points 2142 are preferably attached on the back of the shoot-through window 2140.

FIG. 21B shows a shoot-through window configuration 2150, which illustrates the corresponding shoot-through window receiving features of a currently preferred embodiment of the cover 1540. A shoot-through receiving point 2154 is located on the inside of the window flaps 1572 which matches the location of each respective shoot-through fastening point 2144. The shoot-through receiving points 2154 are located inside the flaps around the star windows (i.e. first flap 1572*a* and fourth flap 1572*b* as shown in FIG. 15B, or their combination as a single flap 1572 as appropriate for the four fastener star window of FIG. 15C). Being located inside the flaps 1572 allows moisture to run of the flaps 1572 and down the outside of the shoot-through window 2140.

The lower fastening points 2142*a* and 2142*b* match with lower receiving points 2152*a* and 2152*b*, respectively, that are located on the outside of the cover 1540. The bottom few inches of the shoot-through window 2140 overlap the opening of the window as by the horizontal dashed line in FIG. 21B. This allows the moisture to run off the shoot-through window 2140 and down the lower portion of the cover panel 1542.

The lower fastening points 2142*a* and 2142*b* and the corresponding lower receiving points 2152*a* and 2152*b* are located on at the bottom of the bottom left window fastener 1214 and the bottom right window fastener 1216, respectively (see FIG. 15A) and near the bottoms of the second flap 1547 and third flap 1548 (see FIG. 15B).

When the novel star window is configured as shown in FIG. 15Q (without the novel shoot-through window 2140), the user can from inside the shelter or blind attach the shoot-through window 2140 by connecting the respective fastening points (1242 and 1244) to the corresponding receiving points (1252 and 1254). A novel feature of the present invention is the user can then disconnect the window section loop 1580 from the window section attachment 1582 and lower the triangle section 1220 while still maintaining the wall tension through the shoot-through window 2140. The present invention teaches that forces that keep the respective cover panels 1542 taut are transferred from the shoot-through receiving points 2154 (nearest the cover shafts 1500 or 1510) through the shoot-through window 2140 material to the lower receiving points 2152*a*and 2152*b*. Thus, the various novel features of the present invention including: the adjustable length shafts (e.g. cover shafts 1500 with half length shafts 1099 as extension shafts of FIG. 11B); the bow cords 1626 (FIG. 11B and FIG. 11D); the cover 1540 with star window layout 1590 (FIG. 15A); rain flap configuration 1592 (FIG. 15B); and shoot-through window 2140; work together to provide a means of concealment that maintains taut cover panels regardless of the terrain, weather, or lighting conditions. These advantages are achieved with less weight and less cost but with greater ease of use, than is presently known in the art.

FIG. 21C shows a photographic image of an embodiment of a blind incorporating the many of the above-described novel features, including the shoot-through window 2140. This blind preferably uses a camouflaged pattern, such as copyrighted by the Mossy Oak brand owner. The window fasteners are all fully closed. The top window fastener 1210 is fully concealed by top flap 1570. The top receiving point 2154*g* is shown exposed by fourth flap 1572*b*. The door flap 1572*c* is shown turned back exposing the door fastener 1212*c* to view. The four-fastener star window 1594 is visualized on the right side of the image.

The receiving points 2154 are alternatively made of strips of hook material which allow the shoot-though window 2140 to be attached at various heights with the lowest position being the one shown in FIG. 21B. As the shoot-though window 2140 is raised higher on the strips of receiving material, an opening in the bottom of the window increases in size. The user can adjust the opening to meet the needs of the situation, such as firing an arrow or taking a picture while keep most of the window section concealed by the shoot-though window 2140 material.

FIG. 22A through 22G

FIG. 22A through 22G show alternate ways to secure the ends of a shaft to the ground and to connect a bow cord.

FIG. 22A shows an embodiment of a three-legged bracket which is a threaded stake 2230 that has both a threaded leg 2236 and an unthreaded leg 2235, neither of which are pointed. The threaded leg 2236 is attached to any dimpled connector such as the receiving end 1072 of a shaft. The unthreaded leg 2235 is used to drive the stake into the ground and to grip the stake for removal.

Figure 22B:
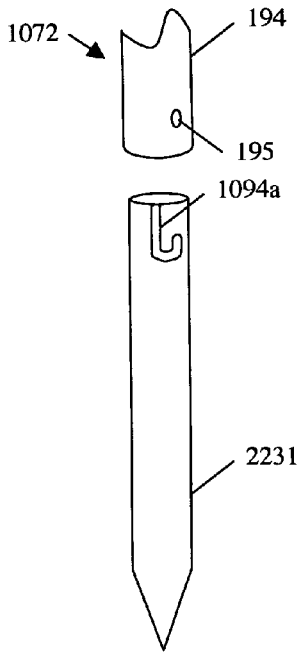

FIG. 22B shows a sharpened shaft with slot 2231. The slot 1094*a* is used to removably secure the sharpened shaft 2231 to the receiving end 1072 of a shaft.

Figure 22C:
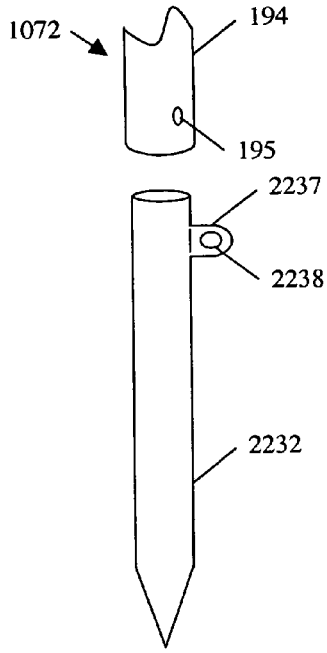

FIG. 22C shows a stake with tab 2232. The tab 2237 is used to grip the stake. The cord hole 2238 in the tab 2237 is used to attach a cord such as the bow cord 1626.

Figure 22D:
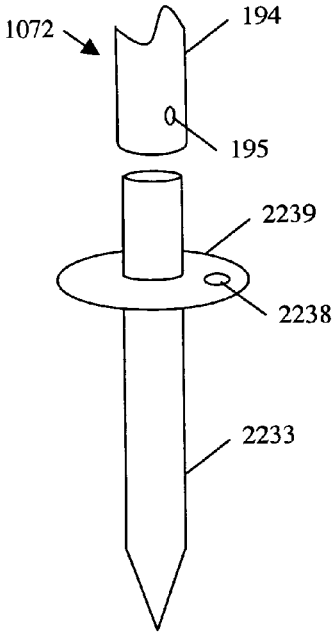

FIG. 22D shows a stake with disc 2233. The disc 2239 is used to grip the stake. The cord hole 2238 in the disc 2239 may be used to attach a cord such as the bow cord 1626.

Figure 22E:
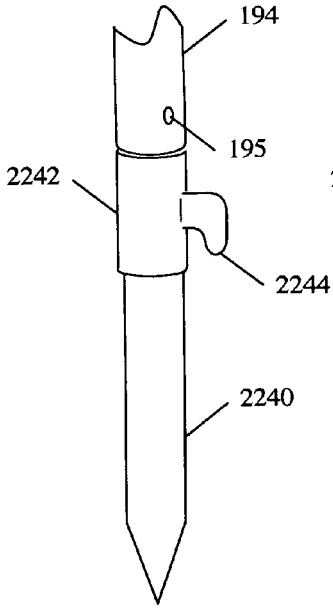
Figure 22F:
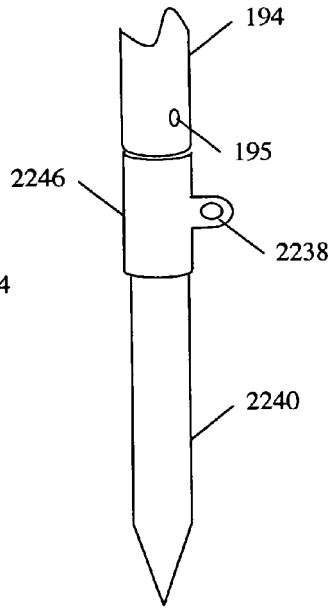

FIG. 22E and FIG. 22F show a sharpened shaft 2240 inserted into a dimpled connector 194. FIG. 22E shows a clip with hook 2242, comprising a clip hook 2244. FIG. 22F shows clip with tab 2246 (similar to attaching clip 1577). Either clip (2242 or 2246) is preferably formed as solid ring that easily slides over the sharpened shaft 2240. The bow cord 1626 may be permanently attached to the cord hole 2238 and easily passed over the sharpened shaft 2240 for the bottom attachment 1573 (see FIG. 11B, compare FIG. 11D).

A knot such as the one shown for the bottom attachment of 1573 is alternatively tied around the sharpened shaft 2240 (which takes the place of the alternate support 101 as shown in FIG. 11D) to achieve some cost savings.

FIG. 22G shows yet another alternative embodiment of the present invention. The cover shafts (1500 or 1510) is tightly secured to the corner of the cover 1540 by placing an inserting pin 2250 in the receiving end 1072 of the cover shaft (or a connected extension shaft such as 1099). The inserting pin 2250 is permanently attached to a plurality of corner loops 1622 (preferably all twelve corner loops 1622*a*, 1622*b*, and 1622*c*, in each of the four corners, respectively). The same loop can be used to stake down the respective corner of the cover, effectively securing both the shaft and the corner of the cover to the ground.

FIG. 22G is a somewhat exploded view. In practice the shaft 1510, stake 2252, and corner loop 1622 would be pressed tightly in together in the lower corner.

As described above a portion of the corner loop 1622 could pass to the outside of the cover 1540 and be staked from the outside. A cover hole 1240 would allow the cover to have an integral floor and allow the stake to pass through or allow the corner loop to pass through and be staked on the outside. Further in a situation like the one shown in FIG. 16F, the stake 2252 which is substituted for alternate support 101 would not interfere with the excess material of the cover roll 1546*c*.

FIG. 23A through 23D

FIG. 23A through FIG. 23D illustrate yet another novel, optional feature of the modular system of the present invention. As shown FIG. 16O and FIG. 16P, the present invention allows the arches that comprises the shelter frame 1530 to be taller or to be lower. The cover 1540 needs to be able to accommodate this flexibility.

Figure 23A:
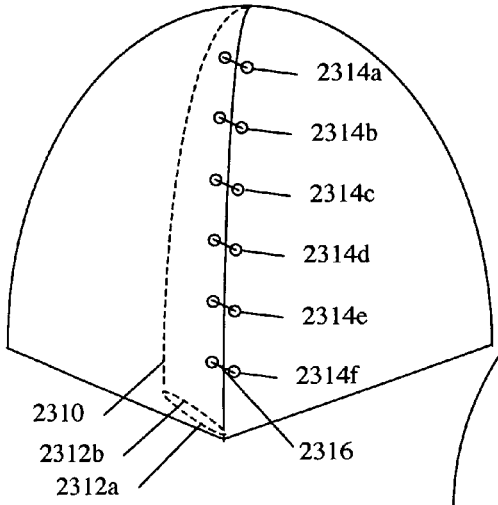
Figure 23B:
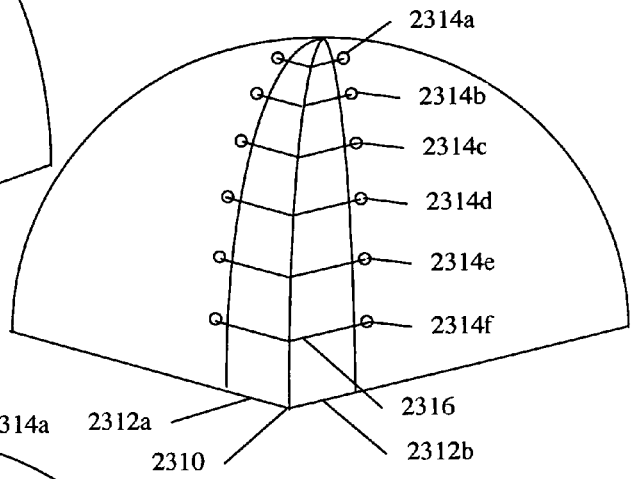

FIG. 23A shows a cover 1540 having at a fold 2310 in at least one corner. The fold 2310 brings two expansion panels 2312*a* and 2312*b* together when the shelter frame 1530 is in a taller position (see FIG. 16O) and to expand to a lower position (see FIG. 16P) as shown in FIG. 23B or alternatively FIG. 23C. The tension on the wall of the cover is maintained by passing one or more laces 2316 through pairs of lace holes. The lace could be a single cord that is drawn up, or a series of ties of for each pair of lace holes (for example, 2314*a* through 2314*f*). The laces 2314 could comprise elastic cord 126 which would be a means of maintaining a tighten force of the walls of the shelter or blind.

FIG. 23B shows the fold being released evenly on both sides of the corner shaft.

Figure 23C:
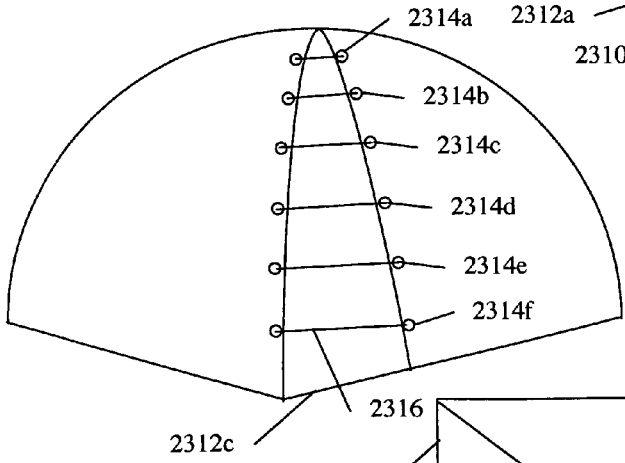

FIG. 23C shows the laces starting at the corner seam 1544 and the expansion panel 2312*c* only expanding on one side.

While a single expansion (such as the combination of 2312*a* and 2312*b* in FIG. 23B or 2312*c* in FIG. 23C) would allow for the necessary flexibility. The uniformity of the same of the cover 1540 would be better maintained with two expanding sections of the type shown in FIG. 23B at opposite corners, or with four expanding sections of the type shown in FIG. 23C.

Figure 23D:
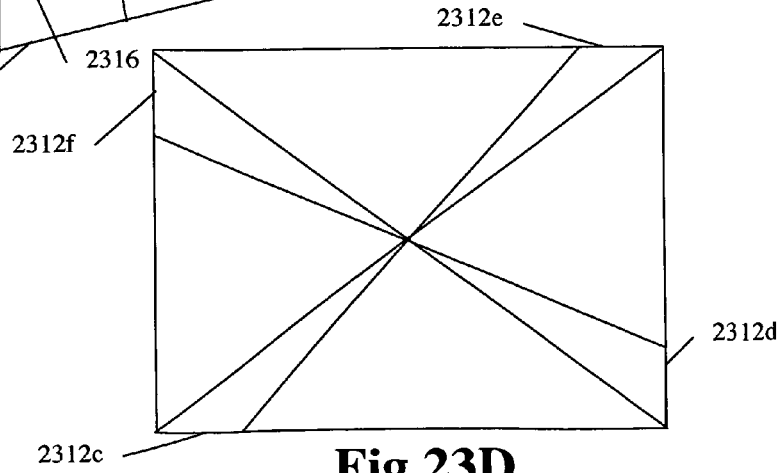

FIG. 23D shows the top view of four expansion panels 2312*c*, 2312*d*, 2312*e* and 2312*f*, each in one side of a four-side cover (as shown in FIG. 23C), Solid Shafts Versus Hollow Shafts With Elastic Cords Some of the foregoing embodiments have explicitly shown the use of hollow shaft segments connected with an internally running cord 126, for example FIG. 1W, FIG. 13 and FIG. 8A. The present invention also provides a means for attaching solid shaft segments and still allowing the shafts to breakdown (see discussion in parent application). Most of the embodiments can be implemented with either type of segmented shaft. A solid fiberglass shaft has greater strength than the same sized hollow fiberglass shaft. By using solid fiberglass shafts, smaller diameter shafts can be used resulting in lower cost and lower volume. It is anticipated that both hollow shafts with cords and solid shafts with or without hinged connectors will be used. The different types of shafts can be color-coded, for example, black for solid and grey for hollow.

For some applications, an operator may want to use a solid shaft for every other segment in a segmented shaft. The remaining segments could be those as shown in FIG. 1W which would allow for a breakdown at both ends of the hollow shaft segments. The end result would be a stronger overall segmented shaft that would have one breakdown point per each shaft.

In applications where the segmented shaft needs to also have tensile strength, only solid poles without corded attachments would be necessary.

Other Uses

While the descriptions of the various embodiments have been made in reference to an undeveloped outdoor area, the module system of the present invention could also be used in urban areas. For example, in colder winter climates, the system could be used to form a green house over a garden using clear plastic sheeting and then reassembled in the summer as a shelter for vehicles or bicycles using an opaque tarp. In another example, the supports, shafts, connectors, and curtains could be used to form a backyard maze. In yet another example, the system could be used for constructing outdoor structures for weddings, flea markets, festivals, or even security checkpoints.

Lengths In Multiples and Integrated Features

The present invention anticipates that the various components, modules, and units will be provided in an integrated fashion. For example, shafts segments all either are the same size or be multiples of a standard unit of length. For example, in the currently preferred embodiment, the standard full length is about 31 inches and a half stick is about 15.5 inches. Grommets, including reinforced holes, are placed in covers, cover straps, curtains, skirts, and tarps so that the shaft segments can pass through at any connection. Angles are determined based on the use of standard units of length when forming modules such as the pyramid cap 1621. As mentioned in the parent application, the same tarp 1560 is sized for use as a removable floor and a roof for a cylindrical arched roof unit 1604. The dimpled connectors 194 are designed to receive both a threaded leg that can be screwed into a tree (e.g. 150 or 191) and an inserting end of a segmented shaft. Applying these principles allows the users of the system to configure an unlimited number of different structures to meet the needs various situations and various sized groups.

Thus, any shaft may be lengthened incrementally by that unit of length by using a segment as an extension segment.

ADVANTAGES

Modular

The system of the present invention is modular. A user can begin using smaller modules with minimal investment and add more pieces or more complex modules later. A group of users can each own separate modules, which are used independently, and then construct more complex configurations when the group comes together in the outdoors.

Separately Packable

Because the various components and modules can be separated, different users in a group can carry a relatively lighter load, for example, in their backpacks. The removable floor can be removed and only the lighter components need to be carried.

Star Window

The novel window configuration of the present invention provides blind windows with four or more sections such that any section or groups of sections can be independently opened while maintaining taut cover panels. The star windows also allow the top of the blind to be fully opened. A novel window section attachment allows non-adjacent window sections to be attached.

Skin Tightening

The novel means of tightening the skin of the present invention provides methods and means for tightening the skin on the sides of a blind cover to reduce movement and flutter in the wind. The means of the present invention include cover shafts that are securely anchored in the ground and bow cords which attach to the cover shaft and cause a constant outward pressure on the sides of the cover. This is done with lower cost, lighter weight, and easier to use structures.

Simple

The present invention is simple to make and use. For example, the starter kit (support 100 plus curtain 300) contains fewer components than other devices in the field of this invention. Each component is easily made. The present invention requires little time to attach and to set up.

Basic modules can be quickly setup to provide initial concealment. Other components can be added and configured as needed.

Easy To Use

The present invention is easy to use. To install, the operator 400 simply attaches the support and optional shafts, connectors, curtains, and covers. To use as a tree blind, the support 100 of the starter kit is angularly position to raised or lowered position.

Unlike conventional tents, or other complex blind systems, the user can simple place supports in the ground. Next, a shelter frame can be assembled from shafts that can be preconfigured and quickly deployed. And then, a cover can be placed over a freestanding structure.

Lightweight

The present invention comprises a few simple parts that can easily be constructed of lightweight materials. Being lightweight is important for those who have to carry gear into the outdoors.

Compact

The present invention is compact. The support, shafts, connectors, and curtains can easily be rolled together into a small bundle or placed in a slender sack such as the case 1300. Even larger modules such as covers with cover shafts can be broken down and rolled together in relatively small bundles. This is advantageous for both storage and carrying.

Portable

The present invention is lightweight and compact allowing it to be carried long distances into the outdoors and to be used in a variety of locations. The curtain 300 can be folded or rolled up with various components of the attaching pivoting support 100 and placed in the case 1300 for easily carrying on a waist belt or in a backpack. Other components can be separately packable by a group of users.

The cover 1540 and other loose parts can be placed in a novel cover bag for easy movement.

Quiet

The attaching pivot support with a curtain has no moving parts that would make a noise or rattle together. In some cases the screws turning against the attaching structure could make a quiet sound. However the design is such that once screwed in all the way the screw can be backed out a turn or two to reduce the volume of noise made to a negligible level.

Further, the tension on the curtain 300 provided by the second leg 160 and the anchor points 310 and ties 340 reduce wind noise.

The skin tightening features of the present invention reduce noise from wind movement or flutter.

Universal

The modular system of the present invention uses the same brackets and shafts to construct both a variety of tree blinds and ground blinds. The same parts and equipment can be used to construct configurations for different purposes and for different environments. This maximizes the user's investment in the materials and minimizes the number of items to be packed. The use of standard shaft segments and half-length extension shafts provide for a large number of configuration using the same basic components.

Lower Cost, Longer Reliability

The present invention provides a number of novel features that reduce the complexity and cost of manufacture and that increase the reliability of the parts.

Avoiding Scent Detection

The present invention provides a number of features that reduce the scent that is released from a blind in the wind that is passing by wildlife that might be down wind.

CONCLUSION, RAMIFICATION, AND SCOPE

Accordingly, the reader will see that the present invention provides an easy to use, simple, lightweight, compact, portable, quiet, multi-use modular system for concealment and shelter.

While my above descriptions contain several specifics these should not be construed as limitations on the scope of the invention, but rather as examples of some of the preferred embodiments thereof. Many other variations are possible. For example, other embodiments of a means of connection shaft segments could be used, such as creating threads or locking slots using a smaller, machined metal sleeve glued on the end of an inserting end of a fiberglass shaft could be used. Further, different sizes of PVC pipes could be used as shafts and connectors. The various could be used without departing for the scope and spirit of the novel features of the present invention.

Accordingly, the scope of the invention should be determined not by the illustrated embodiments, but by the appended claims and their legal equivalents.

We claim:

1. A modular system for concealment and shelter for an operator, the system comprising:

a plurality of brackets and connectors each having an inserting end, a plurality of shafts having lengths which are multiples of a predetermined length, each shaft having at least one receiving end configured to receive an inserting end, each of said receiving ends being coupled to a respective inserting end of a cooperative one of said plurality of brackets and connectors or said plurality of shafts, at least one sheet of material having reinforced holes there through at predetermined locations whereby selected ones of the shafts pass through the material, and a cover module, said cover module comprising:

a cover sheet of material with a predetermined shape, forming a cover, and at least two of said shafts, connected to the cover, forming cover shafts, wherein the cover shafts form a frame for said cover, whereby the operator is provided enhanced concealment or protection from the elements, said cover further defines at least one window comprising four of more window sections, wherein each window section is connected to an adjacent window section with a removable window zipper, whereby each window section is independently opened, wherein the zippers meet forming a first star, the star having a center, and wherein each of the zippers starts fastening at the ends thereof away from the center and finishes fastening at the center.

2. The system of claim 1, further comprising a fifth window fastener also comprising a fifth zipper, wherein the fifth zipper also meets at the center.

3. The system of claim 2, wherein the fifth zipper also starts fastening at the ends away from the center and finishes at the center.

4. The system of claim 2, further comprising a second window with a second set of zippers forming a second star, wherein one end of the fifth zipper meets at the center of the first star and the other end of the fifth zipper meets at the center of the second star, connecting both stars, and wherein the fifth zipper starts fastening at the center of the one star and finishes at the center of the other star.

5. The system of claim 4 wherein the fifth window zipper is completely detached so that the top of the cover is fully opened, whereby the user is concealed on four sides, and whereby the user sees 180 degrees in a vertical plane.

6. A method of deploying the modular system of claim 5, said modular system further comprising a plurality of means for attaching to the ground, the method comprising the steps of:

a) attaching the plurality of attaching means to the ground, b) placing the cover, with the top of the cover fully opened, on the attaching means to quickly provide initial concealment, c) connecting the cover shafts to the attaching means, forming a freestanding frame, d) closing the top of the cover over the freestanding frame, providing increased concealment.

7. A method of deploying the modular system of claim 1, said modular system further comprising a plurality of means for attaching to an attaching structure, the method comprising the steps of:

a) attaching the plurality of attaching means to the attaching structure, c) connecting the cover shafts to the attaching means, forming a frame, and b) placing the cover, on the attaching means to provide concealment.

8. The method of claim 7, further comprising the step of opening at least one window section of the at least one window.

9. The method of claim 7, further comprising the step of opening at least one window section of the at least one window.

10. A modular system for concealment and shelter for an operator, the system comprising:

a plurality of brackets and connectors each having an inserting end, a plurality of shafts having lengths which are multiples of a predetermined length, each shaft having at least one receiving end configured to receive an inserting end, each of said receiving ends being coupled to a respective inserting end of a cooperative one of said plurality of brackets and connectors or said plurality of shafts, at least one sheet of material having reinforced holes there through at predetermined locations whereby selected ones of the shafts pass through the material, and a cover module comprising:

a cover comprising a sheet of material with a predetermined shape, and at least two of said shafts, connected to the cover, forming cover shafts, wherein the cover shafts form a frame for said cover, whereby the operator is provided enhanced concealment or protection from the elements, said cover further defines at least one window comprising four of more window sections, wherein each window section is connected to an adjacent window section with a removable window zipper, whereby each window section is independently opened, wherein at least one window zipper is extended to a bottom edge of the cover sheet forming a door fastener, wherein each window zipper is covered with a rain flap on the exterior of the cover, whereby moisture from rain or snow is directed away from the window fastener, whereby the door fastener is disconnected thereby allowing the user to enter the covered module.

11. A modular system for concealment and shelter for an operator, the system comprising:

a cover sheet of material with a predetermined shape, forming a cover, and at least two cover shafts, connected to the cover, wherein the cover shafts form a frame for said cover, whereby the operator is provided enhanced concealment or protection from the elements, said cover further defines at least one window comprising four of more window sections, wherein each window section is connected to an adjacent window section with a window zipper, whereby each window section is independently opened, wherein the zippers meet forming a first star, the star having a center, and wherein each of the zippers starts fastening at the ends thereof away from the center and finishes fastening at the center.

12. The system of claim 11, further comprising a fifth zipper, wherein the fifth zipper also meets at the center.

13. The system of claim 12, further comprising a second window with a second set of zippers forming a second star, wherein one end of the fifth zipper meets at the center of the first star and the other end of the fifth zipper meets at the center of the second star, connecting both stars, and wherein the fifth zipper starts fastening at the center of the one star and finishes at the center of the other star.

14. The system of claim 11, wherein at least one window zipper is extended to a bottom edge of the cover sheet forming a door fastener, whereby the door fastener is disconnected thereby allowing the user to enter the modular system.

15. A method of deploying the modular system of claim 11, said modular system further comprising a plurality of means for attaching to an attaching structure, the method comprising the steps of:

a) attaching the plurality of attaching means to the attaching structure, c) connecting the cover shafts to the attaching means, forming a frame, and b) placing the cover, on the attaching means to provide concealment.

16. The system of claim 11, wherein the cover shafts comprise a plurality of shaft segments having lengths that are multiples of a predetermined length, each shaft segment having at least one receiving end configured to receive an inserting end, and at least one of said receiving ends being coupled to a respective inserting end.

17. The system of claim 16, wherein a plurality of shaft segment comprises both one of the inserting ends and one of the receiving ends, whereby the inserting end of any of the shaft segments is removeably connected to the receiving end of any other of the shaft segments.

18. The system of claim 17, wherein at least one receiving end of said shaft segments comprises an inwardly protruding dimple, wherein the dimple of at least one receiving end engages a feature of at least one of the inserting ends of another shaft segment.

19. The system of claim 18, wherein the feature comprises threads, whereby said operator threads the threaded inserting end into the receiving end comprising the dimple to make the attachment.

20. The system of claim 17, wherein at least one end of said shaft segments comprises a dimple, wherein the dimple of at least one end engages a feature of at least one of the corresponding ends of another shaft segment.

21. The system of claim 16, further comprising extension shafts having the predetermined length, wherein at least one of the cover shafts is extended by the predetermined length by removably attaching an extension shaft.

22. The system of claim 21, wherein the operator adjusts the length of the cover shafts by adding or removing extension shafts, wherein the covered module is supported in a substantially horizontal position relative to the general surface of the earth while the configuration is located on a steep hillside, on rough, irregular terrain, or amid large obstacles.

23. The system of claim 11, wherein the cover further comprises reinforced holes there through at predetermined locations whereby selected ones of the shafts pass through the reinforced holes of the material.

24. The system of claim 11, wherein the cover shafts are configured as intersecting arches, and the cover sheet is formed from four cover panels such that the system substantially has a rectangular dome shape.

25. The system of claim 11, further comprising:

a) at least one window section loop connected to a first window section, and b) at least one window section attachment connected to another non-adjacent window section, wherein each window section loop is removably connected to at least one window section attachment, wherein the first window section is closed while at least one adjacent section is open.

26. The system of claim 11, further comprising a plurality of means for attaching to an attaching structure, wherein the cover shafts are attached to the attaching means, wherein the attaching means are attached to the attaching structure.

27. The system of claim 26, wherein the attaching structure is a pole.

28. The system of claim 26, wherein the attaching structure is a scaffold.

29. The system of claim 26, wherein the scaffold is a freestanding metal structure.

* * * * *